US008895458B2

(12) United States Patent
Nonaka et al.

(10) Patent No.: US 8,895,458 B2
(45) Date of Patent: Nov. 25, 2014

(54) ABRASIVE CLOTH AND METHOD FOR PRODUCING NANOFIBER STRUCTURE

(75) Inventors: Shuichi Nonaka, Otsu (JP); Yoshihiro Naruse, Otsu (JP); Takashi Ochi, Mishima (JP); Takeo Matsunase, Moriyama (JP)

(73) Assignee: Toray Industries, Inc., Tokyo (JP)

( * ) Notice: Subject to any disclaimer, the term of this patent is extended or adjusted under 35 U.S.C. 154(b) by 760 days.

(21) Appl. No.: 11/578,926

(22) PCT Filed: Apr. 20, 2005

(86) PCT No.: PCT/JP2005/007949

§ 371 (c)(1),
(2), (4) Date: Oct. 19, 2006

(87) PCT Pub. No.: WO2005/102604

PCT Pub. Date: Nov. 3, 2005

(65) Prior Publication Data

US 2007/0218279 A1 Sep. 20, 2007

(30) Foreign Application Priority Data

Apr. 21, 2004 (JP) ..... 2004-125293
Apr. 21, 2004 (JP) ..... 2004-125511

(51) Int. Cl.
*D04H 1/00* (2006.01)
*B24B 37/24* (2012.01)
*D04H 1/42* (2012.01)

(52) U.S. Cl.
CPC . *B24B 37/24* (2013.01); *D04H 1/42* (2013.01)
USPC ..... 442/351; 442/60; 442/164; 442/168; 442/334; 442/340; 442/381

(58) Field of Classification Search
USPC ..... 442/164, 168, 334, 340, 351, 381, 60
See application file for complete search history.

(56) References Cited

U.S. PATENT DOCUMENTS 3,828,934 A * 8/1974 Green et al. ..... 210/457
3,974,072 A * 8/1976 Birchall et al. ..... 508/111

(Continued)

FOREIGN PATENT DOCUMENTS

JP 6220151 8/1994
JP 10-53967 2/1998

(Continued)

OTHER PUBLICATIONS

"Extrusion Polymerization: Catalyzed Synthesis of Crystalline Linear Polyethylene Nanofibers Within a Mesoporous Silica", Keisuke Kageyama et al. vol. 285, (1999), pp. 2113-2115.

(Continued)

*Primary Examiner* — Andrew Piziali
(74) *Attorney, Agent, or Firm* — RatnerPrestia

(57) ABSTRACT

An abrasive cloth which comprises an article in a sheet form having, in at least a part thereof, nanofibers comprising a thermoplastic polymer and having a number average single fiber fineness of $1\times10^{-8}$ to $2\times10^{-4}$ dtex wherein the sum of single fiber fineness percentages (which is defined in the specification) of a single fiber fineness of $1\times10^{-8}$ to $2\times10^{-4}$ dtex is the range of 60% or more, and exhibits a stress at 10% elongation in a longitudinal direction of 5 to 200 N/cm-width; and a method for preparing a nanofiber structure, which comprises providing a nanofiber dispersion having a dispersant and, dispersed therein, nanofibers comprising a thermoplastic polymer and having a number average diameter of 1 to 500 nm, attaching the dispersion to a support, and then removing said dispersant. The above abrasive cloth is excellent in texturing characteristics, and the above method allows the preparation of a nanofiber structure wherein nanofibers form a composite with the support.

14 Claims, 13 Drawing Sheets

(56) References Cited

U.S. PATENT DOCUMENTS

| | | | | |
|---|---|---|---|---|
| 4,147,574 | A * | 4/1979 | Setsuie et al. | 156/62.4 |
| 4,186,101 | A * | 1/1980 | Reinhardt | 210/497.01 |
| 4,966,808 | A * | 10/1990 | Kawano | 442/201 |
| 5,035,240 | A * | 7/1991 | Braun et al. | 128/205.27 |
| 2002/0073849 | A1 * | 6/2002 | Buettner et al. | 95/280 |
| 2002/0092423 | A1 * | 7/2002 | Gillingham et al. | 95/287 |
| 2003/0190383 | A1 * | 10/2003 | Kim | 425/110 |

FOREIGN PATENT DOCUMENTS

| | | | |
|---|---|---|---|
| JP | 2001-1252 | A | 1/2001 |
| JP | 2001-315056 | A | 11/2001 |
| JP | 2002-79472 | | 3/2002 |
| JP | 2002-224945 | | 8/2002 |
| JP | 2002-327386 | A | 11/2002 |
| JP | 200394320 | | 4/2003 |
| JP | 2003-170347 | A | 6/2003 |
| JP | 2003170348 | | 6/2003 |
| JP | 200442244 | | 2/2004 |
| KR | 2003-0008049 | | 1/2003 |
| KR | 10-2003-0062343 | | 7/2003 |
| WO | WO 97/23266 | | 7/1997 |
| WO | WO02/43921 | | 6/2002 |
| WO | WO 03/033815 | A2 | 4/2003 |
| WO | WO2004/016852 | A2 | 2/2004 |

OTHER PUBLICATIONS

"Beaded Nanofibers Formed During Electrospinning", H. Fong et al. (1999), pp. 4585-4592.

International Search Report dated Aug. 16, 2005, application No. PCT/JP2005/007949.

European Search Report dated Jul. 20, 2009, application No. EP08016899.

Korean Office Action dated Nov. 19, 2011, application No. 10-2006-7021489.

* cited by examiner

ABRASIVE CLOTH AND METHOD FOR PRODUCING NANOFIBER STRUCTURE

This is a U.S. National Phase application of application number PCT/JP2005/007949, filed Apr. 20, 2005.

TECHNICAL FIELD

The present invention relates to an abrasive cloth, and more particularly, to an abrasive cloth used for texturing during the texturing of a substrate and a subsequent formation thereon of a magnetic recording layer to thereby produce a magnetic recording medium.

The present invention also relates to a method for producing a nanofiber structure in which a support is conjugated with nanofibers.

BACKGROUND ART

In recent years, a magnetic recording medium such as a magnetic disk has been requiring increases in capacity and recording density due to remarkable technical innovation; hence an increase in precision in surface processing of various substrates has also been required.

Along with the increases in capacity and recording density of recent years, a spacing between a recording disk and a magnetic head, i.e., the floating height of the magnetic head has been becoming significantly low, and lowering the floating height of the magnetic disk causes a contact between a projection and the magnetic head hence a head crash if there is the projection on the surface of the magnetic disk, resulting in scratches on the disk surface. Also, even with a minute projection that does not cause the head crash, the contact with the magnetic head causes an error that occurs during reading and writing of information. Furthermore, the magnetic head is brought into sticking with the surface of the magnetic disk to thereby cause the trouble of not being floated.

As means for preventing the close contact between the recording disk and the magnetic head, surface processing referred to as texturing in which minute streaks are formed on the surface of the recording disk has been performed. The texturing enables a coercive force in a recording direction, i.e., the recording density of the disk to be increased by controlling the orientation of crystal growth at the time of formation of a metal magnetic layer onto the disk substrate.

As a texturing method, a method such as slurry polishing in which slurry composed of abrasive grains is attached onto the surface of an abrasive cloth and polishing is performed with the cloth, has been used. However, in the case of texturing, it can be said that waviness after the polishing should be reduced and a hard disk surface currently having an average surface roughness of 1 nm or more should be further smoothed in order to meet the increase in recording density due to the recent rapid increase in recording capacity (a target average surface roughness is 0.5 nm or less). For this reason, the attainment of fibers further made finely thinner has been desired for the abrasive cloth for polishing a hard disk surface.

However, the abrasive cloth that utilizes a current sea-island type conjugate fiber spinning technology has a limitation of a single fiber fineness of 0.01 dtex (equivalent to a diameter of 1 μm), and therefore has not had a sufficient level that can respond to the above-described needs (Patent Literature 1).

Also, a method for obtaining an ultrafine nonwoven fabric made of polymer blend fibers has been described (Patent Literature 2); however, a single fiber fineness obtained by it is 0.001 dtex (equivalent to a diameter of 0.3 μm) at the finest level, which has not also been a sufficient level that is able to respond to the above-described needs. Furthermore, an abrasive cloth with a single fiber fineness of 0.3 dtex or below using polymer blend fibers has been disclosed (Patent Literature 3), and the literature has also described that a single fiber fineness of 0.0003 dtex (equivalent to a diameter of 0.2 μm) can be obtained, which is certainly ultrafine as a single fiber fineness. However, it has also described that the obtained single fiber fineness of the ultrafine yarns described in Patent Literature 3 is decided by dispersion of an island polymer in the polymer blend fibers, and since, in a polymer blend system used in Patent Literature 3, the dispersion of the island polymer is not sufficiently carried out, a single fiber fineness of 0.0003 dtex (equivalent to a diameter of 0.2 μm) and that of 0.004 dtex (equivalent to a diameter of 0.6 μm) are mixed, resulting in a large variation of a single fiber fineness in obtained ultrafine yarns. In addition, in the case where they are used for the above-described surface abrasive cloth for a hard disk, abrasive grains cannot be uniformly carried on the abrasive cloth due to the large variation in fineness, and consequently there has arisen the problem that smoothness of the surface of the hard disk is rather reduced.

Meanwhile, as a technology for making the fibers comprising a nonwoven fabric finely thinner, an electrospinning has been attracting attention in recent years.

This is a technology in which a polymer is dissolved in an electrolyte solution and then extruded from a spinneret, and in the process of this, a high voltage of several thousands to thirty thousands is impressed to the polymer solution, and then fibers are made finely thinner by the high-speed jet of the polymer solution followed by bending and expansion of the jet. Using this technology may enable a single fiber fineness of the order of $10^{-5}$ dtex (equivalent to a single fiber diameter of several tens nm) to be provided, which is 1/100 or less in fineness, or 1/10 or less in diameter in comparison with the conventional polymer blend technology. A polymer that can be subjected to the technology is mostly a biopolymer such as collagen, or a water-soluble polymer; however, a thermoplastic polymer may be dissolved in an organic solvent to be then processed by the electrospinning. However, as has been described in the literature "Polymer, vol. 40, 4585 (1999)" (Nonpatent Literature 1), strings that are ultrafine yarn parts are connected therebetween by beads (diameter of approximately 0.5 μm) that are polymer puddle parts in many cases, and therefore there has been a large variation in single fiber fineness in a nonwoven fabric in terms of an ultrafine fiber nonwoven fabric. For this reason, an attempt to suppress generation of beads to thereby uniform a fiber diameter has been made; however, the variation has still been large (Nonpatent literature 2).

Also, a nonwoven fabric obtained by the electrospinning is provided by evaporation of a solvent in the process of fiberization, and therefore a resulting fiber aggregate is not orientationally crystallized in many cases and its strength is also lower than that of a conventional nonwoven fabric, which have been causing a large limitation to an application development. In addition, the electrospinning itself has had a big problem as a producing method, i.e., there have been problems that a size of a resulting nonwoven fabric is as small as approximately 100 $cm^2$, and productivity is at most several grams per hour that is considerably lower than that of conventional melt spinning. There have further been problems that a high voltage is required, and an organic solvent and ultrafine yarns float in the air.

Also, as a method for producing an ultrafine fiber nonwoven fabric, a procedure utilizing cellulose fibrils has been known (Patent Literature 4). More specifically, this is a procedure in which a beating technique for pulp is applied to cuprammonium rayon to thereby fine the average diameter of fibers down to approximately 200 to 300 nm, and then the fined fibers are arranged in a mesh-like form on an ultrafine fiber nonwoven fabric made of polyester by a papermaking method.

However, the beating technique that has been conventionally established is intended for only cellulose, and it has not been possible to fine a synthetic polymer such as polyester or nylon down to its diameter of 200 to 300 nm by beating. This has been because cellulose is originally composed of microfibril aggregates whereas the synthetic polymer does not have such a clear fibril structure and therefore the beating does not cause fibrillation but pulverization. In addition, Patent Literature 4 describes a method for inducing acetic acid bacteria to produce cellulose and then configuring a structure in which cellulose nanofibers are arranged in a mesh-like form on an ultrafine fiber nonwoven fabric made of polyester. Industrial utilization of the method has been difficult, however, since the productivity of this method is too low.

Meanwhile, cellulose fibers as described above have had the problem of their essentially having poor dimensional stability due to the presence of water or moisture. Therefore nanofibers made of a synthetic polymer having good dimensional stability have been required.

Also, cellulose fibrils obtained by the conventional beating technique cannot be produced with uniform fiber diameters, which is likely to cause nonuniform pore diameters, and therefore a procedure other than cellulose fibrillation has been required.

Furthermore, also in order to control the chemical resistance, thermal resistance, affinity with a support, and the like of ultrafine fibers forming into a mesh-like structure, a method for producing the mesh-like structure composed of nanofibers made of a synthesis polymer that has a wide variety of types, instead of cellulose, has been required.

As described above, an attainment of fibers to be referred to as nanofibers, which have no limitations on the shape or polymer used in the production, can be widely applied and developed, exhibit a small variation in single fiber finenesses and have an extremely small single fiber diameter, has been required.

Also, in order to perform more precise polishing, it is required that the fibers comprising an abrasive cloth be finer in diameter and the sheet be softer; the polishing rate achieved using, such a cloth, however, is correspondingly reduced. Accordingly, in order to obtain sufficient polishing rate, a procedure in which the tension applied to the abrasive cloth during polishing is set higher thereby enhancing contact between the abrasive cloth and the polishing target has commonly be used. However, setting the tension higher causes problems such as reduced stability during processing and elongation of the abrasive cloth sheet. This in turn may lead to other problems including the occurrence of defects such as scratches on the surface of the polishing target. Therefore in order to prevent the above problems, the attainment of an abrasive cloth that can resist such higher tension has been required.

Patent Literature 1: Japanese Patent Unexamined Publication No. 2002-224945

Patent Literature 2: Japanese Patent Unexamined Publication No. Hei10-53967

Patent Literature 3: Japanese Patent Unexamined Publication No. 2002-79472

Patent Literature 4: International Published Patent Application No. 97/23266 pamphlet Nonpatent Literature 1: Polymer, vol. 40, 4585 (1999)

Nonpatent Literature 2: Science, vol. 285, 2113 (1993)

DISCLOSURE OF INVENTION

An object of the present invention is to provide a novel abrasive cloth having excellent polishing characteristics by suppressing elongation of the cloth during polishing by using unprecedented nanofibers having a small variation in single fiber finenesses.

Also, another object of the present invention is to provide a novel method for producing a nanofiber structure, by which a nanofiber structure, comprising nanofibers made of a thermoplastic polymer that are readily arranged on a support in a desired mesh-like form, can be produced.

In order to solve the above problems, the present invention comprises the following configurations.

(1) An abrasive cloth comprising a sheet-like material having at least in its part nanofibers made of a thermoplastic polymer, the nanofibers having a number average single fiber fineness of $1\times10^{-8}$ to $4\times10^{-4}$ dtex in which the sum of fineness ratios of single fiber finenesses in the range of $1\times10^{-8}$ to $4\times10^{-4}$ dtex is 60% or more, wherein the stress at 10% elongation in a longitudinal direction is in the range of 5 to 200 N/cm width.

(2) An abrasive cloth comprising a sheet-like material having at least in its part nanofibers made of a thermoplastic polymer, the nanofibers having a number average single fiber fineness of $1\times10^{-8}$ to $2\times10^{-4}$ dtex in which the sum of fineness ratios of single fiber finenesses in the range of $1\times10^{-8}$ to $2\times10^{-4}$ dtex is 60% or more, wherein the stress at 10% elongation in a longitudinal direction is in the range of 5 to 200 N/cm width.

(3) The abrasive cloth described in the above (1) or (2), wherein 50% or more of the nanofibers in a single fiber fineness ratio falls within 30 nm in a single fiber diameter difference.

(4) The abrasive cloth described in any one of the above (1) to (3), wherein the sheet-like material is made of a nonwoven fabric.

(5) The abrasive cloth described in any one of the above (1) to (3), wherein the sheet-like material is made of a woven fabric.

(6) The abrasive cloth described in any one of the above (1) to (3), wherein the sheet-like material is made of a knitted fabric.

(7) The abrasive cloth described in any one of the above (1) to (6), wherein the ratio S between a value of compressive elasticity of the sheet-like material under a load of 0.1 kg/cm$^2$ and that under a load of 0.5 kg/cm$^2$ is 4.0 or less.

(8) The abrasive cloth described in any one of the above (1) to (7), wherein an abrasion resistance coefficient of the sheet-like material is 50 mg or less.

(9) The abrasive cloth described in any one of the above (1) to (8), wherein a surface roughness value of the sheet-like material is 100 μm or less.

(10) The abrasive cloth described in any one of the above (1) to (9), wherein a surface hardness value of the sheet-like material is 20 or more.

(11) The abrasive cloth described in any one of the above (1) to (10), wherein the sheet-like material has at least on its one surface a napped surface composed of the nanofibers.

(12) The abrasive cloth described in any one of the above (1) to (11), wherein the sheet-like material is formed in such a way that nanofibers are laminated on a support.

(13) The abrasive cloth described in the above (12), wherein a thickness of the nanofiber laminated layer is 70% or less of a thickness of the whole sheet-like material.

(14) The abrasive cloth described in any one of the above (1) to (13), wherein the sheet-like material has a space inside thereof, and the space is impregnated with a polymeric elastomer.

(15) The abrasive cloth described in the above (14), wherein the polymeric elastomer is polyurethane.

(16) The abrasive cloth described in the above (14) or (15), wherein a content of the polymeric elastomer is in the range of 20 to 60 wt. % of a fiber weight of the sheet-like material.

(17) A method for producing a nanofiber structure, wherein a nanofiber dispersion liquid in which nanofibers having a number average diameter of 1 to 500 nm and made of a thermoplastic polymer are dispersed in a dispersion medium is attached to a support, and then the dispersion liquid is removed.

(18) The method for producing a nanofiber structure described in the above (17), wherein the nanofibers made of the thermoplastic polymer have a number average diameter of 1 to 200 nm.

(19) The method for producing a nanofiber structure described in the above (17) or (18), wherein in order to attach the nanofiber dispersion liquid to the support, the nanofiber dispersion liquid is sprayed to be thereby attached.

(20) The method for producing a nanofiber structure described in the above (17) or (18), wherein in order to attach the nanofiber dispersion liquid to the support, the support is immersed into the nanofiber dispersion liquid to be thereby attached with the nanofiber dispersion liquid.

(21) The method for producing a nanofiber structure described in the above (17) or (18), wherein in order to attach the nanofiber dispersion liquid to the support, the nanofiber dispersion liquid is coated on the support.

(22) The method for producing a nanofiber structure described in any one of the above (17) to (21), wherein a porous support is used as the support.

(23) A method for producing a nanofiber structure, wherein nanofibers having a number average diameter of 1 to 500 nm and made of a thermoplastic polymer are dispersed in a dispersion medium to thereby prepare a nanofiber dispersion liquid, and then the nanofiber dispersion liquid is subjected to papermaking with a use of a porous support as a base.

(24) The method for producing a nanofiber structure described in any one of the above (17) to (23), wherein a concentration of the nanofibers contained in the nanofiber dispersion liquid is in the range of 0.0001 to 1 wt. %.

(25) The method for producing a nanofiber structure described in any one of the above (17) to (23), wherein a concentration of the nanofibers contained in the nanofiber dispersion liquid is in the range of 0.001 to 0.1 wt. %.

(26) The method for producing a nanofiber structure described in any one of the above (17) to (25), wherein a concentration of a dispersant contained in the nanofiber dispersion liquid is in the range of 0.00001 to 20 wt. %.

(27) The method for producing a nanofiber structure described in any one of the above (17) to (25), wherein a concentration of a dispersant contained in the nanofiber dispersion liquid is in the range of 0.0001 to 5 wt. %.

(28) The method for producing a nanofiber structure described in the above (26) or (27), wherein the dispersant is at least one type selected from the group consisting of a nonionic dispersant, an anionic dispersant, and a cationic dispersant.

(29) The method for producing a nanofiber structure described in the above (28), wherein a zeta potential of the nanofiber falls within the range of −5 to +5 mV, and the dispersant is the nonionic dispersant.

(30) The method for producing a nonfiber structure described in the above (28), wherein a zeta potential of the nanofiber is not less than −100 mV and less than −5 mV, and the dispersant is the anionic dispersant.

(31) The method for producing a nanofiber structure described in the above (28), wherein a zeta potential of the nanofiber exceeds +5 mV and is not more than 100 mV, and the dispersant is the cationic dispersant.

(32) The method for producing a nanofiber structure described in any one of the above (26) to (31), wherein a molecular weight of the dispersant is in the range of 1000 to 50000.

(33) The method for producing a nanofiber structure described in any one of the above (17) to (32), wherein a fiber ratio of single fibers contained in the nanofibers and falling within a diameter range more than 500 nm and not more than 1 μm is 3% or less.

(34) The method for producing a nanofiber structure described in any one of the above (17) to (33), wherein the support is composed of at least one structure selected from the group consisting of a nonwoven fabric, paper, a woven fabric, a knitted fabric, and foam.

Effect of the Invention

According to the present invention, an abrasive cloth having excellent polishing characteristics can be provided by suppressing elongation during polishing by using unprecedented nanofibers having a small variation in single fiber fineness.

Also, according to a method for producing a nanofiber structure of the present invention, nanofibers made of a melt-spinnable thermoplastic polymer can readily be arranged in a desired mesh-like form on a support, enabling the production of a nanofiber structure comprising intended capabilities with high productivity and without any occurrence of problems in the process of production.

EXPLANATIONS OF NUMERALS

Figure 1:
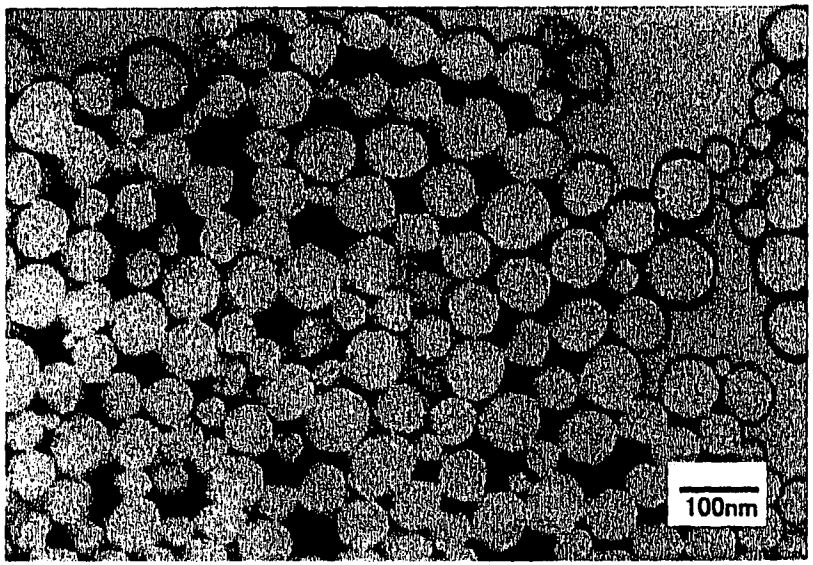
FIG. 1 is a TEM photograph showing a cross-section of a nylon nanofiber, which is one example of a nanofiber of the present invention.

1: hopper,
2: melting section,
3: spinning block,
4: spinning pack,
5: spinneret,
6: chimney,
7: yarn,
8: collecting/oiling guide,
9: first take-up roller,
10: second take-up roller,
11: wound yarn,
12: metering section,
13: discharge hole length,
14: discharge hole diameter,
15: undrawn yarn,
16: feed roller,
17: first hot roller,
18: second hot roller,
19: third roller (room temperature),
20: drawn yarn,
21: twin-screw extruding kneader
22: chip weighing device.

BEST MODE FOR CARRYING OUT THE INVENTION

An abrasive cloth of the present invention and a method for producing a nanofiber structure of the present invention will hereinafter be described in more detail; however, prior to the description, definitions of the term "nanofiber" to be used for descriptions of both inventions will be explained. Although nanofibers themselves have almost no difference between both inventions, they are defined as having a slightly different meaning therebetween in the present invention.

In other words, when "an invention of an abrasive cloth" is described herein, a concept of the nanofiber refers to a fiber having a single fiber diameter of 1 to 250 nm (in the case of a nylon 6 fiber (hereinafter sometimes referred to as N6), $1\times10^{-8}$ to $6\times10^{-4}$ dtex).

However, when "an invention of a method for producing a nanofiber structure" is described herein, a concept of the nanofiber refers to a fiber having a single fiber diameter of 1 to 1000 nm (1 μm).

The difference between the two definitions is associated with a point whether or not nanofibers that have a single fiber diameter more than 250 nm and less than 1000 nm are included in a parent population when "a single fiber fineness of a nanofiber" or "a single fiber diameter of a nanofiber" is calculated as the average value of measurement values for multiple fibers in the description of each invention. That is, in the case of "the invention of an abrasive cloth", they are not included whereas in the case of "the invention of a method for producing a nanofiber structure", they are included.

In any of the present inventions, a primarily common assumption is that the concept of the nanofiber is essentially a general term of a fiber having a single fiber diameter of 1 to 1000 nm (1 μm); however, in the case of "the invention of an abrasive cloth", a structural feature as the abrasive cloth can be clarified by a discussion based on the average value obtained by using fibers each having a single fiber diameter of 1 to 250 nm (in the case of N6, $1\times10^{-8}$ to $6\times10^{-4}$ dtex) as a parent population in order to perform good texturing with higher precision, rather than by a discussion based on the average value obtained by using fibers including those each having a diameter more than 250 nm and less than 1000 nm.

On the other hand, since in the case of "the invention of a method for producing a nanofiber structure", the structure is not limited to specified applications or fields the technology is not necessarily based on such a fine single fiber diameter, and a technical feature can rather be clarified by the discussion based on the average value obtained by using fibers including those each having a diameter more than 250 nm and less than 1000 nm.

However, in either case, there is no large difference in various average values and distributions of the nanofibers intended by the present invention between the case where the fibers each having a diameter more than 250 nm and less than 1000 nm are included and that where they are not included.

The reason is that, according to the present invention, the fibers each having a single fiber diameter range of 1 to 250 nm can be usually obtained and most of fibers fall within the range, so that the parent population is mostly occupied by such fibers.

On the assumption of the above, the description is hereinafter provided.

Firstly, a first requirement of the abrasive cloth of the present invention is that the abrasive cloth comprises a sheet-like material having in its part nanofibers that are made of a thermoplastic polymer and have a number average single fiber fineness of $1\times10^{-8}$ to $4\times10^{-4}$ dtex in which the sum of fineness ratios of single fiber finenesses in the range of $1\times10^{-8}$ to $4\times10^{-4}$ dtex is 60% or more.

Note that as described above, in the present invention, the nanofiber refers to a single fiber having a diameter ranging from 1 to 1000 nm (1 μm); however, specifically and more preferably, a fiber having an average single fiber diameter of 1 to 250 nm (in the case of N6, $1\times10^{-8}$ to $4\times10^{-4}$ dtex) is used as the nanofiber.

Morphologically, it is a general term for all including single fibers completely dispersed, single fibers partially bonded, and aggregates (such as bundles) in which a plurality of single fibers are aggregated, and a fiber length and a cross-sectional shape of each of them are not limited.

In the present invention, the average value and variation of the single fiber finenesses are important.

These can be obtained by performing at three or more points a procedure in which a cross section of a sheet-like material (abrasive cloth) containing nanofibers is observed through a transmission electron microscope (TEM) or a scanning electron microscope (SEM) and diameters of 50 or more single fibers randomly sampled are measured, to thereby measure at least total of 150 single fiber diameters. At this time, fibers each having a diameter exceeding 250 nm are removed, and only those each having a diameter of 250 nm (in the case of nylon 6, $6\times10^{-4}$ dtex (at a specific gravity of 1.14 g/cm$^3$)) or less, i.e., in the range from 1 to 250 nm, are randomly sampled to be measured. Also, in the case where each of nanofibers comprising the sheet-like material has a modified cross-section, a cross-sectional area of a single fiber is first measured, and the area is defined as an area of a circle, assuming that the cross-section takes a form of the circle. Calculating a diameter from the area enables the single fiber diameter to be obtained. The average value of single fiber finenesses is obtained as follows. First, single fiber diameters are measured to one decimal place in nm unit and the first decimal place in each of the diameters is rounded off to the nearest integer. The single fiber finenesses are calculated from the single fiber diameters, and a simple average of them is found. In the present invention, this is referred to as "a number average single fiber fineness". One example of a cross-sectional photograph of the nanofibers is now shown in FIG. 1. In FIG. 1, a measuring scale of 100 nm is also shown, and it turns out that single fiber diameters of almost all the fibers are 100 nm or below.

It is important for the abrasive cloth of the present invention that the number average single fiber fineness of the nanofibers is in the range of $1\times10^{-8}$ to $4\times10^{-4}$ dtex (in the case of nylon 6 (a specific gravity of 1.14 g/cm$^3$), equivalent to a single fiber diameter of 1 to 200 nm). This is as fine as 1/10 to 1/1000 in a single fiber diameter in comparison with an abrasive cloth produced by the conventional sea-island type conjugate fiber spinning, and can lead to an abrasive cloth having a texture completely different from that of the conventional abrasive cloth or an abrasive cloth enabling smoothness of a hard disk to be further improved in comparison with the conventional abrasive cloth. The number average single fiber fineness is preferably from $1\times10^{-8}$ to $2\times10^{-4}$ dtex (in the case of nylon 6 (a specific gravity of 1.14 g/cm$^3$), equivalent to a single fiber diameter of 1 to 150 nm), more preferably from $1\times10^{-8}$ to $1\times10^{-4}$ dtex (in the case of nylon 6 (a specific gravity of 1.14 g/cm$^3$), equivalent to a single fiber diameter of 1 to 100 nm), and further preferably from $0.8\times10^{-5}$ to $6\times10^{-5}$ dtex (in the case of nylon 6 (a specific gravity of 1.14 g/cm$^3$), equivalent to a single fiber diameter of 30 to 80 nm).

Also, the variation in single fiber fineness among the nanofibers comprising the abrasive cloth of the present invention is evaluated as follows. That is, let a single fiber fineness of each of the nanofibers in the abrasive cloth be $dt_i$, and the sum of them be a total fineness ($dt_1+dt_2+\ldots+dt_n$). Also, a frequency (the number) of nanofibers each having a same single fiber fineness is counted, and then let a product of them divided by the total fineness be fineness ratio of the single fiber fineness. This corresponds to a weight fraction (volume fraction) of each single fiber fineness component to all the nanofibers contained in the abrasive cloth, and a single fiber fineness component having a larger fraction value makes a larger contribution to characteristics of the nanofiber abrasive cloth.

In addition, in the present invention, such variation in single fiber fineness among the nanofibers is obtained in a similar manner to the above-described procedure for obtaining the average value of single fiber finenesses, i.e., it is obtained by performing at three or more points the procedure in which a cross section of a sheet-like material (abrasive cloth) containing nanofibers at least in its part is observed through a transmission electron microscope (TEM) or a scanning electron microscope (SEM) and single fiber diameters of fifty nanofibers or more that are randomly sampled are measured, to thereby measure at least a total of 150 single fiber diameters or more, and it is only necessary to obtain it as an N number similar to the above-described case of obtaining the average value of single fiber finenesses.

In the present invention, it is important that 60% or more of the total fineness ratio falls within the range of $1\times10^{-8}$ to $4\times10^{-4}$ dtex (in the case of nylon 6 (a specific gravity of 1.14 g/cm$^3$), equivalent to a single fiber diameter of 1 to 200 nm). In other words, it means that the number of nanofibers each having a fineness more than $4\times10^{-4}$ dtex is nearly equal to zero. As well as sufficiently fulfilling the function of a nanofiber abrasive cloth, this enables the stability of product quality to be improved, and further abrasive grains to be uniformly carried onto the abrasive cloth due to a remarkably low variation in fineness, resulting in enabling the smoothness of a hard disk surface to be significantly improved. Preferably, 60% or more of the total fineness ratio falls within the range of $1\times10^{-8}$ to $2\times10^{-4}$ dtex (in the case of nylon 6 (a specific gravity of 1.14 g/cm$^3$), equivalent to a single fiber diameter of 1 to 150 nm), more preferably the range of $1\times10^{-8}$ to $1\times10^{-4}$ dtex (in the case of nylon 6 (a specific gravity of 1.14 g/cm$^3$), equivalent to a single fiber diameter of 1 to 100 nm), and further preferably the range of $1\times10^{-8}$ to $6\times10^{-5}$ dtex (in the case of nylon 6 (a specific gravity of 1.14 g/cm$^3$), equivalent to a single fiber diameter of 1 to 80 nm). Still further preferably, 75% or more of the total fineness ratio falls within the range of $0.8\times10^{-5}$ to $6\times10^{-5}$ dtex (in the case of nylon 6 (a specific gravity of 1.14 g/cm$^3$), equivalent to a single fiber diameter of 30 to 80 nm).

The thermoplastic polymers in the present invention include polyester (hereinafter sometimes referred to as PET), polyamide, polyolefin, and polyphenylene sulfide (hereinafter sometimes referred to as PPS), and many of polycondensation polymers represented by polyester and polyamide are more preferable because of their higher melting points. If the melting point of a polymer is 165° C. or higher, thermal resistance of resultant nanofibers is good enough, which is preferable. For example, the melting point of polylactic acid (hereinafter sometimes referred to as PLA) is 170° C., that of PET is 255° C., and that of N6 is 220° C. Also, the polymer may have additives such as grains, flame retardant, and antistatic agent. In addition, other constituents may be copolymerized to the extent that do not damage characteristics of the polymer. Still furthermore, the polymer having the melting point of 300° C. or below is preferable due to its easiness in melt spinning.

As the sheet-like material in the present invention, a nonwoven fabric obtained in such a way that short fibers are arranged in a direction of a sheet width by using a carding machine and a crosslapper to form a laminated web and then followed by needle punching, directly formed by fiber spinning such as melt-blowing or spun-bonding, or obtained by a papermaking method; a material in which nanofibers are attached onto a support by spraying, immersing, or coating; or a woven/knitted fabric is preferably used. Among them, a nonwoven fabric in which a short fiber web is needle punched, a material obtained by wet papermaking, or a high density woven fabric is preferable as the abrasive cloth since a material having a high entanglement of ultrafine fibers, high denseness of surface fibers, and a low variation in surface fiber density is preferable in order to uniformly carry abrasive grains.

A needling density at which the short fiber web is needle punched is preferably 1000 to 3500 needles/cm$^2$ from the of higher densification of fibers (formation of a dense napped surface) due to a higher entanglement of the fibers. If it is less than 1000 needles/cm$^2$, the denseness of surface fibers of an abrasive cloth is poor, which is unfavorable, and if it exceeds 3500 needles/cm$^2$, processability is deteriorated as well as damage to fibers becomes significant, which is also unfavorable. A unit weight is preferably 3 g/m$^2$ or more in the case of the wet papermaking, or such that warp and weft cover factor values of a woven fabric are respectively 500 or more in the case of the high density woven fabric, and if the cover factors are less than 400, voids among single fibers becomes large, resulting in poor denseness.

Note that the warp cover factor value and the weft cover factor value are respectively expressed by the following expressions:

$$\text{Warp cover factor value} = \text{warp weaving density [yarns/inch]} \times (\text{warp fineness [dtex]})^{1/2}, \text{ and}$$

$$\text{Weft cover factor value} = \text{weft weaving density [yarns/inch]} \times (\text{weft fineness [dtex]})^{1/2}.$$

The method for producing the above-described short fiber web or the fibers for directly obtaining the sheet-like material is not particularly limited, and a material obtained by single component fiber spinning, sea-island type conjugate fiber spinning, or splittable conjugate fiber spinning may be employed. Among them, a material in which a readily soluble polymer is eluted from the sea-island type conjugate fiber comprising the readily soluble polymer as the sea component and a polymer alloy, which is a precursor to the nanofiber of the present invention, as the island component, enables a fiber diameter in an nanofiber aggregate to be reduced. The number of scratches can thus be reduced at the time of polishing by using this material as an abrasive cloth, and therefore such a material is preferable. Furthermore, a material in which a readily soluble polymer is eluted from an island core-sheath type sea-island conjugate fiber composed of: a core-sheath type island component having a polymer alloy as the sheath part and a slightly soluble polymer as the core part; and a sea component having the readily soluble polymer becomes a core-sheath type ultrafine fiber that has a small fiber diameter and also takes a configuration in which a nanofiber sheath is arranged around a slightly soluble island. Using this material as an abrasive cloth, at the time of polishing thus not only enables the number of scratches to be reduced but also the polishing rate to be increased since the core is hard to some extent.

Also, a material obtained in such a way that a dividable conjugate fiber arranged at least in its parts with a polymer alloy is divided and then a readily soluble polymer in the polymer alloy is eluted allows the effect similar to the above-described sea-island type conjugate fiber case to be achieved.

As elongation characteristics of the abrasive cloth of the present invention, it is important that the stress at 10% elongation in the longitudinal direction of the abrasive cloth under dry conditions (under the conditions of a room temperature of 20° C. and a humidity of 40%) is 5 to 200 N/cm width.

From the perspective of processing efficiency and stability, as a method for texturing by using the abrasive cloth of the present invention, the abrasive cloth is cut into a tape-like form having a width of 30 to 50 mm and then used.

Then, while the abrasive cloth having the tape-like form is brought into contact with a substrate in a state where the substrate is continuously rotated, the abrasive cloth or the substrate is reciprocated in the radial direction of the substrate to be thereby continuously run. During the running, slurry containing free abrasive grains is supplied and attached to the surface of the abrasive cloth having the tape-like form, to thereby polish a surface of an aluminum alloy magnetic recording disk or a glass magnetic recording disk, which is a preferred method. As a condition for the polishing, slurry in which abrasive grains with high hardness, such as diamond microparticles, are dispersed in an aqueous dispersion medium is preferably used.

In order to uniformly control the contact of the surface of the abrasive cloth with the substrate to thereby perform uniform polishing when a surface of the substrate is polished with the abrasive cloth having the surface with the slurry attached, it is preferable to perform the polishing under the condition that a working tension of approximately 10 to 20 N is applied to the abrasive cloth.

Controlling the stress at 10% elongation in the longitudinal direction of the abrasive cloth to be 5 to 200 N/cm width enables the elongation percentage of the abrasive cloth having the tape-like form to be suppressed to 3% or less, ultra-precise surface roughness to be attained without a reduction in the denseness of surface fibers, and the number of scratch defects to be suppressed to a lower level.

A case where the stress at 10% elongation in the longitudinal direction of the abrasive cloth is less than 5 N/cm width is unfavorable. The reason is that elongation of the abrasive cloth under working tension during texturing becomes too large, and therefore the denseness of the surface fibers is reduced and ultra-precise surface roughness cannot be attained, as well as abrasive grains are aggregated in void parts arising from elongation where fibers at the surface of the abrasive cloth are not present, whereby scratch defects are likely to occur.

On the other hand, a case of more than 200 N/cm width is also unfavorable. The reason is that the abrasive cloth in a wet condition due to the slurry containing the free abrasive grains is brought into contact with the surface of the disk, and becomes a dry condition because of the squeezing out of moisture, and consequently the abrasive grains are strongly pressed onto the substrate surface, whereby scratch defects are likely to occur as well as surface roughness becomes larger. More preferably, the stress at 10% elongation is in the range of 10 to 200 N/cm width, and further preferably in the range of 30 to 200 N/cm width.

Means for controlling the stress at 10% elongation in the longitudinal direction of the abrasive cloth to be in the range of 5 to 200 N/cm width for manufacturing include, methods such as, but are not limited to, those described below.

That is, in the case where a sheet-like material to be the abrasive cloth is a nonwoven fabric, the stress at 10% elongation can be attained in such a way that a fiber orientation is arranged by needle punch processing or water jet punch processing to thereby make an adjustment. Or if the stress at elongation cannot be adjusted to 5 N/cm width or more only with the nanofibers, the stress at 10% elongation can be attained by mixture with other fibers each having a single fiber fineness of $1\times10^{-3}$ dtex (in the case of nylon 6 (a specific gravity of 1.14 g/cm$^3$), equivalent to a single fiber diameter of 0.3 μm), a woven/knitted or nonwoven fabric made of the above-mentioned other fibers, a film, or the like is used.

As a method for using the mixture, a laminating method, a bonding method, or a mixing method may be employed.

The laminating method herein means a method for laminating nanofibers onto a sheet-like material made of other fibers, or laminating other fibers onto a sheet-like material made of only nanofibers. Various methods may be employed, for example, a method for laminating nanofibers onto a nonwoven fabric made of other fibers by a papermaking method or an air-laid method, a laminating method by spraying, immersing, or coating a nanofiber dispersion liquid onto various supports to thereby attach nanofibers, or a method for laminating other fibers onto a nonwoven fabric made of nanofibers by any of above methods.

The bonding method herein means a method in which a sheet-like material made of only nanofibers, and another sheet-like material or a film are separately fabricated by an ordinary method, and then stacked and bonded to each other. Various methods may be employed, for example, a method for bonding a sheet-like material made of nanofibers to a sheet-like material made of other fibers or a film with the use of a binder, an entangling method by needle punching or a high-pressure water jet, a method in which other thermofusible fibers are preliminarily mixed into a sheet-like material made of nanofibers or other fibers, and then thermofusing is carried out with a heating roll, a method in which polymer alloy fibers that are nanofiber precursors are directly bonded to a sheet-like material made of other fibers or a film by a melt blow method or a spunbond method, and then a sea component is eluted and removed from the polymer alloy fibers, or a method for directly bonding other fibers to a sheet-like material made of nanofibers by a melt blow method, or a spunbond method.

Among those, the method for bonding a sheet-like material comprising the nanofibers and a film is preferable since it enables stress at elongation to be controlled without any damage to surface smoothness of the abrasive cloth because of superiority in surface smoothness of the film, and thereby highly precise processing to be performed.

As a raw material to be the film herein, the material that has a film form, such as polyolefin series, polyester series, or polyphenylene sulfide series may be used; however, considering versatility, the use of a polyester film is desirable.

Furthermore, the mixing method herein means a formation of a sheet-like material in a state where nanofibers and other fibers are mixed with each other. For example, nanofibers and other fibers are mixed, and then any of various methods including an entangling method by needle punching or a high-pressure water jet, and a mixing and papermaking method may be employed.

In the case where a sheet-like material to be the abrasive cloth is a woven fabric or a knitted fabric, binding force among fibers is high and constituent yarns do not move so much within the fabric, and therefore increasing the number of the yarns per unit area and the amount of fibers makes the density of the fabric higher, thus attaining the stress of 5 N/cm width or more at 10% elongation, or similarly to the above-described nonwoven fabric, the use of a mixture with other fibers each having a single fiber fineness of $1\times10^{-3}$ dtex (in the case of nylon 6 (a specific gravity of 1.14 g/cm$^3$), equivalent to a single fiber diameter of 0.3 μm) or more, or with a woven/knitted or nonwoven fabric made of the above-mentioned other fibers, or with a film enables the stress at elongation to be attained.

Also, depending on required characteristics such as the surface morphology, stress at 10% elongation, strength/elongation, or cushioning properties of a sheet-like material, a mixture with a nonwoven fabric, a woven fabric, or a knitted fabric may be used in a similar manner to the above-described nonwoven fabric case.

Furthermore, as another indicator of a variation in fineness, there is a fineness ratio of single fibers falling within 30 nm in a single fiber diameter difference in the nanofibers within the abrasive cloth, which means the degree of concentration of a variation around the center value of fineness, i.e., it means that the higher this fineness ratio is, the lower the variation is. In the present invention, the single fiber fineness ratio in which the single fiber diameter difference falls within 30 nm (in the case of nylon 6 (a specific gravity of 1.14 g/cm$^3$), equivalent to a single fiber fineness of $8\times10^{-6}$ dtex) is preferably 50% or more, and more preferably 70% or more.

Preferably, in the abrasive cloth of the present invention, the ratio S between a value of compressive elasticity of the sheet-like material under a load of 0.1 kg/cm$^2$ and that under a load of 0.5 kg/cm$^2$ is 4.0 or less. The compressive elasticity ratio S is obtained as follows. That is, by using a measurement method to be described in after-mentioned examples, compressive characteristics of the sheet-like material are first measured, from which a graph of distortion and a compressive load is made. Tangential gradients at 0.1 and 0.5 kg/cm$^2$ are defined as respective compressive elasticity values, and the value obtained by dividing the compressive elasticity value at 0.5 kg/cm$^2$ by that at 0.1 kg/cm$^2$ is defined as S. Smallness in the compressive elasticity ratio S means that a difference in magnitude between a distortion under a low load and that under a high load is small, i.e., even in the case where pressure is locally varied when the sheet-like material is pressed against a polishing target during polishing, the difference in distortion of the sheet-like material is small. This enables not only smoothness of the sheet-like material to be maintained and highly precise polishing to be performed, but also local aggregation of slurry during polishing to be mitigated to thereby suppress the occurrence of scratch defects since appropriate cushioning properties are given to the sheet-like material. Preferably, the compressive elasticity ratio S is 3.0 or less, and more preferably 2.5 or less. A lower limit of the compressive elasticity ratio S is preferably 0.01 or more.

Furthermore, in the sheet-like material, an abrasion resistance coefficient is preferably 50 mg or less. Note that the abrasion resistance coefficient is obtained from the amount of fibers that have dropped off from the sheet-like material by using a measurement method to be described in the after-mentioned examples. If the abrasion resistance coefficient is large, fibers are likely to drop off from the sheet-like material to form pills and slurry is aggregated onto the pills, which is likely to cause scratch defects. For this reason, the sheet-like material that is unlikely to be abraded even during polishing, i.e., the sheet-like material that has small abrasion resistance coefficient is desirable. The abrasion resistance coefficient is preferably 40 mg or less, and more preferably 30 mg or less. A lower limit of the abrasion resistance coefficient is preferably 0.1 mg or more.

In the abrasive cloth of the present invention, a surface roughness of the sheet-like material is preferably 100 μm or less. Note that the surface roughness is obtained by measuring a polishing surface of the sheet-like material, i.e., a surface at which the sheet-like material is brought into contact with a polishing target, by using the measurement method to be described in the after-mentioned examples. Smallness in the surface roughness enables not only surface smoothness of the sheet-like material to be increased to thereby improve a processing precision during polishing, but also abrasive grains to be uniformly gripped due to uniformity of a fiber orientation at the surface of the sheet-like material, whereby aggregation of the abrasive grains are unlikely to occur and an occurrence of scratches can be suppressed. The surface roughness is preferably 60 μm or less, and more preferably 40 μm or less. A lower limit of the surface roughness is preferably 0.5 μm or more.

Also, a surface hardness of the sheet-like material is preferably 20 or more. Note that the surface hardness is obtained by using the measurement method to be described in the after-mentioned examples. A larger surface hardness enables not only durability of the sheet-like material to be improved during polishing, but also surface smoothness of the sheet like material to be maintained due to improvement of form stability of the sheet-like material, and grinding efficiency during polishing to be improved since the sheet-like material has a certain degree of hardness. The surface hardness is preferably 30 or more, and more preferably 40 or more. An upper limit of the surface hardness is preferably 100 or less.

Preferably, in the abrasive cloth of the present invention, at least one surface of the sheet-like material has a napped surface composed of nanofibers. In order to obtain the napped surface, buffing treatment is preferably performed on the sheet-like material. The buffing treatment herein is generally performed by using card clothing or sandpaper. The sheet-like material on which such napping treatment is performed enables uniform and dense napped fibers to be formed, abrasive grains in slurry, which are to be attached during texturing of a hard disk, to be finely dispersed, and highly precise finishing to be attained. In the present invention, it is possible to laminate nanofibers onto a support to thereby form the sheet-like material, and preferably a thickness of the nanofiber laminated layer is 70% or less of that of the whole sheet-like material. Configuring the laminated layer thickness to be 70% or less enables polishing stability to be improved due to reinforcement effects of the support on the sheet-like material. A percentage of the laminated layer thickness is preferably 50% or less, and more preferably 20% or less. A lower limit of the percentage of the laminated layer thickness is preferably 1% or more.

Also, preferably, the sheet-like material has spaces therein, which are impregnated with a polymeric elastomer, and the impregnation can be obtained by providing the polymeric elastomer to the sheet-like material having the spaces.

A polymeric elastomer functions as a cushion for surface irregularities or absorbing vibrations, retention of fiber shape, or the like, and integrating it with the sheet-like material results in excellent fittedness to a polishing target and an excellent suppressive effect on scratches of the polishing target. As such a polymeric elastomer, a urethane-based, silicone-based, or acrylic polymer may be used. Among them, polyurethane is preferable in terms of processability and cushioning properties in the process of the present invention. Furthermore, in the case of polyurethane, as its soft segment, a material composed of polyether series, polyester series, polycarbonate series, or a copolymer of them may be used. Among these types of polyurethane, solely polyether series, or polyurethane copolymerized with at lease one of polyether series, polyester series or polycarbonate series is preferably used in terms of sheet elasticity in order to bring napped fibers at a surface of the abrasive cloth into a dense and uniformly dispersed condition at the time of buffing treatment after polyurethane has been provided. The cushioning properties and fittedness during polishing are important in terms of polishing precision, controlled by the ratio between fibers and a polymeric elastomer, or a void ratio in the sheet-like material, and adjusted depending on the precision or purpose of polishing.

A content of the polymeric elastomer is preferably in the range of 20 to 60 wt. % of a weight of fibers in terms of molding, and the surface condition, void ratio, cushioning properties, hardness, strength and the like of the abrasive cloth can be adjusted by the content. The case of less than 20 wt. % is unfavorable since the cushioning properties become poor and therefore scratches are likely to occur. The case of exceeding 60 wt. % is also unfavorable since processability and productivity become poor as well as the polymeric elastomer is likely to become exposed on a surface, which is likely to cause scratches due to aggregation of abrasive grains.

As a method for providing such a polymeric elastomer, a procedure such as coating or impregnation followed by coagulation may be employed. The content of the polymeric elastomer is measured with the use of the abrasive cloth with an area of 1 $m^2$ as a sample. The content of the polymeric elastomer can be obtained in such a way that the polymeric elastomer is eluted and removed from the abrasive cloth with the sample area of 1 $m^2$ by using a solvent or the like, and then weights before and after the eluting and removing processing are respectively measured.

Meanwhile, in a magnetic recording medium such as a hard disk, a recording capacity and a recording density have been increasing, and accordingly higher precision in polishing of a substrate surface have been required. Therefore, in order to increase precision in polishing, finer and highly dispersed grains for polishing have been used. Along with this, an abrasive cloth has also been required to be a sheet-like material that has a finer fiber diameter, higher dispersibility of fibers, and higher smoothness so as to uniformly grip such finer abrasive grains and not to localize the abrasive grains on a surface of a substrate during polishing. In order to attain the requirements, in the abrasive cloth of the present invention, it is preferable that the nanofibers are dispersed in the sheet-like material to the level as fine as a single fiber, similarly to the abrasive grains.

As described above, in the abrasive cloth of the present invention, it is preferable that nanofibers are well dispersed to the level as fine as a single fiber, and in order to attain this, the present invention also enables a higher-performance abrasive cloth to be produced by employing an after-mentioned method for producing a nanofiber structure.

The method for producing a nanofiber structure according to the present invention will hereinafter be described.

That is, attaching a nanofiber dispersion liquid to a support allows nanofibers to be dispersed in the sheet-like material to the level as fine as a single fiber to thereby obtain a nanofiber structure. Note that the nanofiber structure means, but is not limited to, that in one example, it is further processed to become, e.g., an abrasive cloth.

Employing such a method for producing such a nanofiber structure enables not only nanofibers to be readily dispersed in the sheet-like material but also the arrangement of the nanofibers in the sheet-like material to be desirably controlled, resulting in a high-performance abrasive cloth.

The method for producing a nanofiber structure according to the present invention is described below in more detail.

The term "nanofiber structure" used in the description of the method for producing a nanofiber structure according to the present invention refers to a structure in which nanofibers are arranged in one dimension, two dimensions, or three dimensions, and a two-dimensional or three-dimensional mesh-like structure is preferable.

In the present invention, it is important to first attach to a support a liquid in which nanofibers having a number average diameter of 1 to 500 nm are dispersed in a dispersion medium (hereinafter referred to as a nanofiber dispersion liquid). This method has a significant advantage of very high safeness since employing the method allows for high productivity and absences of harmful organic solvent vapor and floating nanofibers, differently from electrospinning.

Also, in the method for producing a nanofiber structure according to the present invention, it is important that a number average diameter of nanofibers is in the range of 1 to 500 nm. This enables absolute strength required as fibers to be obtained and consequently, when the nanofiber structure is used as a filter, for example, the capturing capability for microparticles can be improved by sufficiently decreasing a pore diameter or significantly increasing a specific surface area while suppressing the breakage of fibers even if objects to be filtered collide. The number average diameter of single nanofibers is preferably in the range of 1 to 200 nm, and more preferably in the range of 30 to 100 nm.

For example, in the case of the nanofiber structure, the number average diameter of single nanofibers can be obtained as follows.

That is, a cross-section of a nanofiber bundle before dispersion into a dispersion medium is observed through a transmission electron microscope (TEM), then cross-sectional areas of 150 or more single fibers randomly sampled in a same cross-section are analyzed with image processing software, and circle-equivalent diameters are obtained. On the other hand, in the case of analyzing diameters of nanofibers having been already dispersed in a dispersion medium, a following procedure may be employed. That is, a liquid in which nanofibers are dispersed is attached onto a sample stage of a scanning electron microscope (SEM), and dried, and then metal evaporation is performed to prepare a sample. The sample is observed through SEM to measure single nanofiber diameters, to be thereby able to obtain the number average diameter in the same manner as above (specific gravity of 1.14 g/cm$^3$).

Furthermore, in the case of analysis with the use of a nanofiber structure, a surface of a nanofiber part may be observed through SEM, or an ultrathin segment may be cut out so as to reveal a cross-section of a nanofiber, which is then observed through TEM.

Still furthermore, a nanofiber to be used for the nanofiber structure of the present invention corresponds to the nanofiber of which a single fiber diameter is more than 500 nm and not more than 1 μm, which is referred as a nanofiber in the present invention; however, a fiber ratio of relatively thick fibers is preferably 3 wt. % or less. Note that the fiber ratio of thick fibers means the ratio of a weight of the thick fibers (each having a diameter more than 500 nm and not more than 1 μm) to a total weight of nanofibers each having a diameter more than 1 nm and not more than 11 m, and is calculated as follows. That is, given that single fiber diameter of each of the nanofibers is di, the sum of a square of it $(d_1^2+d_2^2+\ldots+d_n^2)=\Sigma d_i^2$, (i=1~n) is calculated. Also, given that a fiber diameter of each of the nanofibers that fall within the diameter range more than 500 nm and not more than 1 μm is Di, the sum of a square of it $(D_1^2+D_2^2+\ldots+D_m^2)=\Sigma D_i^2$, (i=1~m) is calculated. Calculating the ratio of $\Sigma D_i^2$ to $\Sigma d_i^2$ enables the area ratio of the thick fibers to all the nanofibers, i.e., the weight ratio to be obtained.

Regarding the nanofibers used for the method for producing a nanofiber structure according to the present invention, the fiber weight ratio of single fibers each having a diameter ranging more than 500 nm and not more than 1 μm is preferable 3% or less, more preferably 1% or less, and further preferably 0.1% or less. In other words, this means that the number of thick fibers each having a diameter exceeding 500 nm is nearly equal to zero.

Also, in the case where the number average diameter is 200 nm or less, a fiber weight ratio of single fibers each having a diameter more than 200 nm is preferably 3% or less, more preferably 1% or less, and further preferably 0.1% or less. Furthermore, in the case where the number average diameter is 100 nm or less, a fiber weight ratio of single fibers each having a diameter more than 100 nm is preferably 3% or less, more preferably 1% or less, and further preferably 0.1% or less. These enable a function of the nanofiber structure obtained by the method for producing a nanofiber structure according to the present invention to be sufficiently fulfilled and the stability of product quality to be improved.

In the method for producing a nanofiber structure according to the present invention, as a procedure for dispersing nanofibers into a dispersion medium, shear force is provided to the nanofibers by using a Niagara beater, a refiner, a cutter, a crusher for laboratory use, a bio-mixer, a mixer for home use, a roll mill, a mortar, or a PFI beater, whereby the nanofibers can be dispersed to the level as fine as one fiber and then given into the dispersion medium. Also, in order to suppress reaggregation of them, a dispersant may be used as appropriate. Furthermore, regarding the dispersion medium, it is not particularly limited; however, the use of water is preferable in terms of safeness.

The nanofiber dispersion liquid obtained as described above is then attached to the support. Note that the attachment of the nanofiber dispersion liquid to the support means the following state.

That is, it means the state where the nanofiber dispersion liquid is being brought into contact with a surface and/or an inside of the support. In such a state, an interaction may or may not exist between the nanofibers and the support. In other words, the nanofiber dispersion liquid may be simply placed on the support, or van der Waals forces, hydrogen bonding, an ion interaction, or the like may act, or alternatively chemical bonding may be created.

A procedure for attaching the nanofiber dispersion liquid to the support is not limited, but may be appropriately selected depending on a purpose.

For example, a first procedure is spraying the nanofiber dispersion liquid to the support. Since the nanofibers used in the present invention hardly include thick fibers each having a single fiber diameter exceeding 500 nm, spraying can be performed even through a fine nozzle of an atomizer, a spray, or the like without blockage, and the nanofiber dispersion liquid can be nebulized and attached to the support. This procedure is effective when a nanofiber layer is desired to be formed onto the support, or when a thickness of the nanofiber layer is desired to be significantly thinned. Adjusting a concentration or spraying time period of the nanofiber dispersion liquid enables the thickness to be thinned to 1 g m or less.

A second procedure for attaching the nanofiber dispersion liquid to the support is immersing the support into the nanofiber dispersion liquid. Procedures for the immersing include completely sinking the support into the nanofiber dispersion liquid, and soaking only the surface. The second procedure facilitates adsorbing the nanofiber dispersion liquid into the support, and particularly in the case where the support is porous, it has an advantage of facilitating a three-dimensional formation of a mesh-like structure composed of the nanofibers inside of the support. Regarding the adsorption of the nanofiber dispersion liquid into the support, a further addition of a squeezing step with a mangle is more effective. Furthermore, there are advantages of the suppression of defects such as pinholes even after wide width processing or continuous processing and the high uniformity in the mesh-like structure composed of nanofibers since the nanofiber dispersion liquid can be uniformly attached to the support.

A third procedure for attaching the nanofiber dispersion liquid to the support is coating the nanofiber dispersion liquid onto the support. There is an advantage that the nanofiber layer can be uniformly formed to a desired thickness if viscosity of the nanofiber dispersion liquid is increased by increasing the nanofiber concentration in the nanofiber dispersion liquid or using a thickener together and then the liquid is coated with a knife coater etc. As a specific coating procedure, the coating may be performed with the use of any publicly known means such as a dye coater, a roll coater, a rod coater, a blade coater, or an air knife coater, and then a drying procedure or a laminating procedure may be used.

Alternatively, a procedure in which the nanofiber dispersion liquid is simply drizzled over the support may be employed. Since the nanofibers used in the present invention hardly include thick fibers each having a single fiber diameter exceeding 500 nm, they are likely to be uniformly dispersed into the dispersion medium and form into a state resembling a solution into which the nanofibers are dissolved, and immersing the support into nanofiber dispersion liquid or coating the liquid to the support enables the nanofibers to be uniformly attached to the support.

As described above, attaching the nanofiber dispersion liquid to the support followed by removing the dispersion medium enables the nanofiber structure in which nanofibers are attached to the support in a mesh-like form to be obtained. The reason can be considered that, even if nanofibers are dispersed to the single fibers in the dispersion liquid, they are condensed in drying process of the dispersion medium and partially entangled to thereby form into the mesh-like structure. In addition, a procedure for removing the dispersion medium is not particularly limited, but may be directly dried, or in the case of the immersing procedure or the like where a large amount of dispersion medium is contained in the support, squeezing the dispersion medium first with a mangle or the like is also effective.

Furthermore, in the present invention, it is also important that nanofibers made of a thermoplastic polymer and having a number average diameter of 1 to 500 nm are dispersed into a dispersion medium to produce a nanofiber dispersion liquid, which is subjected to a papermaking onto a porous support. The papermaking herein means a procedure in which the nanofiber dispersion liquid is passed through the porous support, the nanofibers as dispersoids are attached to the porous support, and then the dispersion medium is removed by wiping or drying. The use of the procedure has significant advantages of high productivity, and very high safeness because of absence of harmful organic solvent vapor and floating nanofibers, differently from electrospinning. Also, this procedure is the most appropriate procedure for forming also inside of the porous support a three-dimensional mesh-like structure composed of the nanofibers since the nanofibers intrude into the inside of the porous support.

Meanwhile, if the fiber length of each of nanofibers is shorten to 5 mm or less, the nanofibers intrude into the deep inside of the porous support in the process of the immersing procedure or the papermaking method, to be thereby likely to form into the mesh-like structure there, and therefore it is preferable. From this perspective, the fiber length of nanofibers is more preferably 2 mm or less. Also, a lower limit of the fiber length of nanofibers is not particularly limited as long as it falls within a range applicable by the papermaking; however, it is preferably 0.1 mm or more in terms of formation efficiency of the mesh-like structure.

Also, a concentration of nanofibers contained in the nanofiber dispersion liquid is preferably in the range of 0.0001 to 1 wt. %, and more preferably in the range of 0.001 to 0.1 wt. %. Note that the nanofiber concentration refers to the ratio of a weight of a nanofiber component to that of the whole nanofiber dispersion liquid. Setting the nanofiber concentration to be 1 wt. % or less, or preferably 0.1 wt. % or less enables the suppression of mutual aggregation of the nanofibers and the uniform attachment of the nanofibers to the support to be facilitated. Also, there are advantages that an attaching amount of the nanofibers to the support is easily adjusted, and capabilities, such as liquid permeability, air permeability, and a capturing capability, of the nanofiber structure produced by using the present method are easily controlled because of the low concentration. On the other hand, setting the nanofiber concentration to be 0.0001 wt. % or more, or preferably 0.001 wt. % or more enables the nanofibers to be mutually entangled and the formation of the mesh-like structure to be facilitated. Furthermore, there is also an advantage of improving production efficiency since it is not necessary to store and handle a large amount of nanofiber dispersion liquid, and only a short time period is necessary to attach the nanofiber dispersion liquid to the support.

In addition, the nanofiber mesh-like structure can be controlled by various factors. The point that should be noted is the dispersion state of nanofibers in the nanofiber dispersion liquid. This can be controlled by nanofiber concentration, affinity between a polymer comprising nanofibers and a dispersion medium, an addition of dispersant, or the like. As a type of the dispersant, for example, in the case of using in an aqueous dispersion medium, it is preferable to select the dispersant from anionic series such as polycarboxylate, cationic series such as a quarternary ammonium salt, or nonionic series such as polyoxyethylene ether or polyoxyethylene ester. In order to select an appropriate dispersant, for example, in the case of dispersion by using charge repulsion among nanofibers, a type of the dispersant may be selected based on its surface potential (zeta potential). At pH=7, in the case of nanofibers with the zeta potential ranging from −5 to +5 mV, a nonionic dispersant is preferably added; in the case of those with the zeta potential ranging not less than −100 mV and less than −5 mV, an anionic dispersant is preferably added; and in the case of those with the zeta potential in the range exceeding +5 mV and not more than 100 mV, a cationic dispersant is preferably added. For example, in the case of N6 (nylon 6) nanofibers, the zeta potential measured by using a laser Doppler electrophoresis method (around pH=7) is −14 mV, i.e., a surface is negatively charged, and therefore, if the anionic dispersant is used as the dispersant in order to increase an absolute value of the potential, the zeta potential changes to −50 mV, whereby the uniformity of dispersion can be improved. On the other hand, in the case of dispersion by using steric repulsion, if a molecular weight becomes too large, an effect as a flocculant rather than a dispersant becomes significant, and therefore, controlling the molecular weight of the dispersant is preferable. In such a case, the molecular weight of the dispersant is preferably in the range of 1000 to 50000, and more preferably in the range of 5000 to 15000. However, even in the case of dispersants having same chemical compositions, their molecular weight, a type of a polymer comprising the nanofibers, a concentration of the fibers, or another compounding agent has an influence, and therefore it is preferable to select an appropriate dispersant according to a type of the nanofibers, an application, or a purpose, and adjust the dispersion liquid. A concentration of the dispersant is preferably in the range of 0.00001 to 20 wt. % of the whole dispersion liquid, more preferably in the range of 0.0001 to 5 wt. %, and most preferably in the range of 0.01 to 1 wt. %, which enables a sufficient dispersion effect to be obtained. Also, the drying process is the condensing process of the nanofiber dispersion liquid, and therefore may have an influence on the mesh-like structure. That is, if a nanofiber concentration becomes too high during the drying process, the nanofibers are likely to be secondarily aggregated, and along with the secondary aggregation, a pore diameter in the mesh-like structure is likely to increase. Also, if a drying rate is high, the dispersion medium evaporates before the nanofibers are aggregated, whereby the secondary aggregation of the nanofibers is suppressed and the pore diameter in the mesh-like structure is likely to decrease.

Also, the surface free energy of the nanofiber dispersion liquid or wettability of it with the support may have an influence on the mesh-like structure and the influence is likely to occur particularly in the case where the nanofiber dispersion liquid is attached in a film form. The reason is that in the case of high surface free energy or low wettability with the support, the stability of a nanofiber dispersion liquid film is reduced, so that some parts of the nanofiber dispersion liquid film are broken with the progress of evaporation of the dispersion medium, and the parts become pores. In this case, the diameters of the pores tend to increase. From such a perspective, an additive for controlling the stability of the nanofiber dispersion liquid during the drying process may be contained.

Also, longer fibers are likely to be entangled and form into a stable mesh-like structure, whereas they are likely to cause the nanofibers to be concentrated due to aggregation and therefore the pore diameter tends to increase. Furthermore, if a molecular structure of a polymer has a functional group or a large number of benzene rings like a liquid crystal polymer, the concentration of the nanofibers due to aggregation is likely to occur and therefore the pore diameter tends to increase.

In the present invention, the support is not particularly limited, but a nonwoven fabric, paper, a woven fabric, a knitted fabric, foam, a film, a sheet, a three-dimensional molding, or a complex composed of them may be used. Also, using a porous support enables a nanofiber mesh-like structure to be formed onto the pores or in the pore spaces of the support, and therefore is preferable. A type of the support may be selected in consideration of capabilities such as the air permeability, strength, and form stability of a completed nanofiber structure. For example, in the case of application to a filter, a support in which pore diameters are large and pores are in communication with one another in a usage environment is preferable in order to increase air and liquid permeabilities. Also, in the case where the nanofiber structure with a nanofiber layer provided on a surface of a support is used for an application such as wiping, polishing, or grinding, the support having higher strength and form stability is preferable. Furthermore, in the case where the nanofiber layer is provided on the surface of a support, the support having higher surface smoothness leads to the improvement in uniformity of a nanofiber layer thickness or of a mesh-like structure, and therefore is preferable. Still furthermore, in order to improve affinity between the nanofibers and the support, and uniformity of the mesh-like structure, as fibers to be used for the support, very fine yarns each having a single fiber diameter more than 1 μm and not more than 10 μm are preferably used, and more preferably, ultrafine yarns each having a single fiber diameter more than 1 μm and not more than 5 μm are used. Still furthermore, a material of the support is not particularly limited, but preferably selected such that the nanofiber dispersion liquid does not deteriorate form stability of the support. In addition, in the case of using the papermaking method, the nanofiber dispersion liquid should be passed through the support, and therefore it is important that the support is porous.

In the present invention, the use of the nanofiber made of a thermoplastic polymer is important, and this enables pulverization to be significantly suppressed even if beating is performed, differently from a conventional synthetic fiber.

The method for producing polymer alloy fibers to be used for a nanofiber abrasive cloth or a nanofiber structure according to the present invention is not particularly limited, and the following method may be employed, for example.

That is, two or more types of polymers respectively having different solubilities in a solvent are melted into a molten polymer alloy, which is then subjected to spinning followed by being cooled, solidified and fiberized. Then, drawing heat treatment is performed as appropriate to obtain polymer alloy fibers. Subsequently, the polymer alloy fibers are made into a fabric by using an ordinary method, followed by removing the readily soluble polymer with a solvent, or the readily soluble polymer is removed from the polymer alloy fibers with a solvent, followed by making the fibers into the fabric whereby a nanofiber sheet-like material can be obtained.

Also, removing the readily soluble polymer from the polymer alloy fibers with solvent results in a nanofiber bundle used in the present invention.

Note that, in the polymer alloy fiber that is a precursor to the nanofiber, the readily soluble polymer forms into a sea part (matrix) and the slightly soluble polymer forms into island parts (domains), and controlling the size of each of the islands is important. The island size is decided in such a way that a cross-section of the polymer alloy fiber is observed through a transmission electron microscope (TEM) and the size is evaluated as a circle-equivalent diameter from the observation. Since the island size in the precursor allows an approximate diameter of the nanofiber to be decided, the distribution of the island sizes are designed based on the distribution of the nanofiber diameters. Accordingly, kneading of polymers to be alloyed is very important, and sufficient kneading with the use of a kneading extruder or a static kneader is preferable. In addition, simple chip blending (e.g. Japanese Patent Unexamined Publication Nos. Hei06-272114 and Hei10-53967) results in unsatisfactory kneading, and therefore is difficult to disperse the islands in a state as fine as a few tens nm size.

When kneading, although depending on polymers to be combined, in the case of using the kneading extruder, the use of a twin-screw extruding kneader is preferable, whereas in the case of using the static kneader, the number of divisions is preferably one million or more. Also, it is preferable that respective polymers are independently weighed, and independently fed to a kneading machine in order to prevent blending irregularities or the change in blend ratio over time. At this time, the polymers may be independently fed in a pellet form, or in a molten state. Also, two or more types of polymers may be fed to a first section of the extruding kneader, or a side feed procedure in which one component is fed to a middle section of the processing system of the extruding kneader may be employed.

In the case of using the twin-screw extruding kneader as a kneading machine, it is preferable that both of high-level kneading and suppression of a polymer residence time period are established. A screw is composed of a feeding section and a kneading section, and a length of the kneading section is preferably set to be 20% or more of an effective length of the screw, which results in high-level kneading. Also, setting the length of the kneading section to be 40% or less of the effective length of the screw enables excessive shear stress to be prevented and the residence time period to be shortened, whereby thermal deterioration of polymers and gelation of a polyamide component or the like can be suppressed. Furthermore, locating the kneading section as close to a discharge side of the twin-screw extruder as possible enables a residence time period after kneading to be shortened and an island polymer reaggregation to be suppressed. In addition, in the case of enhancing the kneading, a screw having a back flow function with which polymers are moved in a reverse direction in the extruding kneader may be provided.

Also, in order to disperse islands in a state as ultrafine as a few tens nm size, a combination of polymers is also important.

In order to bring a shape of an island domain (cross-section of a nanofiber) into a circle shape as close as possible, the island polymer and the sea polymer are preferably incompatible. However, a simple combination of the incompatible polymers results in the difficulty in sufficiently ultrafine dispersion of the island polymers. For this reason, it is preferable to optimize compatibilities of the polymers to be combined, and one of indicators to do the optimization is a solubility parameter (SP value). Note that the SP value is a parameter reflecting cohesive force of a material, which is defined as (evaporation energy/molar volume)$^{112}$, and if polymers having close SP values are used, a polymer alloy having good compatibility may be obtained. SP values of various polymers have been known, and are described in "Plastic Data Book" (co-edited by Asahi Kasei AMIDAS Co., Ltd./Plastic editorial department, page 189 and other pages). If a difference in SP value between two polymers is in the range of 1 to 9 $(MJ/m^3)^{1/2}$, both rounding of the island domain due to becoming incompatible and an ultrafine dispersion are easily established, which is preferable. For example, the difference in SP value between N6 and PET is approximately 6 $(MJ/m^3)^{1/2}$, which is a favorable example; however, in the case of N6 and PE, the difference in SP value therebetween is approximately 11 $(MJ/m^3)^{1/2}$, which is one of unfavorable examples.

Also, if a difference in melting point between polymers is 20° C. or less, particularly at the time of kneading with the use of an extruding kneader, a difference in molten state therebetween in the extruding kneader is unlikely to arise, resulting in high efficient kneading, which is preferable.

Also, in the case where a polymer that is likely to be thermally decomposed or thermally deteriorated is used as one component, kneading and spinning temperatures should be suppressed low, which has also an advantage. Note that an amorphous polymer has no melting point, and therefore glass transition temperature, Vicat softening temperature, or thermal deformation temperature is substituted for the melting point.

Furthermore, melt viscosity is also important, and setting a melt viscosity of a polymer comprising an island part to be lower than that of a polymer comprising a sea part facilitates the deformation of the island polymer due to shear force, resulting in facilitating an ultrafine dispersion of the island polymer, which is preferable in terms of processing polymers into nanofibers. However, setting the viscosity of the island polymer to be too low causes the change of the polymer into a sea state to be facilitated, whereby a blend ratio to the whole fibers cannot be increased, and therefore it is preferable to set the viscosity of the island polymer to be 1/10 or more of that of the sea polymer.

Also, the melt viscosity of the sea polymer may have a large influence on spinnability, and the use of a polymer with a viscosity of 100 Pa·s or less as the sea polymer facilitates a dispersion of the island polymer and therefore is preferable. Furthermore, this enables the spinnability to be significantly improved. In this case, the melt viscosity takes a value at a spinneret temperature during spinning and a shear rate of 1216 $sect^1$.

At the time of spinning an ultrafinely dispersed polymer alloy used in the present invention, a cooling condition for yarn is important as well as a design of the spinneret. As described above, the polymer alloy is a very unstable molten fluid, and therefore it is preferably cooled down and solidified immediately after it has been discharged from the spinneret. To do this, a distance from the spinneret to a point where the cooling down starts is preferably in the range of 1 to 15 cm. Note that the point where the cooling down starts means a position where the active cooling down of the yarn starts, and in an actual melt spinning machine, a top end of a chimney is substituted for the point.

The nanofiber abrasive cloth of the present invention enables a 0.5 nm or less surface roughness of a hard disk to be attained.

Also, the nanofiber abrasive cloth of the present invention enables 300 scratches per 10 disks in a hard disk to be attained.

The abrasive cloth of the present invention is not limited to only an application of hard disk polishing, but may be preferably used for grinding or polishing of precision equipment for the use of IT parts or the like, or used as a wiping cloth for the equipment by utilizing its surface smoothness, flexibility, and wiping capability.

Furthermore, the nanofiber structure obtained by using the method for producing a nanofiber structure according to the present invention is favorable not only to the above-described polishing use, but also to various uses from materials for a daily life such as a mask, to industrial use such as an air filter and a liquid filter, to a medical use such as a blood filter.

The applicable fields include, for example: an air filter for a clean room, an automobile, or an exhaust system in a factory, an incineration plant, a house, or the like; a liquid filter for chemical processing, food, or pharmaceutical and medical services; a HEPA filter; and a ULPA filter.

It is particularly preferable to the HEPA filter, ULPA filter, or blood filter using the mesh-like structure.

It should be appreciated that it is also preferable to general fiber applications: apparel applications such as moisture permeable and waterproof materials; interior applications such as curtains, carpets, mats, wallpaper, and furniture; automotive interior applications such as mats, car seats, and ceiling materials; cosmetic applications such as cosmetic tools, cleansing sheets and skin care sheets; industrial material applications such as battery separators and building materials; daily life material applications such as wiping cloths, cleaning sheets, and items for health care; IT material applications such as sensor materials; medical applications such as extracorporeal circulation columns, adhesive plasters, plasters, and cell culture substrate; and so on.

EXAMPLES

The present invention is described below in detail with reference to examples. In addition, as measuring methods in the examples, the following methods were used.

A. Melt Viscosity of Polymer

Melt viscosities of polymers were measured with the use of Capillograph 1B manufactured by Toyo Seiki Seisaku-sho, Ltd. In addition, a retention time period of a polymer from sample setting to a start of measurement was set to 10 minutes.

B. Melting Point

A peak-top temperature value representing the melting of a polymer, which was measured at the time of 2nd run with the use of Perkin Elmer DSC-7, was defined as a melting point. During the measurement, a heating rate was set to 16° C./minute and a sample amount was adjusted to 10 mg.

C. Shear Stress at Discharge Hole of Spinneret

A shear stress between a spinneret hole wall and a polymer is calculated from the Hagen-Poiseuille formula (shear stress $(dyne/cm^2)=R\times P/2L$), where R: a radius of the spinneret discharge hole (cm), P: pressure loss at the spinneret discharge hole $(dyne/cm^2)$, and L: a length of the spinneret discharge hole (cm).

Also, $P=(8L\eta Q/\pi R^4)$, where $\eta$: a viscosity of polymer (poise), Q: a discharge amount $(cm^3/sec)$, and $\pi$: a circle ratio.

Furthermore, 1 $dyne/cm^2$ in the CGS unit system is equivalent to 0.1 Pa in the SI unit system.

D. Uster Irregularity of Polymer Alloy Fiber (U %)

Measurements were performed with the use of USTER TESTER 4 manufactured by Zellweger Uster AG at a yarn feeding rate of 200 m/minute in a normal mode.

E. Cross Sectional Observation of Sheet-Like Material Through TEM

In the case of an abrasive cloth, a sheet-like material was embedded into an epoxy resin, from which an ultrathin segment was cut out in a cross-sectional direction, and with the use of the ultrathin segment, a cross-section of the sheet-like material was observed through a transmission electron microscope (TEM). Also, metal dyeing was provided as appropriate.

Furthermore, in the case of a structure, a nanofiber bundle prior to dispersion was used, from which an ultrathin segment was cut out in a cross-sectional direction, and with the use of the ultrathin segment, a cross-section of the nanofiber was observed through TEM. Also, metal dyeing was provided as appropriate.

TEM apparatus: Type H-7100FA manufactured by Hitachi Ltd.

F. Number Average Single Fiber Fineness and Diameter of Nanofibers

A cross-section of a sheet-like material containing nanofibers is observed through a transmission electron microscope (TEM) or a scanning electron microscope (SEM), and diameters of 50 or more single fibers randomly sampled in a same cross section are measured. The number average values are determined by performing at three or more points a measuring procedure in which the single fiber diameters and single fiber finenesses are obtained from a cross-sectional photograph of the sheet-like material obtained through the TEM or SEM with the use of image processing software (WINROOF) to thereby measure at least total of 150 or more single fiber diameters.

Note that in the case related to the abrasive cloth of the present invention, a parent population of the measurements is decided in a manner shown in (1) below, whereas in the case related to the method for producing a nanofiber structure, it is decided in a manner shown in (2) below.

(1) In the Case Related to the Abrasive Cloth of the Present Invention:

Fibers each having a diameter exceeding 250 nm (in the case of nylon 6 (a specific gravity of 1.14 g/cm$^3$), $6\times10^{-4}$ dtex) are removed, and only fibers each having a single fiber diameter ranging from 1 nm to 250 nm are randomly selected and then measured.

(2) In the Case Related to the Method for Producing a Nanofiber Structure:

Fibers each having a diameter exceeding 1000 nm (in the case of nylon 6 (a specific gravity of 1.14 g/cm$^3$), a single fiber fineness of $9\times10^{-3}$ dtex) are removed, and only fibers each having a single fiber diameter ranging from 1 nm to 1000 nm are randomly selected and then measured.

In addition, in the case where each of nanofibers comprising the sheet-like material has a modified cross-section, a cross-sectional area of a single fiber is first measured, and the area is defined as an area of a circle, assuming that the cross-section is the circle. Calculating a diameter from the area allows the single fiber diameter to be obtained.

An average value of single fiber finenesses is obtained as follows. First, single fiber diameters are measured to one decimal place in nm unit and the decimal place in each of the diameters is rounded off. The single fiber finenesses are calculated from the rounded single fiber diameters, and the simple average of them is obtained. In the present invention, this is referred to as "the number average single fiber fineness".

The number average single fiber diameter is also found in the same statistical manner.

G. Number Average Diameter of Nanofibers

The number average diameter of nanofibers is found as follows.

That is, circle-equivalent single fiber diameters of nanofibers were calculated from the cross-sectional photograph obtained by the above TEM observation with the use of the image processing software (WINROOF), and then a simple average value of them was found. At the time, diameters of 150 or more nanofibers that had been randomly sampled in a same cross-section were analyzed and used for the calculation.

H. Number Average Variation in Single Fiber Fineness Among Nanofibers

The variation in single fiber fineness among nanofibers comprising an abrasive cloth is evaluated in the following manner as described above.

That is, a single fiber fineness of each of the nanofibers in the abrasive cloth is obtained to one significant digit, and let the obtained value be $dt_i$, and the sum of them be a total fineness ($dt_1+dt_2+\ldots+dt_n$). Also, a single fiber fineness of each of the nanofibers is obtained to one significant digit as described above, then a frequency (number) of nanofibers each having a same single fiber fineness is counted, and a product of them divided by the total fineness is defined as a fineness ratio of the single fiber fineness.

This corresponds to a weight fraction (volume fraction) of each single fiber fineness component to all the nanofibers contained in the abrasive cloth, and a single fiber fineness component having a larger fraction value makes a larger contribution to characteristics of the nanofiber abrasive cloth.

In addition, in the present invention, a variation in single fiber fineness among such nanofibers is obtained in a similar manner to the above-described procedure for obtaining the average value of single fiber finenesses, i.e., it is obtained by performing at three or more points the procedure in which a cross-section of the sheet-like material at least partially containing nanofibers is observed through a transmission electron microscope (TEM) or a scanning electron microscope (SEM), and single fiber diameters of 50 or more nanofibers that are randomly sampled are measured, to thereby measure at least total of 150 or more single fiber diameters. Furthermore, it is obtained using the same number of measurement and data as in the above-described case of obtaining the average value of single fiber finenesses.

I. Fiber Ratio

Let a single fiber diameter of each of the nanofibers be di by using the above analysis on a diameter of a nanofiber cross-section. Then, the sum of a square of it ($d_1^2+d_2^2+\ldots+d_n^2$)= $\Sigma d_i^2$, (i=1~n) is calculated. Also, let a fiber diameter of each of the nanofibers, which falls within the diameter range more than 500 nm and not more than 1 μm, be Di. Then, the sum of a square of it ($D_1^2+D_2^2+\ldots+D_m^2$)=$\Sigma D_i^2$, (i=1~m) is calculated. Calculating a ratio of $\Sigma D_i^2$ to $\Sigma d_i^2$ allowed an area ratio (weight ratio) of the thick fibers to all the nanofibers, i.e., the fiber ratio to be defined.

J. Variation of Nanofiber Diameters

The variation of nanofiber diameters is evaluated as follows. That is, it is evaluated with the use of a fineness ratio of single fibers whose diameter difference from a center value of the single fiber diameters of the nanofibers falls within 30 nm. This means that the degree of concentration of a variation on the vicinity of a center value of fineness, i.e., the higher this fineness ratio is, the smaller the variation is. This is also obtained using the same number of measurement and the same data as used in the above-described case of obtaining the number average single fiber fineness.

K. Tensile Strength and Stress at 10% Elongation of Sheet-Like Material

Based on JIS L1096 8.12.1 (1999), a sample with a width of 5 cm and a length of 20 cm was taken from a sheet-like material (abrasive cloth), and a measurement was performed with a constant extension rate tensile strength tester at a clamping interval of 10 cm and an tensile speed of 10 cm/minute while the sample was extended. Based on an obtained value, a load per a width of 1 cm was defined as a tensile strength value (unit: N/cm width).

Also, the stress at 1 cm elongation was defined as the stress at 10% elongation.

L. Texturing of Hard Disk

An abrasive cloth was first shaped into tape with a width of 40 mm, and then polishing was performed for 25 seconds using as a polishing target a substrate which a commercially available aluminum plate was plated with Ni—P and then polished, under the condition that a processing tension of 20 N was applied to the abrasive cloth while the abrasive cloth was moved at a rate of 5 cm/minute and slurry comprising free abrasive grains composed of diamond crystals with an average grain diameter of 0.2 μm was dropped onto a surface of the abrasive cloth.

Also, an average surface roughness and the number of scratches of the polishing target were found as follows.

<Substrate Surface Roughness>

In conformity to JISB0601, an average roughness was measured at 10 arbitrary points on a surface of a disk substrate sample, and then by averaging the measured values at the 10 points, the substrate surface roughness was calculated.

<Scratch Numbers>

Using both sides of each of 5 substrates after texturing, i.e., 10 surfaces, as measuring targets, the number of scratches were measured with Candela 5100 optical surface analyzer. Then, an evaluation was performed on the unit of the average value of the measured values at the 10 surfaces, and 300 scratches or less was considered acceptable.

L. Polymeric Elastomer Content

A content of a polymeric elastomer was obtained in such a way that the polymeric elastomer was eluted and removed from an abrasive cloth with a sample area of 1 $m^2$ by using a solvent or the like, and then weights before and after the eluting and removing processing were respectively measured.

M. SEM Observation

Platinum was vapor-deposited onto a sample, and the sample was observed through an ultrahigh-resolution field-emission scanning electron microscope.

SEM apparatus: UHR-FE-SEM manufactured by Hitachi Ltd.

O. Mechanical Properties of Fiber

A load-elongation curve was obtained at room temperature (25° C.) under the condition that an initial sample length=200 mm and a tensile speed=200 mm/minute and also under the condition indicated in JIS L1013. Then, a load value at break divided by an initial fineness, and an elongation value at break divided by the initial sample length were defined as strength and elongation respectively, and a strength-elongation curve was obtained.

P. Compressive Elasticity Ratio

A compressive elasticity ratio S is defined by the following. Compressive characteristics are first measured under the following conditions.

Measuring equipment: Autograph AGS-500B manufactured by Shimadzu Corporation,

Size of sample: 50 mmϕ,

Thickness of sample: 0.4 mm or thicker, (If a sample thickness is less than 0.4 mm, multiple samples are stacked such that the thickness of the stacked samples is 0.4 mm or thicker and closest to 0.4 mm, and then measured), and Compression speed: 0.5 mm/minute.

Then, a relationship between a distortion and a compressive load obtained by the measurements is graphed, and tangential gradients at 0.1 kg/$cm^2$ and 0.5 kg/$cm^2$ are defined as respective compressive elasticity values. A value that is the compressive elasticity value at 0.5 kg/$cm^2$ divided by that at 0.1 kg/$cm^2$ is defined as S.

Q. Abrasion Resistance

A test was performed in conformity to ASTM D-1175. Specifically, the abrasion resistance is defined by a decreasing amount (mg) of a sample abraded to 45 cycles at a load of 3628.8 g using a Schiefer abrasion tester manufactured by Nihon Denshi Kagaku Co., Ltd. with a nylon brush with a nap length of 13 mm.

A number of measurement was 3, and the average of three measured values was found.

R. Surface Roughness

Ten or more abrasive cloth samples each having a size of 7 cm×7 cm are prepared, and then left for 12 hours or longer in a desiccator at a temperature of 20° C. and a humidity of 60%. One of them is placed in the Talysurf 4 surface roughness meter manufactured by TAYLOR HOBSON Ltd. Surface roughness of a sample having a surface length of 5 mm is measured in an environment of a temperature of 20° C. and a humidity of 60% under the measurement condition that a curvature radius in a measurement and detection section was 1.25 μm, a speed at a detection section was 30 cm/minute, and a roughness sensitivity was 500 times. This measurement was performed on the 10 samples, and a simple average of measurement results of the 10 samples was obtained.

S. Surface Hardness

Surface hardness is represented by hardness measured in conformity to the provisions described in JIS K-6253A. That is, 10 or more abrasive cloth samples each having a size of 7 cm×7 cm are prepared, and then left for 12 hours or longer in a desiccator at a temperature of 20° C. and a humidity of 60%. One of them was placed in a constant pressure load hardness tester CL-150 attached with the type ASKER A sensor section manufactured by Kobunshi Keiki Co., Ltd. Hardness was measured in an environment of a temperature of 20° C. and a humidity of 60%. This measurement was performed on the 10 samples, and a simple average of measurement results of the 10 samples was obtained.

T. Thickness of Laminated Layer

A thickness of a nanofiber laminated layer is found as follows. First, in order to measure a thickness of only a support, 10 samples each having a size of 10 cm square are cut out of anywhere of the support. Then, each sample is placed on a sample stage with a micrometer gauge, and a thickness of the sample is measured by using the micrometer at 20° C. and 65%. The thickness is measured at each of 10 points for each sample, and a simple average of the 10 thicknesses is defined as a thickness Ts (μm). A thickness of a sheet-like material is measured in a similar manner to the above and defined as a thickness Tn (μm). The thickness of a nanofiber laminated layer with respect to the whole sheet-like material was found by the following expression (1).

$$\text{A thickness of laminated layer}=(Tn-Ts)/Tn\times 100 \quad (1)$$

U. Zeta Potential Measurement

KCl of 0.001M was preliminarily added into a nanofiber dispersion liquid, and a measurement was performed at pH=7 by using the ELS-800 electrophoretic light scattering photometer (manufactured by OTSUKA ELECTRONICS Co., Ltd.).

Example 1

N6 (20 wt. %) having a melt viscosity of 53 Pa·s (at 262° C. and a shear rate of 121.6 $sec^{-1}$) and a melting point of 220° C., and copolymerized PET (80 wt. %) having a melting point of 225° C. copolymerized PET from 8 mol % isophthalic acid and 4 mol % bisphenol A having a melt viscosity of 310 Pa·s (at 262° C. and a shear rate of 121.6 $sec^{-}$) were kneaded at 260° C. by using a twin-screw extruding kneader to obtain a polymer alloy chip. In addition, a melt viscosity of the copolymerized PET at 262° C. and 1216 $sec^{1}$ was 180 Pa·s. A kneading condition at the time was as follows.

Regarding polymer feeding, N6 (nylon 6) and copolymerized PET were separately weighed and then separately fed into the kneader. A screw having a diameter of 37 mm, an effective length of 1670 mm, and L/D=45.1 was used, and a temperature was 260° C.

Figure 7:
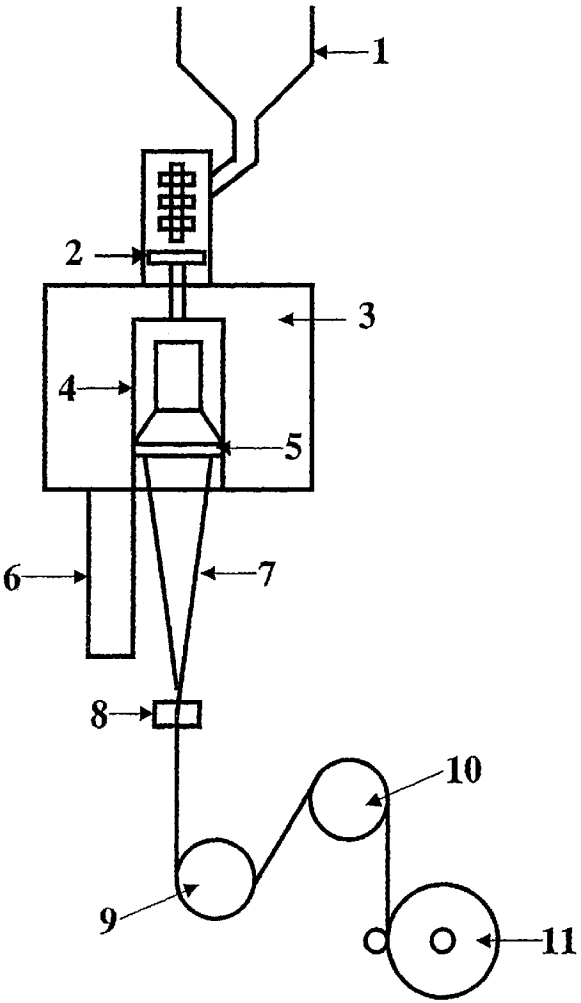
FIG. 7 is a diagram illustrating a spinning machine used in examples.

The polymer alloy chip was melted in a melting section 2 at 275° C., and then introduced into a spin block 3 having a spinning temperature of 280° C. Then, as shown in FIG. 7, the molten polymer alloy was filtered through a metallic nonwoven fabric with a maximum penetration particle size of 15 g m, and then a melt spinning was performed from a spinneret 5 having its surface temperature of 262° C. In FIG. 7, a reference numeral 1 represents a hopper, 2 represents the melting section, 3 represents the spin block, 4 represents a spinning pack, 5 represents the spinneret, 6 represents a chimney, 7 represents a yarn, 8 represents a collecting/oiling guide, 9 represents a first take-up roller, 10 represents a second take-up roller, and 11 represents a wound yarn.

Figure 8:
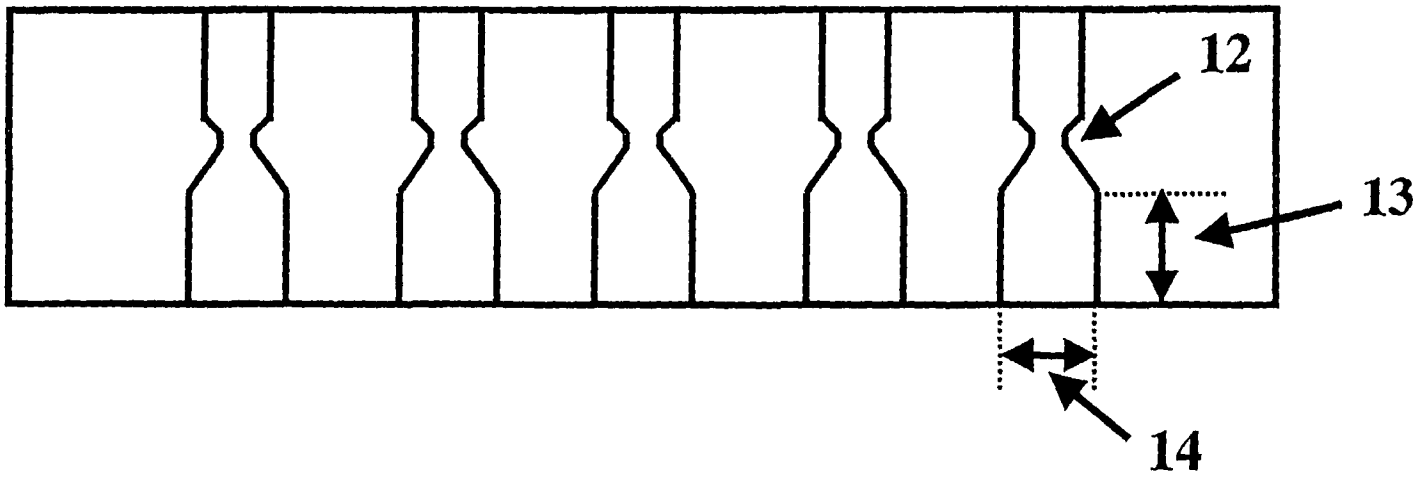
FIG. 8 is a diagram illustrating a spinneret used in the examples.

In the example, the upper part of a discharge hole of the spinneret was provided with a weighing section 12 with a diameter of 0.3 mm as shown in FIG. 8. The spinneret having a discharge hole diameter of 0.7 mm and a discharge hole length of 1.75 mm was used. Also, a discharge amount per a single hole was set to 2.9 g/minute.

A shear stress between a spinneret hole wall and the polymer was 0.13 MPa (a viscosity of the polymer alloy was 105 Pa·s at 262° C. and a shear rate of 1248 $sec^{-1}$), which was a sufficiently low value. Furthermore, a distance from a lower surface of the spinneret to a starting point of cooling (upper end of the chimney 6) was 9 cm. A discharged yarn was cooled and solidified over 1 m with a cooling air having a temperature of 20° C., oiled at the oiling guide 8 placed 1.8 m below the spinneret 5, and then wound at a rate of 900 m/minute through the unheated first and second take-up rollers 9 and 10.

Figure 9:
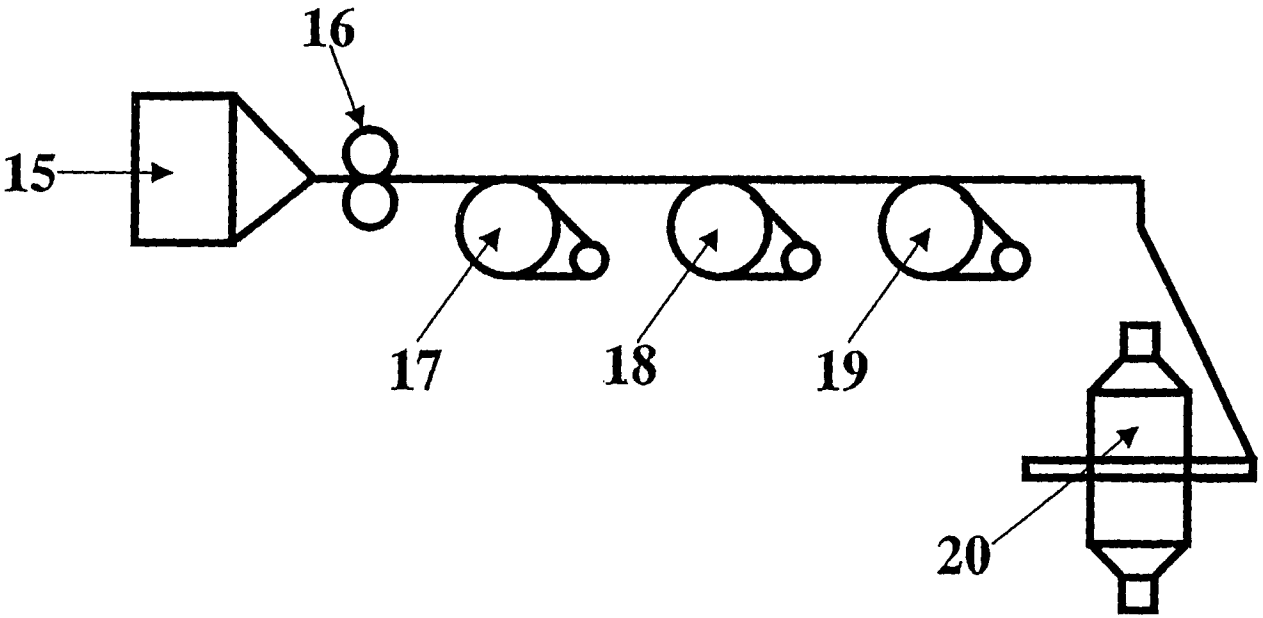
FIG. 9 is a diagram illustrating a drawing machine used in the examples.

Subsequently, as shown in FIG. 9, drawing and heat treatment was performed on the wound yarn under the condition that a temperature of a first hot roller 17 was 90° C. and a temperature of a second hot roller 18 was 130° C. During the treatment, the draw ratio between the first hot roller 17 and the second hot roller 18 was set to 3.2. In FIG. 9, a reference numeral 15 represents an undrawn yarn, 16 represents feed rollers, 19 represents a third roller (room temperature), and 20 represents a drawn yarn. An obtained polymer alloy fiber exhibited excellent characteristics of 120 dtex, 12 filaments, a strength of 4.0 cN/dtex, an elongation percentage of 35%, and U %=1.7%.

Figure 2:
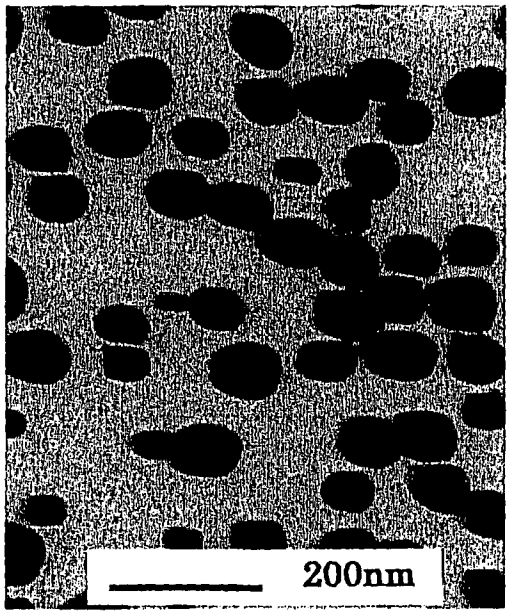
FIG. 2 is a TEM photograph showing a cross-section of a polymer alloy fiber used in Example 1.

Also, a cross-sectional TEM observation of the obtained polymer alloy fiber exhibited a sea-island structure having a sea component (light part) composed of copolymerized PET and an island component (dark part) composed of N6 as shown in FIG. 2, and also revealed that the polymer alloy fiber was a precursor of N6 nanofiber, which the N6 dispersed in an ultrafine state, and that a number average diameter of the N6 islands was 53 nm. Then, crimping and cutting were performed on the polymer alloy fiber to thereby obtain polymer alloy staple fibers (A) with a cut length of 51 mm.

The polymer alloy staple fibers (A) obtained as described were subjected to carding and lapping, and further subjected to needle punching at a punching times of 3500 needles/$cm^2$ to thereby obtain a nonwoven fabric composed of the polymer alloy staple fibers having a unit weight of 500 g/$m^2$.

The nonwoven fabric was immersed into a 5% sodium hydroxide solution at 95° C. for 1 hour to thereby hydrolyze and remove 99% or more of a polyester component in the nonwoven fabric, and then neutralized with acetic acid followed by being rinsed and dried.

As a result of an analysis on only N6 nanofibers in the nonwoven fabric through a TEM photograph, it turned out that a number average single fiber diameter of the N6 nanofibers was 56 nm ($3\times10^{-5}$ dtex), which was unprecedentedly fine.

Also, a fineness ratio of nanofibers each of which a single fiber fineness fell within the range of $1\times10^{-8}$ to $4\times10^{-4}$ dtex was 100%, and further that fell within the range of $1\times10^{-8}$ to $2\times10^{-4}$ dtex was also 100% (in each of the following examples, these facts were confirmed). In addition, a fineness ratio of nanofibers each of which a single fiber fineness fell within the range of $1\times10^{-8}$ to $1\times10^{-4}$ dtex was 99%.

Figure 3:
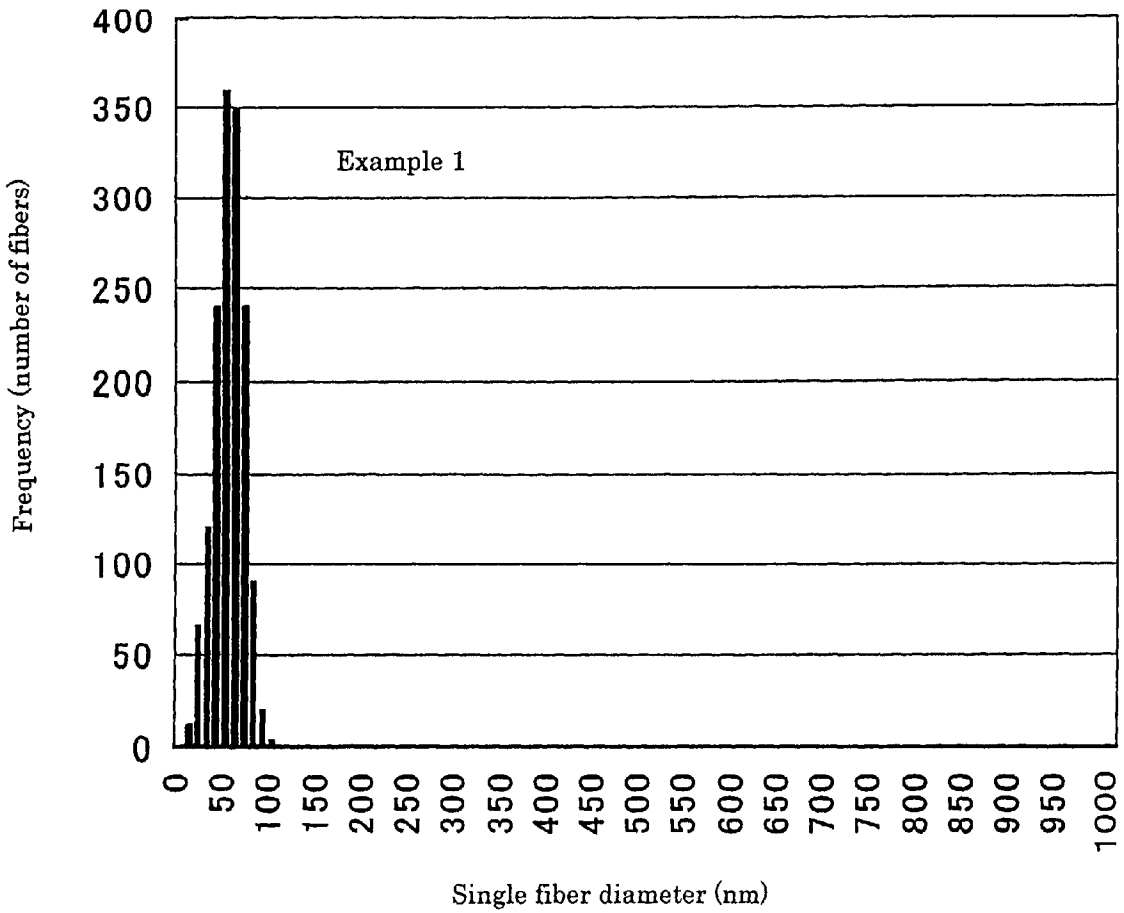
FIG. 3 is a graph illustrating a variation in single fiber fineness among nanofibers in Example 1.
Figure 4:
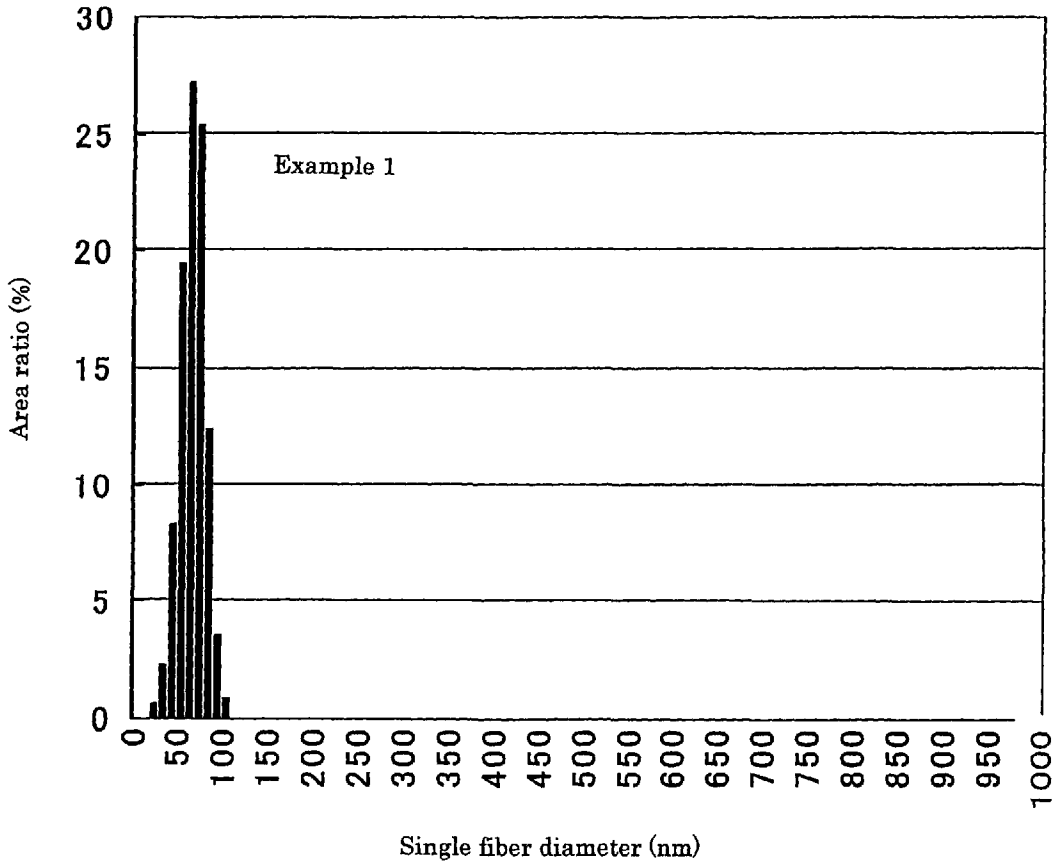
FIG. 4 is a graph illustrating a variation in single fiber fineness among nanofibers in Example 1.

On the other hand, a single fiber fineness ratio of nanofibers each of which a single fiber diameter fell within the range of 55 to 84 nm was 71%, and a variation in single fiber fineness was extremely small as shown in Table 1. Histograms for single fiber diameters and single fiber finenesses of the N6 nanofibers are shown in FIGS. 3 and 4 respectively. In the histograms, the number of nanofibers (frequency) and the fineness ratio were counted by 10 nm in single fiber diameter. The count by 10 nm in single fiber diameter means that for example, the number of nanofibers each having a single fiber diameter of 55 to 64 nm was counted as the number of those each having a single fiber diameter of 60 nm, and also the number of nanofibers each having a single fiber diameter of 75 to 84 nm was counted as the number of those each having a single fiber diameter of 80 nm.

Subsequently, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF solution of polyester/polyether-based polyurethane so as to contain 30 wt. % in terms of solid content with respect to the fibers in the nonwoven fabric, and then subjected to wet coagulation to thereby obtain the nonwoven fabric composed of the N6 nanofibers.

A surface of the obtained nonwoven fabric was buffed with three types of sandpaper, i.e., JIS #240, #350, and #500, nipped with two tiered fluorine-treated heating rollers having a space therebetween of 1.0 mm and a surface temperature of 150° C., pressed at a pressure of 0.7 kg/$cm^2$, and then rapidly cooled down with a cooling roller having a surface temperature of 15° C., to thereby obtain an abrasive cloth having a smooth surface. This abrasive cloth had a compressive elasticity ratio S of 3.0, an abrasion resistance coefficient of 30 mg, a surface roughness of 20 μm, and a surface hardness of 38. Furthermore, the stress at 10% elongation of the abrasive cloth was 12 N/cm width, elongation of the abrasive cloth during texturing was small, and the texturing results of a hard disk in an average surface roughness of the substrate were as small as 0.24 nm, the number of scratches of 96 scratches, which meant that the number of defects was extremely small, and an exhibition of excellence in electromagnetic conversion characteristics. Furthermore, polishing chips and fragments of abrasive grains that remained on the textured surface were hardly present.

Example 2

The polymer alloy staple fibers (A) obtained in Example 1 were subjected to carding and lapping, and further subjected to needle punching at a needle density of 500 needles/$cm^2$ to thereby obtain a nonwoven fabric composed of the polymer alloy staple fibers having a unit weight of 450 g/m$^2$.

Also, PP staple fibers (B) having a single fiber fineness of 1.9 dtex were subjected to carding and lapping, and further subjected to needle punching at a punching times 500 needles/cm$^2$ to thereby obtain a PP nonwoven fabric. One sheet of the nonwoven fabric composed of the polymer alloy staple fibers obtained as above and another sheet of the PP nonwoven fabric were stacked, and the stacked sheets were further subjected to needle punching at a punching times of 3000 needles/m$^2$ to thereby obtain a bonding type nonwoven fabric composed of the polymer alloy staple fibers (A) and the PP staple fibers (B).

Subsequently, similarly to the case of Example 1, this nonwoven fabric was immersed into a 5% sodium hydroxide solution at 95° C. for 1 hour to thereby hydrolyze and remove 99% or more of a polyester component in the nonwoven fabric, and then neutralized with acetic acid followed by being rinsed and dried.

Subsequently, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF solution of polyester/polyether-based polyurethane so as to contain 30 wt. % in terms of solid content with respect to the fibers in the nonwoven fabric, and then subjected to wet coagulation to thereby obtain a mixed nonwoven fabric with a unit weight of 390 g/m$^2$ composed of the N6 nanofibers and PP fibers.

A surface of the obtained nonwoven fabric was buffed, pressed, and then rapidly cooled down in a similar manner to the case of Example 1, to thereby obtain an abrasive cloth having a smooth surface.

The stress at 10% elongation, compressive elasticity ratio S, abrasion resistance coefficient, surface roughness, and surface hardness of the obtained abrasive cloth, and the texturing results of a hard disk are as listed in Table 1.

Example 3

Under the condition that 60 wt. % alkali-soluble copolyester resin and 40 wt. % N6 resin were used for a sea component and an island component respectively, and the island component was configured to be composed of 100 islands by melt spinning, a polymer alloy conjugate fiber (hereinafter referred to as a conjugate fiber) of 5.3 dtex was prepared, and then drawn 2.5 times to thereby obtain a conjugate fiber with 2.1 dtex. This conjugate fiber had a strength of 2.6 cN/dtex and an elongation percentage of 35%. Also, an analysis on an average single yarn fineness in a part to be an ultrafine fiber in the island component through a TEM photograph resulted in the equivalent of 0.02 dtex. Crimping and cutting were performed on this fiber to thereby obtain conjugate staple fibers (C) with a cut length of 51 mm.

This conjugate staple fibers (C) and the polymer alloy staple fibers (A) obtained in Example 1 were subjected to mixing at a weight ratio A/C=50/50, carding and lapping, and further needle punching at a punching times of 3500 needles/cm$^2$ to thereby obtain a mixed nonwoven fabric with a unit weight of 500 g/m$^2$ composed of the polymer alloy staple fibers (A) and the conjugate staple fibers (C).

Subsequently, similarly to the case of Example 1, this nonwoven fabric was immersed into a 5% sodium hydroxide solution at 95° C. for 1 hour to thereby hydrolyze and remove 99% or more of a polyester component in the nonwoven fabric, and then neutralized with acetic acid followed by being rinsed and dried.

Subsequently, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF solution of polyester/polyether-based polyurethane so as to contain 30 wt. % in terms of solid content with respect to the fibers in the nonwoven fabric, and then subjected to wet coagulation to thereby obtain a mixed nonwoven fabric composed of the N6 nanofibers and ultrafine N6 fibers.

A surface of the obtained nonwoven fabric was buffed, pressed, and then rapidly cooled down in a similar manner to the case of Example 1, to thereby obtain an abrasive cloth having a smooth surface.

The stress at 10% elongation, compressive elasticity ratio S, abrasion resistance coefficient, surface roughness, and surface hardness of the obtained abrasive cloth and the texturing results of a hard disk are as listed in Table 1.

Example 4

The polymer alloy fiber obtained in Example 1 was immersed into a 5% sodium hydroxide solution at 95° C. for 1 hour to thereby hydrolyze and remove 99% or more of a polyester component in the polymer alloy fiber, then neutralized with acetic acid followed by being rinsed and dried, and cut into a piece with a length of 2 mm to thereby obtain a cut fiber composed of N6 nanofiber. Twenty three L of water and 30 g of the obtained cut fiber were arranged in a TAPPI standard Niagara test beater (manufactured by Toyo Seiki Seisaku-Sho, Ltd.), then preliminary beating was performed for 5 minutes, subsequently excess water was extracted, and a fiber was retrieved. A weight of the fiber was 250 g and its moisture content was 88%. The 250 g of the fiber in the moisture state was directly arranged into an automatic PFI mill (manufactured by Kumagai Riki Kogyo Co., Ltd.), and then subjected to beating for 6 minutes at a rotation number of 1500 rounds and a clearance of 0.2 mm. 4.2 g of the beaten fiber, 0.5 g of an anionic dispersant SHALLOL AN-103P (manufactured by Dai-ichi Kogyo Seiyaku Co., Ltd. molecular weight 10000) as a dispersant, and 500 g of water were arranged in a fiber mixer MX-X103 (manufactured by Matsushita Electric Industrial Co., Ltd.), and then stirred for 5 minutes to thereby obtain an N6 nanofiber water dispersion. A zeta potential of the nanofiber in the water dispersion was −50 mV. 500 g of the N6 nanofiber water dispersion and 20 L of water were arranged in a semi-automatic square sheet machine (manufactured by Kumagai Riki Kogyo Co., Ltd.), then subjected to papermaking onto a polyester plain weave fabric with a fiber diameter of 45 μm and 200 yarns/inch (Industrial mesh cloth type T-NO.200S manufactured by NBC Inc.) followed by direct drying at 110° C. for 2 minutes by using a high-temperature rotary drier (manufactured by Kumagai Riki Kogyo Co., Ltd.), to thereby obtain an abrasive cloth in which N6 nanofibers with a unit weight of 8 g/m$^2$ was laminated by using the polyester plain weave fabric as a support. Since a thickness of the polyester plain weave fabric was 70 μm and that of the whole laminated abrasive cloth was 100 μm, a thickness of the nanofiber laminated layer was 30% with respect to the whole sheet-like material.

The stress at 10% elongation, and surface roughness of the obtained abrasive cloth, and the texturing results of a hard disk are as listed in Table 1.

Example 5

Polyvinyl alcohol was provided to the abrasive cloth in Example 4 such that a solid content of the polyvinyl alcohol was 20 wt. % with respect to the fibers in the abrasive cloth. Furthermore, the abrasive cloth was impregnated in DMF solution of polyester/polyether-based polyurethane so as to contain 30 wt. % in terms of solid content with respect to the fibers in the abrasive cloth, and then subjected to wet coagulation to thereby obtain a laminated abrasive cloth composed of the N6 nanofibers and the polyester plain weave fabric.

The stress at 10% elongation, and surface roughness of the obtained abrasive cloth, and the texturing results of a hard disk are as listed in Table 1.

Example 6

An abrasive cloth in which N6 nanofibers were laminated on a polyester plain weave fabric was obtained in a similar manner to the case of Example 4, except that a unit weight of the N6 nanofibers laminated in Example 4 was set to 60 g/m$^2$ in this example.

The stress at 10% elongation, and surface roughness of the obtained abrasive cloth, and the texturing results of a hard disk are as listed in Table 1.

Example 7

Polyvinyl alcohol was provided to the abrasive cloth in Example 6 such that a solid content of the polyvinyl alcohol was 20 wt. % with respect to the fibers in the abrasive cloth. Furthermore, the non-woven fabric was impregnated in DMF solution of polyester/polyether-based polyurethane so as to contain 30 wt. % in terms of solid content of polyurethane with respect to the fibers in the abrasive cloth, and then subjected to wet coagulation to thereby obtain a laminated abrasive cloth composed of the N6 nanofibers and the polyester plain weave fabric.

A surface of the obtained abrasive cloth was buffed, pressed, and then rapidly cooled down in a similar manner to the case of Example 1, to thereby obtain an abrasive cloth having a smooth surface.

The stress at 10% elongation and surface roughness of the obtained abrasive cloth, and the texturing results of a hard disk are as listed in Table 1.

Example 8

Melt kneading was performed with the use of N6 used in Example 1 and poly-L-lactic acid (optical purity of 99.5% or more) having a weight-average molecular weight of 120 thousand, a melt viscosity of 30 Pa·s (240° C. and a shear rate of 2432 sec$^{-1}$), and a melting point of 170° C. in a similar manner to the case of Example 1 under the condition of an N6 content of 20 wt. % and a kneading temperature of 220° C., to thereby obtain a polymer alloy chip. Note that the weight-average molecular weight of poly-L-lactic acid was obtained in the following manner. That is, a chloroform solution of the sample was mixed with THF (tetrahydrofuran) to prepare a measuring solution. This was measured at 25° C. by using the gel permeation chromatography (GPC) Waters 2690 manufactured by Waters Corporation to thereby obtain the weight-average molecular weight in polystyrene equivalent.

In addition, a melt viscosity of N6 used in Example 1 at a shear rate of 2432 sec$^{-1}$ was 57 Pa·s. Also, a melt viscosity of the poly-L-lactic acid at a temperature of 215° C. and a shear rate of 1216 sec$^{-1}$ was 86 Pa·s. Melt spinning was performed by using the obtained polymer alloy chip at a melting temperature of 230° C., a spinning temperature of 230° C. (a spinneret surface temperature of 215° C.), and a spinning speed of 3200 m/minute in a similar manner to the case of Example 1 to thereby obtain an undrawn yarn. Then, drawing and heat treatment of the obtained undrawn yarn was performed at a drawing temperature of 90° C., a draw ratio of 1.5 times, and a heat setting temperature of 130° C. in a similar manner to the case of Example 1 to obtain a polymer alloy fiber. The polymer alloy fiber had 70 dtex, 36 filaments, a strength of 3.4 cN/dtex, an elongation percentage of 38%, and U %=0.7%. A cross-sectional TEM observation of the obtained polymer alloy fiber exhibited a sea-island structure in which poly-L-lactic acid comprised a sea component, N6 comprised an island component, and a number average diameter of N6 comprising the island component was 55 nm, and the polymer alloy fiber in which the N6 islands were uniformly distributed on nanosize. Then, crimping and cutting were performed on the fiber to thereby obtain conjugate staple fibers (D) with a cut length of 51 mm.

The above polymer alloy staple fibers (D) were subjected to carding and lapping, and then further subjected to needle punching at a punching times of 3500 needles/cm$^2$ to thereby obtain a nonwoven fabric with a unit weight of 500 g/m$^2$ composed of the polymer alloy staple fibers.

The nonwoven fabric was immersed into a 3% sodium hydroxide solution at 95° C. for 1 hour to thereby hydrolyze and remove 99% or more of a polyester component in the nonwoven fabric, then neutralized with acetic acid followed by being rinsed and dried.

From the nonwoven fabric, only the N6 nanofibers were extracted and then analyzed, and consequently it turned out that a number average single fiber diameter of the N6 nanofibers was 56 nm ($3\times10^{-5}$ dtex), which was unprecedentedly fine, and a variation in single fiber fineness was extremely small as shown in Table 1.

Subsequently, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF series polyester/polyether-based polyurethane so as to contain 30 wt. % in terms of solid content with respect to the fibers in the nonwoven fabric, and then subjected to wet coagulation to thereby obtain a nonwoven fabric with a unit weight of 390 g/m$^2$ composed of the N6 nanofibers.

A surface of the obtained nonwoven fabric was buffed, pressed, and then rapidly cooled down in a similar manner to the case of Example 1, to thereby obtain an abrasive cloth having a smooth surface.

The stress at 10% elongation, compressive elasticity ratio S, abrasion resistance coefficient, surface roughness, and surface hardness of the obtained abrasive cloth, and the texturing results of a hard disk are as listed in Table 1.

Example 9

Melt spinning was performed with the use of N6 (40 wt. %) with a melt viscosity of 500 Pa·s (262° C. and a shear rate of 121.6 sec$^{-1}$) and a melting point of 220° C. in a similar manner to the case of Example 1. During the melt spinning, a shear stress between a spinneret hole wall and the polymer was set to 0.1 MPa (a viscosity of the polymer alloy was 200 Pa·s at 262° C. and a shear rate of 416 sec$^{-1}$), and a polymer alloy fiber was obtained in a similar manner to the case of Example 1. The obtained polymer alloy fiber exhibited excellent characteristics of 126 dtex, 36 filaments, a strength of 4.2 cN/dtex, an elongation percentage of 38%, and U %=1.8%. Also, a cross-sectional TEM observation of the obtained polymer alloy fiber exhibited a sea-island structure in which copolymerized PET comprising a sea component, and N6 comprising an island component, similarly to Example 1, and revealed that the polymer alloy fiber in which a number average diameter of the N6 islands was 80 nm and the N6 islands were distributed in an ultrafine state was obtained. Then, crimping and cutting were performed on the polymer alloy fiber to thereby obtain polymer alloy staple fibers (D) with a cut length of 51 mm.

The above polymer alloy staple fibers (D) were subjected to carding and lapping, and then further subjected to needle punching at a punching times of 3500 needles/$cm^2$ to thereby obtain a nonwoven fabric with a unit weight of 450 g/$m^2$ composed of the polymer alloy staple fibers.

Subsequently, in a similar manner to the case of Example 1, the nonwoven fabric was immersed into a 5% sodium hydroxide solution at 95° C. for 1 hour to thereby hydrolyze and remove 99% or more of a polyester component in the nonwoven fabric, and then neutralized with acetic acid followed by being rinsed and dried.

From the nonwoven fabric, only nanofibers were extracted and then analyzed, and consequently it turned out that a number average single fiber diameter of the nanofibers was 84 nm ($6\times10^{-5}$ dtex), which was unprecedentedly fine, and a variation in single fiber fineness was extremely small as shown in Table 1. Subsequently, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF solution of polyester/polyether-based polyurethane so as to contain 30 wt. % in terms of solid content of polyurethane with respect to the fibers in the nonwoven fabric, and then subjected to wet coagulation to thereby obtain an nonwoven fabric composed of the N6 nanofibers.

A surface of the obtained nonwoven fabric was buffed, pressed, and then rapidly cooled down in a similar manner to the case of Example 1, to thereby obtain an abrasive cloth having a smooth surface.

The stress at 10% elongation, compressive elasticity ratio S, abrasion resistance coefficient, surface roughness, and surface hardness of the obtained abrasive cloth, and the texturing results of a hard disk are as listed in Table 1.

Example 10

A woven fabric having a woven structure of 5-ply satin and a weaving density (warp×weft) of 122 (yarns/inch)×130 (yarns/inch) was obtained with the use of N6 having 44 dtex and 34 filaments and the doubling of 2 polymer alloy fibers obtained in Example 9 as a warp yarn and a weft yarn respectively.

Subsequently, in a similar manner to the case of Example 1, the woven fabric was immersed into a 5% sodium hydroxide solution at 95° C. for 1 hour to thereby hydrolyze and remove 99% or more of a polyester component in the nonwoven fabric, and then neutralized with acetic acid followed by being rinsed and dried to thereby obtain a woven fabric abrasive cloth. A cover factor of the woven fabric (warp×weft) was 860×1405.

The stress at 10% elongation of the obtained abrasive cloth, and the texturing results of a hard disk are as listed in Table 1.

Example 11

The polymer alloy fiber obtained in Example 9 was knitted with a 28-gauge circular knitting machine to obtain a weft knitted fabric having a smooth knitted structure.

Subsequently, in a similar manner to the case of Example 1, the knitted fabric was immersed into a 5% sodium hydroxide solution at 95° C. for 1 hour to thereby hydrolyze and remove 99% or more of a polyester component in the nonwoven fabric, and then neutralized with acetic acid followed by being rinsed and dried to thereby obtain a knitted fabric abrasive cloth.

The stress at 10% elongation of the obtained abrasive cloth and the texturing results of a hard disk are as listed in Table 1.

Example 12

Melt kneading was performed with the use of 20 wt. % of PBT having a melt viscosity of 120 Pa·s (262° C. and 121.6 $sec^{1}$) and a melting point of 225° C. and 80 wt. % of polystyrene copolymerized with 22% of 2-ethylhexyl acrylate (hereinafter sometimes referred to as co-PS) at a kneading temperature of 240° C. in a similar manner to the case of Example 1, to thereby obtain a polymer alloy chip.

Then, the polymer alloy chip was subjected to melt spinning at a melting temperature of 260° C. and a spinning temperature of 260° C. (spinneret surface temperature of 245° C.), a single hole discharge amount of 1.0 g/minute, and a spinning speed of 1200 m/minute in a similar manner to the case of Example 1. The obtained undrawn yarn was subjected to drawing and heat treatment at a drawing temperature of 100° C., a draw ratio of 2.49 times, and a heat setting temperature of 115° C. in a similar manner to the case of Example 1. The obtained drawn yarn had 161 dtex, 36 filaments, a strength of 1.4 cN/dtex, an elongation percentage of 33%, and U %=2.0%.

A cross-sectional TEM observation of the obtained polymer alloy fiber exhibited a sea-island structure in which co-PS comprising a sea component, and PBT comprising an island component, and revealed that the polymer alloy fiber in which a number average diameter of the PBT islands was 45 nm and the PBT islands were uniformly distributed on nanosize was obtained. Then, crimping and cutting were performed on the polymer alloy fiber to thereby obtain polymer alloy staple fibers (E) with a cut length of 51 mm.

The above polymer alloy staple fibers (D) were subjected to carding and lapping, and then further subjected to needle punching at a punching times of 3500 needles/$cm^2$ to thereby obtain a nonwoven fabric with a unit weight of 500 g/$m^2$ composed of the polymer alloy. Then, the nonwoven fabric was immersed into trichloroethylene to thereby elute 99% or more of the polystyrene resin and co-PS comprising the sea component.

From the nonwoven fabric, only the PBT nanofibers were extracted and then analyzed in a similar manner to the case of Example 1, and consequently it turned out that a number average single fiber diameter of the PBT nanofibers was 50 nm ($3\times10^{-5}$ dtex), which was unprecedentedly fine, and a variation in single fiber fineness was extremely small.

Subsequently, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF solution of polyester/polyether-based polyurethane so as to contain 30 wt. % in terms of solid content of polyurethane with respect to the fibers in the nonwoven fabric, and then subjected to wet coagulation to thereby obtain a nonwoven fabric composed of the PBT nanofibers.

A surface of the obtained nonwoven fabric was buffed, pressed, and then rapidly cooled down in a similar manner to the case of Example 1, to thereby obtain an abrasive cloth having a smooth surface.

The stress at 10% elongation, compressive elasticity ratio S, abrasion resistance coefficient, surface roughness, and surface hardness of the obtained abrasive cloth and the texturing results of a hard disk are as listed in Table 1.

Examples 13, 14, 15, 16, 17, and 18

Each abrasive cloth obtained in Example 1 in the case of Example 13, in Example 8 in the case of Example 14, in Example 9 in the case of Example 15, in Example 10 in the case of Example 16, in Example 11 in the case of Example 17, or in Example 12 in the case of Example 18 was applied on its back surface with an adhesive mainly composed of NBR (nitrile rubber) and then pressed and bonded a polyester film with a thickness of 50 μm to thereby obtain a bonding type nonwoven fabric composed of the N6 nanofiber nonwoven fabric and the polyester film.

The stress at 10% elongation, compressive elasticity ratio S, abrasion resistance coefficient, surface roughness, and surface hardness of the obtained nonwoven fabric, and the texturing results of a hard disk are as listed in Table 2.

Examples 19, 20, 21, 22, and 23

An abrasive cloth was obtained in a similar manner to each case of Examples 1, 8, 9, 10, and 11, except that a hydrolytic removal ratio of the polyester component of the polymer alloy fiber in Example 1 in the case of Example 19, in Example 8 in the case of Example 20, in Example 9 in the case of Example 21, in Example 10 in the case of Example 22, or in Example 11 in the case of Example 23 was set to be 50%.

The stress at 10% elongation, compressive elasticity ratio S, abrasion resistance coefficient, surface roughness, and surface hardness of the obtained abrasive cloth, and the texturing results of a hard disk are as listed in Table 3.

Examples 24, 25, 26, and 27

The abrasive cloth obtained in Example 13 in the case of Example 24, in Example 14 in the case of Example 25, in Example 15 in the case of Example 26, or in Example 17 in the case of Example 27 was immersed in water for 30 minutes, and then a hard disk was textured in a state where the nanofibers were sufficiently soaked with water. Texturing results of the hard disk are shown in Table 4.

Comparative Example 1

Figure 10:
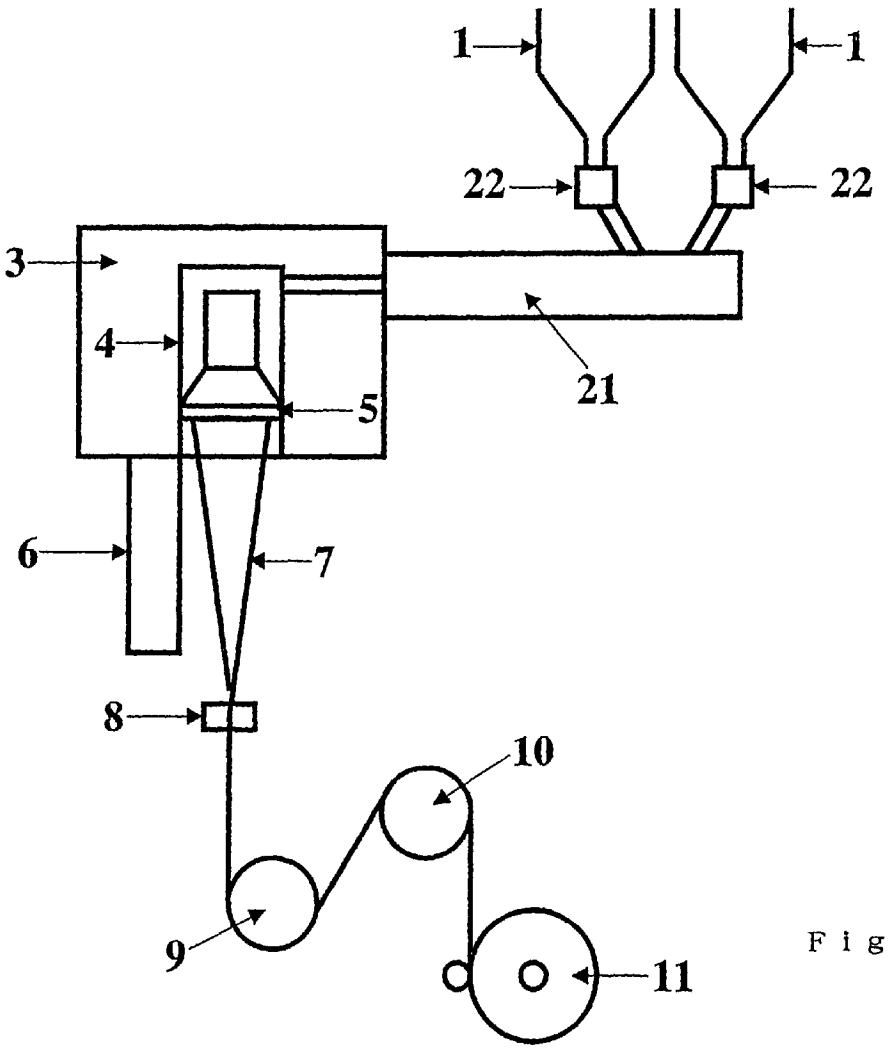
FIG. 10 is a diagram illustrating a spinning machine used in Comparative Example 1.

A device of which an outline is shown in FIG. 10 for introducing N6 with a melt viscosity of 150 Pa·s (262° C. and 121.6 $sec^{-1}$) and a melting point of 220° C. and PE with a melt viscosity of 145 Pa·s (262° C. and 121.6 $sec^{-1}$) and a melting point of 105° C. into a twin-screw extruder and simultaneously weighing respective polymers such that a blend ratio of N6 was 20 wt. % was used, and the respective polymers were melted under the condition that a temperature in the twin-screw extruder 21 was set to 260° C. Then, melt spinning was performed by using a waistless spinneret with the number of spinneret hole of 12, a discharge hole diameter of 0.30 mm, and a discharge hole length of 0.50 mm in a similar manner to the case of Example 1. A reference numeral 22 represents a chip weighing device. However, in addition to the fact that blending irregularities were large and a large Barus effect was observed under the spinneret, stringiness was poor and a yarn was not able to be stably wound, but a small amount of undrawn yarn was obtained and then subjected to drawing and heat treatment in a similar manner to the case of Example 1, to thereby obtain a drawn yarn with 82 dtex and 12 filaments. During the drawing and heat treatment, a draw ratio was set to 2.0 times. Then, crimping and cutting were performed on the fiber to obtain staple fibers composed of N6 and PE with a cut length of 51 mm.

The above staple fibers were subjected to carding and lapping, and further subjected to needle punching at a punching times of 2000 needles/$cm^2$ to thereby obtain nonwoven fabric with a unit weight of 500 g/$m^2$.

Figure 5:
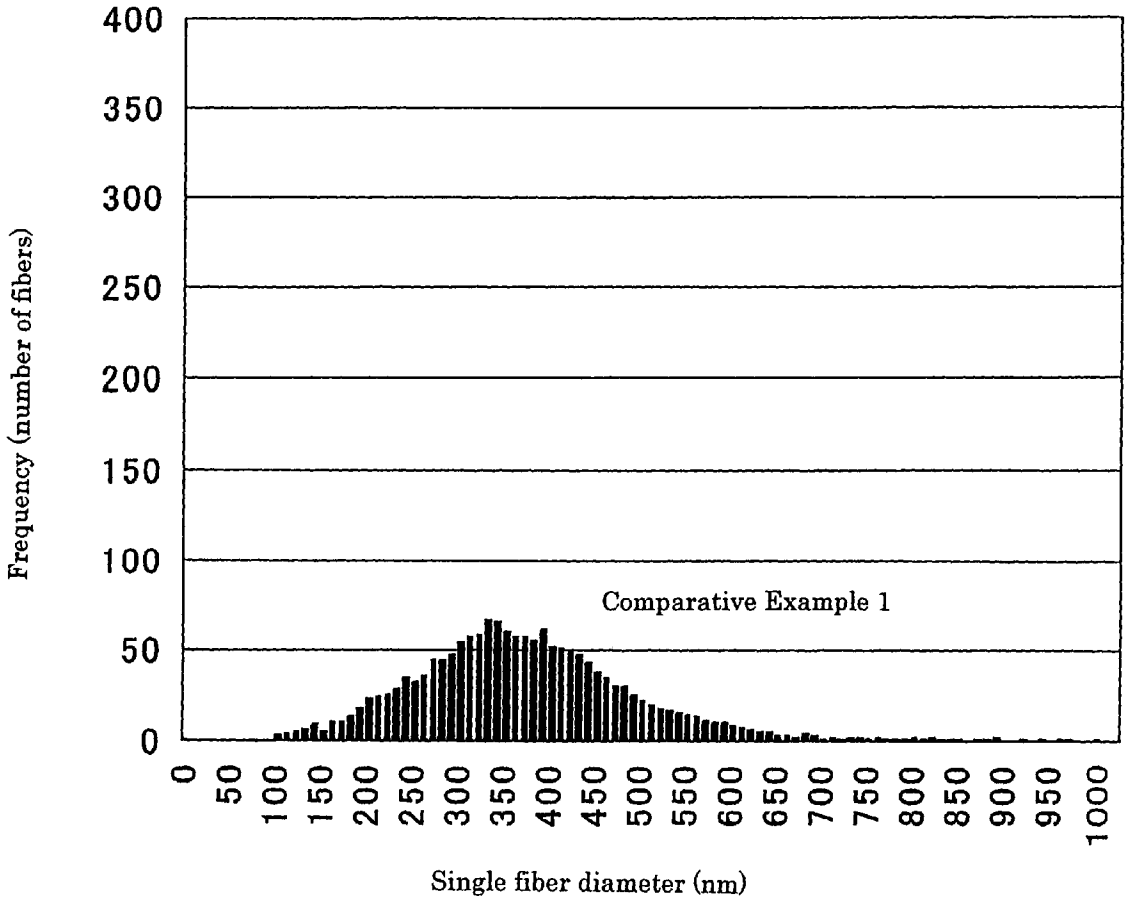
FIG. 5 is a graph illustrating a variation in single fiber fineness among ultra micro fibers in Comparative Example 1.
Figure 6:
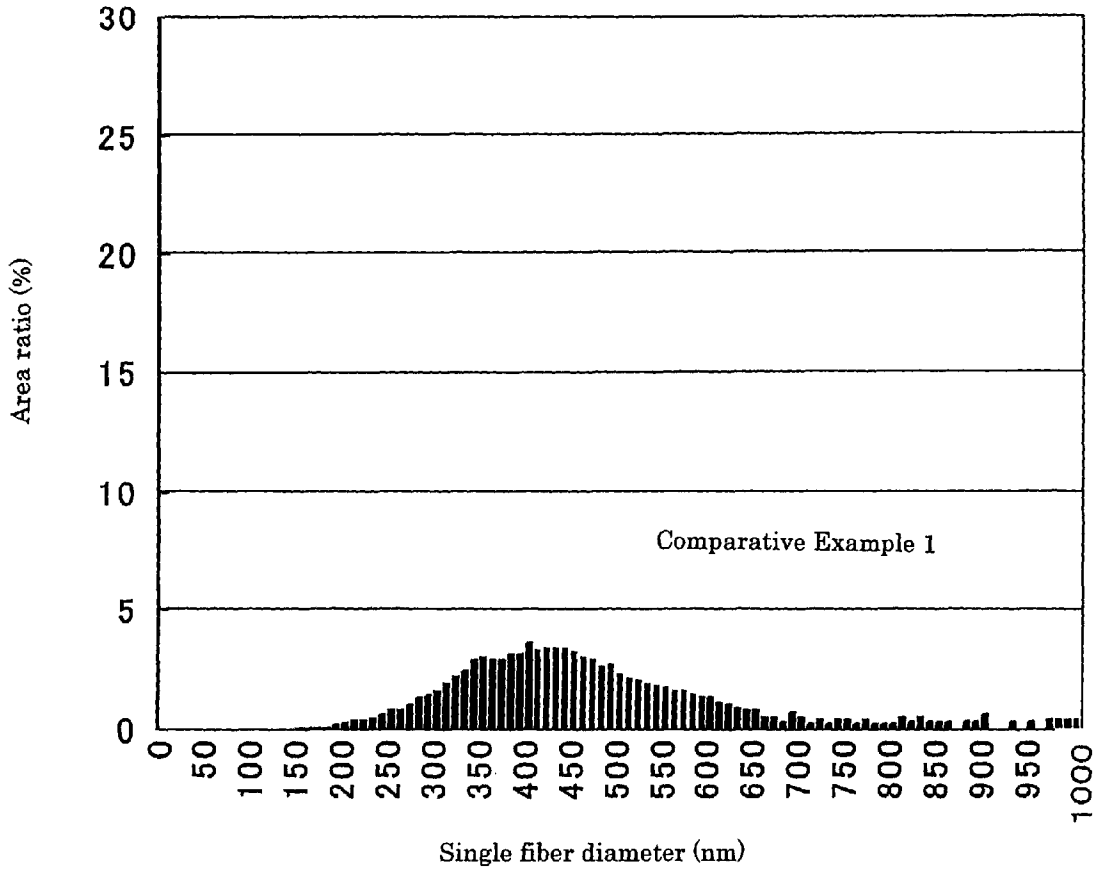
FIG. 6 is a graph illustrating a variation in single fiber fineness among ultra micro fibers in Comparative Example 1.

The nonwoven fabric was immersed into toluene at 85° C. for 1 hour or longer to thereby elute and remove 99% or more of PE in the nonwoven fabric, and a nonwoven fabric composed of an ultrafine N6 yarn was obtained. The ultrafine N6 yarn was extracted from the obtained nonwoven fabric and then analyzed, and consequently it was identified that an ultrafine yarn having a single fiber diameter of 100 nm to 1 μm (single fiber fineness of $9\times10^{-5}$ to $9\times10^{-3}$ dtex) was formed. A number average single fiber fineness of the nonwoven fabric was as large as $1\times10^{-3}$ dtex (single fiber diameter of 334 μm), and a variation in single fiber fineness was also large as shown in FIGS. 5 and 6.

Subsequently, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF solution of polyester/polyether-based polyurethane so as to contain 30 wt. % in terms of solid content of polyurethane with respect to the fibers in the nonwoven fabric, and then subjected to wet coagulation.

Subsequently, a surface of the nonwoven fabric was buffed, pressed, and then rapidly cooled down in a similar manner to the case of Example 1, to thereby obtain an abrasive cloth having a smooth surface.

Texturing results of a hard disk revealed that the number of scratches was approximately 2000 scratches, i.e., the number of defects was extremely large, and electromagnetic conversion characteristics were poor.

Comparative Example 2

An abrasive cloth was obtained in a similar manner to the case of Example 1, except that the punching times of the needle punching in Example 1 was changed to 100 needles/$cm^2$.

The stress at 10% elongation of the obtained abrasive cloth was 0.9 N/cm width, and the abrasive cloth was too much elongated in the process of texturing of a hard disk, whereby the texturing was not be able to be successfully performed.

Results summarizing the above Comparative Examples 1 and 2 are as listed in Table 5.

Example 28

The conjugate staple fibers (C) obtained in Example 3 were subjected to carding and lapping, and further needle punching at a punching times of 3500 needles/$Cm^2$ to thereby obtain nonwoven fabric with a unit weight of 600 g/$m^2$ composed of the conjugate staple fibers (C).

Then, in a similar manner to the case of Example 1, the nonwoven fabric was immersed into a 5% sodium hydroxide solution at 95° C. for 1 hour to thereby hydrolyze and remove 99% or more of a polyester component in the nonwoven fabric, and then neutralized with acetic acid followed by being rinsed and dried.

Subsequently, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF solution of polyester/polyether-based polyurethane so as to contain 30 wt. % in terms of solid content of polyurethane with respect to the fibers in the nonwoven fabric, and then subjected to wet coagulation followed by being buffed in a similar manner to the case of Example 1, to thereby obtain nonwoven fabric composed of the ultrafine N6 fibers.

Also, the water dispersion obtained in Example 4 was further diluted with water to thereby obtain a water dispersion having an N6 nanofiber concentration of 0.05 wt. %. The water dispersion having the concentration of 0.05 wt. % was sprayed 100 times through a spray nozzle onto the nonwoven fabric obtained as mentioned above to thereby form an N6 nanofiber layer onto a sheet-like material composed of the ultrafine N6 fibers, and then the formed material was dried followed by being pressed and rapidly cooled down, to thereby obtain an abrasive cloth having a smooth surface. Since a thickness of the sheet-like material composed of the ultrafine N6 fibers was 500 μm and a thickness of the whole abrasive cloth was 530 μm, a thickness of the nanofiber laminated layer was 5.7% with respect to the whole sheet-like material.

As a result of an analysis only on the N6 nanofibers in the abrasive cloth through a TEM photograph, it turned out that a number average single fiber diameter (number average diameter) of the N6 nanofibers was 56 nm ($3\times10^{-5}$ dtex), a fineness ratio which a single fiber fineness was in the range of $1\times10^{-8}$ to $1\times10^{-4}$ dtex was 99%, particularly a single fiber fineness ratio which a single fiber diameter was in the range of 55 to 84 nm was 71%, and a variation in single fiber fineness was extremely small as shown in Table 6. Also, a fiber ratio which a single fiber diameter was more than 100 nm was 0%.

The stress at 10% elongation, compressive elasticity ratio S, abrasion resistance coefficient, surface roughness, and surface hardness of the obtained abrasive cloth, and the texturing results of a hard disk are as listed in Table 6.

Production of the nanofiber dispersion liquid used in each examples is described in the following reference examples.

Reference Example 1

Melt kneading of N6 (20 wt. %) having a melt viscosity of 57 Pa·s (240° C. and a shear rate of 2432 $sec^{-1}$) and a melting point of 220° C., and poly-L-lactic acid (optical purity of 99.5% or more) (80 wt. %) having a weight-average molecular weight of 120 thousand, a melt viscosity of 30 Pa·s (240° C. and a shear rate of 2432 $sec^{1}$), and a melting point of 170° C. was performed at 220° C. by using the twin-screw extruding kneader, to thereby obtain a polymer alloy chip. Note that the weight-average molecular weight of poly-L-lactic acid was obtained in the following manner. That is, a chloroform solution of the sample was mixed with THF (tetrahydrofuran) to prepare a measuring solution. This was measured at 25° C. by using the gel permeation chromatography (GPC) Waters 2690 manufactured by Waters Corporation to thereby obtain the weight-average molecular weight in polystyrene equivalent. In addition, a melt viscosity of N6 at a temperature of 262° C. and a shear rate of 121.6 $sec^{-1}$ was 53 Pa·s. Also, a melt viscosity of the poly-L-lactic acid at a temperature of 215° C. and a shear rate of 1216 $sec^{-1}$ was 86 Pa·s. Furthermore, a kneading condition for the melt kneading at this time was as follows.

Polymer feeding: N6 and copolymerized PET were independently weighed and then separately fed into the kneader.

Screw type: one-direction fully interlocking double shred

Screw: diameter of 37 mm, effective length of 1670 mm, and L/D=45.1

The kneading length was arranged on the discharge side of a point one third of the effective length of the screw.

Temperature: 220° C.

Vent: 2 points

The polymer alloy chip was melted at 230° C. in the melting section, and then introduced to the spin block with a spinning temperature of 230° C. Then, the molten polymer alloy was filtered through a metallic nonwoven fabric having a maximum penetration particle size of 15 μm, and then melt spinning was performed from a spinneret at a spinneret surface temperature of 215° C. During the melt spinning, the spinneret having a spinneret hole diameter of 0.3 mm and a hole length of 0.55 mm was used, and a Barus effect was hardly observed. Also, during the melt spinning, a discharge amount per one hole was set to 0.94 g/minute. Furthermore, a distance from a lower surface of the spinneret to a starting point of cooling (an upper end of a chimney) was 9 cm. A discharged yarn was cooled and solidified over 1 m with a cooling air having a temperature of 20° C., oiled at an oiling guide placed 1.8 m below the spinneret, and then wound through unheated first and second take-up rollers. Subsequently, drawing and heat treatment of the wound yarn was performed under the condition that the temperature of a first hot roller was 90° C. and the temperature of a second hot roller was 130° C. During the treatment, the draw ratio between the first and second hot rollers was set to 1.5 times. An obtained polymer alloy fiber exhibited excellent characteristics of 62 dtex, 36 filaments, a strength of 3.4 cN/dtex, an elongation percentage of 38%, and U %=0.7%. Also, a cross-sectional TEM observation of the obtained polymer alloy fiber exhibited a sea-island structure having a sea component composed of poly-L-lactic acid and an island component composed of N6, and also revealed that the polymer alloy fiber was a precursor to an N6 nanofiber, in which a number average diameter of the N6 islands was 55 nm, and the N6 were dispersed in an ultrafine state.

The obtained polymer alloy fiber was immersed into a 5% sodium hydroxide solution at 95° C. for 1 hour to thereby hydrolyze and remove 99% or more of a poly-L-lactic acid component in the polymer alloy fiber, and then neutralized with acetic acid followed by being rinsed and dried, to thereby obtain a fiber bundle composed of N6 nanofibers. As a result of analyzing the obtained nanofibers through a TEM photograph, the number average diameter of the N6 nanofibers was 60 nm, which was unprecedently fine, a fiber ratio having a single fiber diameter more than 100 nm was 0%. The obtained fiber bundle composed of the N6 nanofibers was cut into a piece with a length of 2 mm to thereby obtain a cut fiber composed of the N6 nanofiber. 23 L of water and 30 g of the obtained cut fiber were arranged in a TAPPI standard Niagara test beater (manufactured by Toyo Seiki Seisaku-Sho, Ltd.), then preliminary beating was performed for 5 minutes, subsequently excess water was extracted, and the fiber was retrieved. A weight of the fiber was 250 g and its moisture content was 88 wt. %. The 250 g of the fiber in the moisture state was directly arranged into an automatic PFI mill (manufactured by Kumagai Riki Kogyo Co., Ltd.), and then subjected to beating for 6 minutes at a rotation number of 1500 rpm and a clearance of 0.2 mm. 4.2 g of the beaten fiber, 0.5 g of an anionic dispersant SHALLOLAN-103P (manufactured by Dai-ichi Kogyo Seiyaku Co., Ltd.) as a dispersant, and 500 g of water were arranged in a fiber mixer MX-X103 (manufactured by Matsushita Electric Industrial Co., Ltd.), and then stirred for 30 minutes to thereby obtain an N6 nanofiber dispersion liquid with an N6 nanofiber content of 0.1 wt. %. A zeta potential of the nanofiber in the dispersion liquid was −50 mV.

Reference Example 2

Melt kneading was performed in a similar manner to the case of Reference Example 1, except that N6 in Reference Example 1 was replaced by N6 (45 wt. %) having a melt viscosity of 212 Pa·s (262° C. and a shear rate of 121.6 $sec^{-1}$) and a melting point of 220° C., to obtain a polymer alloy chip. Then, in a similar manner to the case of Reference Example 1, it was subjected to melt spinning and drawing and heat treatment to thereby obtain a polymer alloy fiber. The obtained polymer alloy fiber exhibited excellent characteristics of 67 dtex, 36 filaments, a strength of 3.6 cN/dtex, an elongation percentage of 40%, and U %=0.7%. Also, similar to Reference Example 1, a cross-sectional TEM observation of the obtained polymer alloy fiber exhibited a sea-island structure having a sea component composed of poly-L-lactic acid and an island component composed of N6, and the polymer alloy fiber in which a number average diameter of the islands N6 was 110 nm, and the N6 were dispersed in an ultrafine state was obtained.

The obtained polymer alloy was treated in a similar manner to the case of Reference Example 1, i.e. 99% or more of the poly-L-lactic acid component in the polymer alloy fiber was hydrolyzed and removed, and then the remaining polymer alloy fiber was neutralized with acetic acid followed by being rinsed and dried, to thereby obtain a fiber bundle composed of N6 nanofibers. As a result of an analysis on the fiber bundle through a TEM photograph, it turned out that a number average diameter of the N6 nanofibers was 120 nm, which was unprecedentedly fine, a fiber ratio having a single fiber diameter more than 500 nm was 0%, and a fiber ratio having a single fiber diameter more than 200 nm was 1%.

The obtained fiber bundle composed of the N6 nanofibers was cut into a piece with a length of 2 mm to thereby obtain cut fibers of the N6 nanofibers. The obtained cut fibers were subjected to preliminary beating in a similar manner to the case of Reference Example 1, to obtain N6 nanofibers with a moisture content of 88 wt. %, then further subjected to beating in a similar manner to the case of Reference Example 1, and stirred with the use of an anionic dispersant SHALLOL AN-103P (manufactured by Dai-ichi Kogyo Seiyaku Co., Ltd., molecular weight of 10000) as a dispersant in a similar manner to the case of Reference Example 1, to obtain N6 nanofiber dispersion liquid with an N6 nanofiber content of 0.1 wt. %.

Reference Example 3

Melt kneading was performed with the use of 20 wt. % of PBT having a melt viscosity of 120 Pa·s (262° C. and 121.6 $sec^{-1}$) and a melting point of 225° C. and 80 wt. % of polystyrene copolymerized with 22% of 2-ethylhexyl acrylate (PS) at a kneading temperature of 240° C. in a similar manner to the case of Reference Example 1, to thereby obtain a polymer alloy chip. Note that the copolymerized PS had a melt viscosity of 140 Pa·s at 262° C. and 121.6 $sec^{-1}$, and that of 60 Pa·s at 245° C. and 1216 $sec^{-1}$.

Then, the polymer alloy chip was subjected to melt spinning at a melting temperature of 260° C., a spinning temperature of 260° C. (spinneret surface temperature of 245° C.), and a spinning speed of 1200 m/minute in a similar manner to the case of Reference Example 1. During the melt spinning, a spinneret which was provided at an upper part of its discharge hole with a weighing section having a diameter of 0.3 mm, and had a discharge hole diameter of 0.7 mm and a discharge hole length of 1.85 mm was used. Spinnability was good, and the number of yarn breakages for 1 t of spinning was once. During the melt spinning, a discharge amount for a single hole was set to 1.0 g/minute. The obtained undrawn yarn was subjected to drawing and heat treatment at a drawing temperature of 100° C., a draw ratio of 2.49 times, and a heat setting temperature of 115° C. in a similar manner to the case of Reference Example 1. The obtained drawn yarn had 161 dtex, 36 filaments, a strength of 1.4 cN/dtex, an elongation percentage of 33%, and U %=2.0%. A cross-sectional TEM observation of the obtained polymer alloy fiber exhibited a sea-island structure having a sea component composed of copolymerized PS and an island component composed of PBT, and the polymer alloy fiber in which a number average diameter of the PBT islands was 70 nm and the PBT islands were uniformly dispersed on nanosize was obtained.

Then, the obtained polymer alloy fiber was immersed into trichloroethylene to thereby elute 99% or more of copolymerized PS comprising the sea component, followed by being dried to thereby obtain a fiber bundle composed of PBT nanofibers. As a result of an analysis on the fiber bundle through a TEM photograph, it turned out that a number average diameter of the PBT nanofibers was 85 nm, which was unprecedentedly fine, a fiber ratio having a single fiber diameter more than 200 nm was 0%, and a fiber ratio having a single fiber diameter more than 100 nm was 1%.

The obtained fiber bundle composed of the PBT nanofibers was cut into a piece with a length of 2 mm to thereby obtain cut fibers of the PBT nanofibers. The obtained cut fibers were subjected to preliminary beating in a similar manner to the case of Reference Example 1, to obtain PBT nanofibers with a moisture content of 80 wt. %, and then further subjected to beating in a similar manner to the case of Reference Example 1. Subsequently, 2.5 g of the beaten fibers, 0.5 g of a nonionic dispersant NOIGEN EA-87 (manufactured by Dai-ichi Kogyo Seiyaku Co., Ltd., molecular weight of 10000) as a dispersant, and 500 g of water were arranged, and then stirred for 30 minutes to obtain a PBT nanofiber dispersion liquid with a PBT nanofiber content of 0.1 wt. %.

Reference Example 4

Melt kneading of PTT (polytrimethylene terephthalate) having a melt viscosity of 220 Pa·s (262° C. and 121.6 $sec^{-1}$) and a melting point of 225° C. and copolymerized PS (polystyrene) ("Estyrene" KS-18, copolymerized with methyl methacrylate, melt viscosity of 110 Pa·s at 262° C. and 121.6 $sec^{-1}$) manufactured by Nippon Steel Chemical Co., Ltd. was performed at a kneading temperature of 240° C. under the condition of a PTT content of 25 wt. %, in a similar manner to the case of Reference Example 1, to thereby obtain a polymer alloy chip. Note that the copolymerized PS had a melt viscosity of 76 Pa·s at 245° C. and 1216 $sec^{-1}$.

Then, the polymer alloy chip was subjected to melt spinning at a melting temperature of 260° C., a spinning temperature of 260° C. (spinneret surface temperature of 245° C.), and a spinning speed of 1200 m/minute in a similar manner to the case of Reference Example 3. During the melt spinning, a spinneret which was provided at an upper part of its discharge hole with a weighing section having a diameter of 0.23 mm, and had a discharge hole diameter of 2 mm and a discharge hole length of 3 mm was used, similarly to the spinneret used in Reference Example 3. Spinnability was good, and the number of yarn breakages for 1 t of spinning was once. During the melt spinning, a discharge amount for a single hole was adjusted to 1.0 g/minute. The obtained undrawn yarn was subjected to drawing at a draw ratio of 2.6 times in a 90° C. hot water bath. A cross-sectional TEM observation of the obtained drawn yarn exhibited a sea-island structure having a sea component composed of copolymerized PS, and an island component composed of PTT, and the polymer alloy fiber in which a number average diameter of the PTT islands was 75 nm and the PTT islands were uniformly dispersed on nanosize was obtained. Also, this had a single fiber fineness of 3.9 dtex, a strength of 1.3 cN/dtex, and an elongation percentage of 25%.

Then, the obtained polymer alloy fiber was treated in a similar manner to the case of Reference Example 3, to thereby elute 99% or more of the PS component in the polymer alloy fiber, followed by being dried to thereby obtain a fiber bundle composed of PTT nanofibers. As a result of an analysis on the fiber bundle through a TEM photograph, it turned out that a number average diameter of the PTT nanofibers was 95 nm, which was unprecedentedly fine, a fiber ratio having a single fiber diameter more than 200 nm was 0%, and a fiber ratio having a single fiber diameter more than 100 nm was 3%.

The obtained fiber bundle composed of the PTT nanofibers was cut into a piece with a length of 2 mm to thereby obtain cut fibers of the PTT nanofibers. The obtained cut fibers were subjected to preliminary beating in a similar manner to the case of Reference Example 1, to obtain PTT nanofibers with a moisture content of 80 wt. %, and then further subjected to beating in a similar manner to the case of Reference Example 1. Subsequently, 2.5 g of the beaten fibers, 0.5 g of a nonionic dispersant NOIGEN EA-87 (manufactured by Dai-ichi Kogyo Seiyaku Co., Ltd., molecular weight of 10000) as a dispersant, and 500 g of water were arranged, and then stirred for 30 minutes to obtain a PTT nanofiber dispersion liquid with a PTT nanofiber content of 0.1 wt. %.

Reference Example 5

Melt kneading was performed in a similar manner to the case of Reference Example 1, except that N6 in Reference Example 1 was replaced by PP (polypropylene) (23 wt. %) having a melt viscosity of 350 Pa·s (220° C. and 121.6 $sec^{-1}$) and a melting point of 162° C., to obtain a polymer alloy chip. In addition, a melt viscosity of poly-L-lactic acid at 220° C. and 121.6 $sec^{-1}$ was 107 Pa·s. Then, the polymer alloy chip was subjected to melt spinning at a melting temperature of 230° C., a spinning temperature of 230° C. (spinneret surface temperature of 215° C.), and a spinning speed of 900 m/minute in a similar manner to the case of Reference Example 1. During the melt spinning, a discharge amount per one hole was set to 1.5 g/minute. Subsequently, the obtained undrawn yarn was subjected to drawing and heat treatment at a drawing temperature of 90° C., a draw ratio of 2.7 times, and a heat setting temperature of 130° C. in a similar manner to the case of Reference Example 1.

The obtained polymer alloy fiber was immersed into a 5% sodium hydroxide solution at 98° C. for 1 hour to thereby hydrolyze and remove 99% or more of a poly-L-lactic acid component in the polymer alloy fiber, and then neutralized with acetic acid followed by being rinsed and dried, to thereby obtain a fiber bundle composed of PP nanofibers. As a result of an analysis on the fiber bundle through a TEM photograph, it turned out that a number average diameter of the PP nanofibers was 240 nm, and a fiber ratio having a single fiber diameter more than 500 nm was 0%.

The obtained fiber bundle composed of the PP nanofibers was cut into a piece with a length of 2 mm to thereby obtain cut fibers of the PP nanofibers. The obtained cut fibers were subjected to preliminary beating in a similar manner to the case of Reference Example 1, to obtain PP nanofibers with a moisture content of 75 wt. %, and then further subjected to beating in a similar manner to the case of Reference Example 1. Subsequently, 2.0 g of the beaten fibers, 0.5 g of a nonionic dispersant NOIGEN EA-87 (manufactured by Dai-ichi Kogyo Seiyaku Co., Ltd., molecular weight of 10000) as a dispersant, and 500 g of water were arranged, and then stirred for 30 minutes to obtain a PP nanofiber dispersion liquid with a PP nanofiber content of 0.1 wt. %.

Reference Example 6

Under the condition that PBT used in Reference Example 3 was replaced by PP used in Reference Example 5, a fiber bundle composed of PP ultrafine fibers was obtained in a similar manner to the case of Reference Example 3. As a result of an analysis on the fiber bundle through a TEM photograph, it turned out that a number average diameter of the PP ultrafine fibers was 600 nm.

The obtained fiber bundle composed of the PP ultrafine fibers was cut into a piece with a length of 2 mm to thereby obtain cut fibers of the PP ultrafine fibers. The obtained cut fibers were subjected to preliminary beating in a similar manner to the case of Reference Example 1, to obtain PP ultrafine fibers with a moisture content of 75 wt. %, and then further subjected to beating in a similar manner to the case of Reference Example 1. Subsequently, 2.0 g of the beaten fibers, 0.5 g of a nonionic dispersant NOIGEN EA-87 (manufactured by Dai-ichi Kogyo Seiyaku Co., Ltd., molecular weight of 10000) as a dispersant, and 500 g of water were arranged, and then stirred for 30 minutes to obtain a PP ultrafine fiber dispersion liquid with a PP ultrafine fiber content of 0.1 wt. %.

Reference Example 7

A mutually arranged polymer fiber was spun under the condition that PS and PET were used for a sea component and an island component respectively, a sea-island ratio was 50:50, the number of islands was 36, and a spinning speed was 1300 m/minute, and then drawn at a draw ratio of 3.0 times, to thereby obtain a drawn yarn composed of the mutually arranged polymer fiber having a single yarn fineness of 3 dtex. Then, the obtained drawn yarn was treated in a similar manner to the case of Reference Example 3, to thereby elute 99% or more of the PS component in the sea-island type fiber, followed by being dried to thereby obtain a PET ultrafine fiber bundle with a fiber diameter of 2 μm. The obtained PET ultrafine fiber bundle was cut into a piece with a length of 2 mm to thereby obtain cut fibers of the PET ultrafine fibers. The obtained cut fibers were subjected to preliminary beating in a similar manner to the case of Reference Example 1, to obtain PET ultrafine fibers with a moisture content of 75 wt. %, and then further subjected to beating in a similar manner to the case of Reference Example 1. Subsequently, 2.0 g of the beaten fibers, 0.5 g of a nonionic dispersant NOIGEN EA-87 (manufactured by Dai-ichi Kogyo Seiyaku Co., Ltd., molecular weight of 10000) as a dispersant, and 500 g of water were arranged, and then stirred for 30 minutes to obtain a PET ultrafine fiber dispersion liquid with a PET ultrafine fiber content of 0.1 wt. %.

Reference Example 8

A 0.1 wt. % N6 nanofiber dispersion liquid was obtained in a similar manner to the case of Reference Example 1, except that when the N6 nanofiber was stirred with the fiber mixer MX-X103 (manufactured by Matsushita Electric Industrial Co., Ltd.) shown in Reference Example 1, a dispersant was not used. A zeta potential of the nanofiber in the dispersion liquid was −14 mV.

Reference Example 9

Melt kneading of PET having a melt viscosity of 280 Pa·s (300° C. and 1216 $sec^{-1}$) and polyphenylene sulfide (PPS)

having a melt viscosity of 160 Pa·s (300° C. and 1216 $sec^{-1}$) was performed by using a twin-screw extruding kneader under the following condition such that contents of PET and PPS were 80 wt. % and 20 wt. % respectively, to thereby obtain a polymer alloy chip. Note that straight-chain PPS having a molecular chain end replaced by a calcium ion was used.

| | |
|---|---|
| Screw: | L/D = 45.<br>A kneading section length was 34% of a screw effective length.<br>The kneading section was deconcentrated over the whole screw.<br>There are 2 backflow sections. |
| Polymer feeding: | PPS and PET were independently weighed and then separately fed into the kneader. |
| Temperature: | 300° C. |
| Vent: | None. |

The polymer alloy chip obtained in this reference example was led to a spinning machine similarly to the case of Reference Example 1 and subjected to spinning. During the spinning, a spinning temperature was 315° C., and after a molten polymer alloy was filtered through a metallic nonwoven fabric having a maximum penetration particle size of 15 μm, melt spinning was performed from a spinneret with a spinneret surface temperature of 292° C. During the melt spinning, a spinneret, which was provided at an upper part of its discharge hole with a weighing section having a diameter of 0.3 mm and had a discharge hole diameter of 0.6 mm, was used. Also, during the melt spinning, a discharge amount for a single hole was set to 1.1 g/minute. Furthermore, a distance from a lower surface of the spinneret to a starting point of cooling was 7.5 cm. A discharged yarn was cooled and solidified over 1 m with a cooling air having a temperature of 20° C., oiled with process oil mainly composed of alkyl acid ester, and then wound through unheated first and second take-up rollers at a rate of 1000 m/minute. Spinnability at this time was good and the number of yarn breakages during 24 hours continuous spinning was zero. Subsequently, drawing and heat treatment of the wound yarn was performed under the condition that a temperature of a first hot roller was 100° C. and a temperature of a second hot roller was 130° C. During the treatment, the draw ratio between the first and second hot rollers was set to 3.3 times. The obtained polymer alloy fiber exhibited excellent characteristics of 400 dtex, 240 filaments, a strength of 4.4 cN/dtex, an elongation percentage of 27%, and U %=1.3%. Also, a cross-sectional TEM observation of the obtained polymer alloy fiber revealed that PPS as islands each having a diameter less than 100 nm were uniformly dispersed in PET, which was a sea polymer. Also, analysis results of circle-equivalent diameters of the islands with image analysis software WINROOF revealed that an average diameter of the islands was 65 nm, and the polymer alloy fiber in which the PPS was dispersed in an ultrafine state was obtained.

The obtained polymer alloy fiber was immersed into a 5% sodium hydroxide solution at 98° C. for 2 hours to thereby hydrolyze and remove 99% or more of a PET component in the polymer alloy fiber, and then neutralized with acetic acid followed by being rinsed and dried, to thereby obtain a fiber bundle composed of PPS nanofibers. As a result of an analysis on the fiber bundle through a TEM photograph, it turned out that a number average diameter of the PPS nanofibers was 60 nm, which was unprecedentedly fine, and a fiber ratio having a single fiber diameter more than 100 nm was 0%.

The obtained fiber bundle composed of the N6 nanofibers was cut into a piece with a length of 3 mm to thereby obtain cut fibers of the PPS nanofibers. The obtained cut fibers were subjected to preliminary beating in a similar manner to the case of Reference Example 1, to obtain PPS nanofibers with a moisture content of 80 wt. %, and then further subjected to beating in a similar manner to the case of Reference Example 1. Subsequently, 2.5 g of the beaten fibers, 0.5 g of a nonionic dispersant NOIGEN EA-87 (manufactured by Dai-ichi Kogyo Seiyaku Co., Ltd., molecular weight of 10000) as a dispersant, and 500 g of water were arranged, and then stirred for 30 minutes to obtain a PPS nanofiber dispersion liquid with a PPS nanofiber content of 0.1 wt. %.

Reference Examples 10 and 11

An N6 nanofiber dispersion liquid with an N6 nanofiber content of 0.1 wt. % was obtained in a similar manner to the case of Reference Example 1, except that a cut length of the N6 nanofiber was 0.5 mm in the case of Reference Example 10, or 0.2 mm in the case of Reference Example 11.

Examples 29 to 33 and Comparative Examples 3 and 4

Figure 11:
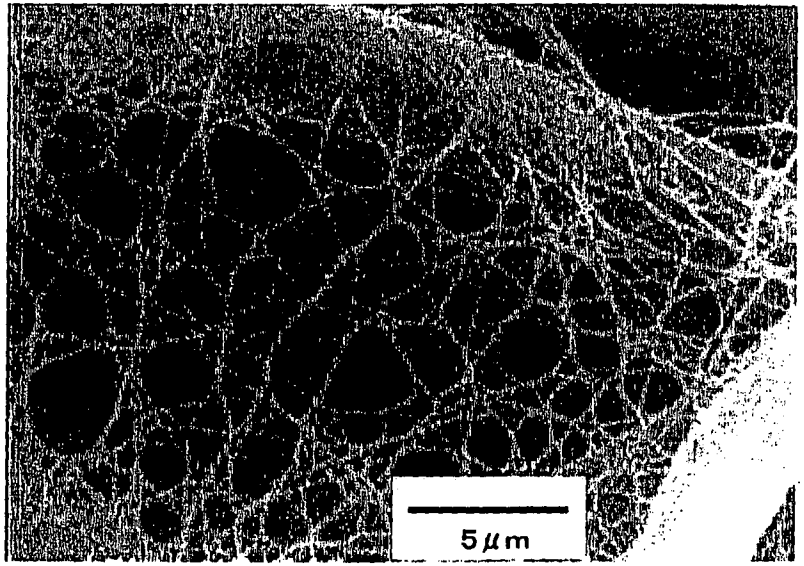
FIG. 11 is a photograph showing a SEM observation result of a surface of a nanofiber structure in Example 29.

The nanofiber dispersion liquids obtained in Reference Examples 1 to 5 in the cases of Examples 29 to 33 respectively and the ultrafine fiber dispersion liquids obtained in Reference Examples 6 and 7 in the cases of Comparative Examples 3 and 4 respectively were diluted to 1/10 with water (fiber content of 0.01 wt. % in each of the dispersion liquids), and then each of the dispersion liquids was poured into an atomizer, sprayed three times to a nonwoven fabric, as a porous support, having the same structure as artificial suede "Ecsaine" (registered trademark of Toray Industries, Inc.) 7000-T, which is also a PET ultrafine fiber nonwoven fabric, and dried at 40° C. for 30 minutes. As a result of observation of its surface through a SEM photograph, it was identified that fine nanofibers were spread in a mesh-like form between thick fibers comprising the porous support and having diameters of 7.3 μm, in each of Examples 29 to 33 where the dispersion liquids in Reference Examples 1 to 5 were respectively used. FIG. 11 shows the observation result of a surface of a nanofiber structure obtained in Example 29 through SEM, and it turned out that there were parts where the nanofibers were subjected to a single fiber dispersion to form the mesh-like structure, as well as parts where a plurality of the nanofibers were partially connected to form the mesh-like structure. Also, pore diameters in the mesh-like structure were approximately in the range of 100 nm to 3 μm. It was also identified that the nanofibers were also bonded to the fibers comprising the support in a similar form.

On the other hand, in the cases of Comparative Examples 3 and 4 where the dispersion liquids in Reference Examples 6 and 7 were respectively used, since fibers were not sufficiently dispersed therebetween when they were beaten, aggregated materials composed of fibers were attached as pills, and the mesh-like structure was not configured. Also, the fibers plugged the atomizer and spraying was difficult.

Example 34

The porous support used in Example 29 was completely immersed for 1 minute in the N6 nanofiber dispersion liquid obtained in Reference Example 1 and diluted to 1/100 with water (nanofiber content of 0.001 wt. %), followed by squeezing of excess nanofiber dispersion liquid attached to the support by using a mangle, and then dried at 60° C. for 1 hour to thereby remove a dispersion medium and obtain a nanofiber structure. As a result of observation of its surface and inside through SEM photographs, it was identified that fine nanofibers were spread in a three-dimensional mesh-like form between thick fibers comprising the porous support and having diameters of 7.3 μm, on the surface and inside of the nanofiber structure. As a result of observation of the mesh-like structure, it turned out that there were parts where the nanofibers were dispersed in a single fiber state to form the mesh-like structure, as well as parts where a plurality of nanofibers were partially connected to form the mesh-like structure. Also, pore diameters in the mesh-like structure were approximately in the range of 60 nm to 1.5 μm. It was also identified that the nanofibers were also bonded to the fibers comprising the support in a similar form.

Example 35

The N6 nanofiber dispersion liquid, which was obtained in Reference Example 1 and added with a 0.1 wt. % thickener CELLOGEN F-SL (manufactured by Dai-ichi Kogyo Seiyaku Co., Ltd.) (nanofiber content of 0.1 wt. %), was coated onto the porous support used in Example 1 at 1 g/cm$^2$, and then dried at 60° C. for 1 hour to thereby remove a dispersion medium and obtain a nanofiber structure. As a result of observation of its surface through a SEM photograph, it was identified that fine nanofibers were spread in a mesh-like form between thick fibers comprising the porous support and having diameters of 7.3 μm. As a result of observation of the mesh-like structure, it turned out that there were parts where the nanofibers were dispersed in a single fiber state to form the mesh-like structure, as well as parts where a plurality of nanofibers were partially connected to form the mesh-like structure. Also, due to the higher nanofiber content in the nanofiber dispersion liquid, an amount of the nanofibers was large, and the nanofibers were uniformly laminated, and therefore pore diameters in the mesh-like structure were in the range of 50 nm to 80 nm, which were relatively small. It was also identified that the nanofibers were also bonded to the fibers comprising the support.

Example 36

PP staple fibers with a single yarn fineness of 1.9 dtex were subjected to carding and lapping, and then further subjected to needle punching at a punching times of 500 needles/cm$^2$ to thereby obtain a PP nonwoven fabric with a unit weight of 240 g/m$^2$. 500 g of the N6 nanofiber dispersion liquid obtained in Reference Example 1 was diluted to 1/40 with water (nanofiber content of 0.0025 wt. %), which was arranged in the square sheet machine (manufactured by Kumagai Riki Kogyo Co., Ltd.), and subjected to papermaking onto the PP nonwoven fabric, followed by absorbing an excess nanofiber dispersion liquid attached to the support with No. 2 filter paper for qualitative analysis (manufactured by Toyo Roshi Kaisha, Ltd.), and subsequently dried it at 110° C. for 2 minutes by using the high-temperature rotary drier (manufactured by Kumagai Riki Kogyo Co., Ltd.), to thereby remove a dispersion medium and obtain a nanofiber structure. As a result of SEM observation of the obtained nanofiber structure, it turned out that fine nanofibers were spread in a three-dimensional mesh-like form not only on a surface of the porous support but also inside of it. Furthermore, as a result of observation of the mesh-like structure, it turned out that there were parts where the nanofibers were dispersed in a single fiber state to form the mesh-like structure, as well as parts where a plurality of nanofibers were partially connected to form the mesh-like structure. Also, pore diameters in the mesh-like structure were approximately in the range of 50 nm to 1 μm. It was also identified that the nanofibers were also bonded to the fibers comprising the support in a similar form.

Examples 37 to 41

In Example 37, a nanofiber structure was obtained in a similar manner to the case of Example 29, except that a PET plain weave fabric, which was woven at a density of 100 yarns/inch by using a yarn having 83 dtex and 36 filaments, was used as a porous support.

In Example 38, a nanofiber structure was obtained in a similar manner to the case of Example 29, except that a PET weft knitted fabric having a smooth knitted structure, which was knitted with the use of a yarn having 83 dtex and 36 filaments and also a 28-gauge circular knitting machine, was used as a porous support.

In Example 39, a nanofiber structure was obtained in a similar manner to the case of Example 29, except that No. 2 filter paper for qualitative analysis (manufactured by Toyo Roshi Kaisha, Ltd.) was used as a porous support.

In Example 40, a nanofiber structure was obtained in a similar manner to the case of Example 29, except that polyethylene foam having an apparent density of 0.033 g/cm$^3$ measured in conformity to JIS K6767 and an average foam diameter of 0.6 mm measured in conformity to JIS K6402 was used as a porous support.

In Example 41, a nanofiber structure was obtained in a similar manner to the case of Example 29, except that a PET film with a thickness of 10 μm was used as a porous support.

As a result of observation of the nanofiber structures obtained in the above-described Examples 37 to 41, any of the structures exhibited that nanofibers were spread in a mesh-like form in pore parts of the porous supports.

Furthermore, as a result of observation of the mesh-like structure, it turned out that there were parts where the nanofibers were dispersed in a single fiber state to form the mesh-like structure, as well as parts where a plurality of nanofibers were partially connected to form the mesh-like structure. It was also identified that the nanofibers were also bonded to any of the supports in Examples 37 to 41 in a similar form.

Examples 42 and 43

The dispersion liquid used in Reference Example 1 in the case of Example 42 or in Reference Example 8 in the case of Example 43 was diluted to 1/10 with water (nanofiber content of 0.01 wt. %), and two drops (0.1 g) of the diluted dispersion liquid were put onto stainless steel wire mesh with a wire diameter of 33 μm and a mesh density of 325 wires/inch, followed by being dried at 70° C. for 10 minutes to thereby rapidly remove a dispersion medium and obtain an N6 nanofiber structure.

Figure 12:
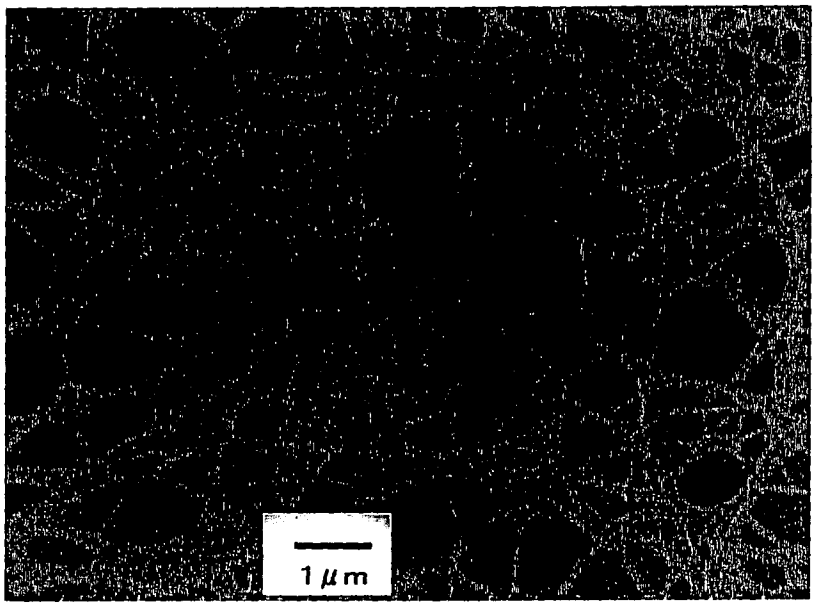
FIG. 12 is a photograph showing a SEM observation result of a surface of a nanofiber structure in Example 42.

FIG. 12 shows a SEM observation result of a surface of the nanofiber structure in Example 42, and revealed that in most parts, a plurality of nanofibers were partially aggregated to form the mesh-like structure, although there were parts where the nanofibers were dispersed in a single fiber state to form the mesh-like structure. Also, pore diameters in the mesh-like structure were approximately in the range of 100 nm to 1.5 μl m.

Figure 13:
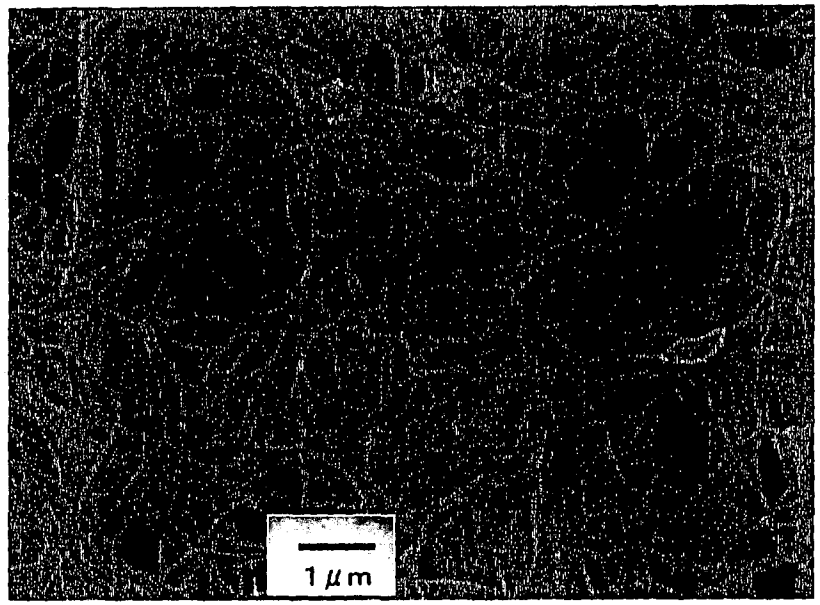
FIG. 13 is a photograph showing a SEM observation result of a surface of a nanofiber structure in Example 43.

On the other hand, FIG. 13 shows a SEM observation result of a surface of the nanofiber structure in Example 43, and revealed that bundle parts in which a plurality of nanofibers were aggregated were layered, onto which nanofiber single fibers were dispersed to form a mesh-like structure. Also, pore diameters in the mesh-like structure were approximately in the range of 50 nm to 0.8 μm, which were smaller in comparison with the case of Example 42.

Due to low wettability with wire mesh in Example 42 or 43, the dropped nanofiber dispersion liquid had a shape close to a hemisphere, which was obviously different in shape of a dropped liquid from those in the case of spraying, immersing, papermaking, or the like. From the shape, it can be considered that rapid drying of it causes a rapid concentration of nanofibers in the thickness direction of the dropped liquid.

Furthermore, Example 43 does not involve any dispersant, and therefore it can be considered that some of the nanofibers started aggregation when the dispersion liquid was dropped, and then compressed simply in the thickness direction due to rapid drying, resulting in the shape as shown in FIG. 13. On the other hand, Example 42 involves a dispersant, it can be considered that the nanofibers were dispersed in a single fiber state when the dispersion liquid was dropped, and then secondarily aggregated in a process of the concentration. It is also considered that the secondary aggregation was not much developed due to rapid drying, resulting in the shape as shown in FIG. 12.

As described, the dispersion state or drying rate of nanofibers in the nanofiber dispersion liquid due to the dispersant, the wettability of nanofiber dispersion liquid and a support, or the shape of attached liquid enables the mesh-like structure to be controlled.

Examples 44 to 46

The nanofiber dispersion liquids obtained in Reference Examples 9 to 11 in the cases of Examples 44 to 46 respectively were diluted to 1/10 with water (nanofiber content of 0.01 wt. %), and then each of the dispersion liquids was poured into an atomizer, sprayed three times to a nonwoven fabric, as a porous support, having the same structure as artificial suede "Ecsaine" (registered trademark of Toray Industries, Inc.) 7000-T, which is also a PET ultrafine fiber nonwoven fabric, and dried at 40° C. for 30 minutes.

As a result of observation of its surface through a SEM photograph, it was identified that fine nanofibers were spread in a mesh-like form between thick fibers comprising the porous support and having diameters of 7.3 μm, in each of Examples 44 to 46. Also, as a result of observation of the mesh-like structure, it turned out that there were parts where the nanofibers were dispersed in a single fiber state to form the mesh-like structure, as well as parts where a plurality of the nanofibers were partially connected to form the mesh-like structure. Also, pore diameters in the mesh-like structure were approximately in the range of 100 nm to 3 μm. It was also identified that the nanofibers were also bonded to the fibers comprising the support in a similar form.

Example 47

With the use of 60 wt. % poly-L-lactic acid used in Example 8 for a sea component and the 40 wt. % polymer alloy obtained in Example 8 for an island component respectively, a conjugate fiber with 8.0 dtex was prepared by melt spinning such that the island component was composed of 100 islands, and then drawn by 2.5 times to obtain a conjugate fiber with 3.2 dtex.

This conjugate fiber had a strength of 2.8 cN/dtex and an elongation percentage of 40%. As a result of a cross-sectional TEM observation the obtained conjugate fiber, it turned out that a number average diameter of the N6 parts in the island component was 56 nm. Crimping and cutting of the fiber were performed to obtain conjugate staple fibers (F) with a cut length of 51 mm.

These conjugate staple fibers (F) were subjected to carding and lapping, and further subjected to needle punching at a punching times of 500 needles/cm$^2$ to obtain a nonwoven fabric with a unit weight of 500 g/m$^2$ composed of the conjugate staple fibers (F).

Also, the conjugate staple fibers (C) used in Example 3 were subjected to carding and lapping, and further subjected to needle punching at a punching times of 500 needles/cm$^2$ to obtain a nonwoven fabric with a unit weight of 500 g/m$^2$ composed of the conjugate staple fibers (C).

One sheet of the nonwoven fabric composed of the conjugate staple fibers (F) and another sheet of the nonwoven fabric composed of the conjugate staple fibers (C), both obtained as above, were stacked, and further subjected to needle punching at a punching times of 3000 needles/m$^2$ to obtain a bonding type nonwoven fabric composed of the conjugate staple fibers (F) and the conjugate staple fibers (C).

Subsequently, in a similar manner to the case of Example 1, this nonwoven fabric was immersed into 5% sodium hydroxide solution at 95° C. for 1 hour to thereby hydrolyze and remove 99% or more of a polyester component in the nonwoven fabric, and then neutralized with acetic acid followed by being rinsed and dried.

Then, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF solution of polyester/polyether-based polyurethane so as to contain 30 wt. % in terms of solid content of polyurethane with respect to the fibers in the nonwoven fabric, and then subjected to wet coagulation to thereby obtain a bonding type nonwoven fabric composed of the N6 nanofibers and ultrafine N6 fibers.

A surface of the obtained nonwoven fabric was buffed, pressed, and then rapidly cooled down in a similar manner to the case of Example 1, to thereby obtain an abrasive cloth having a smooth surface.

The stress at 10% elongation, compressive elasticity ratio S, abrasion resistance coefficient, surface roughness, and surface hardness of the obtained abrasive cloth, and the texturing results of a hard disk are as listed in Table 9.

Example 48

By using 40 wt. % poly-L-lactic acid used in Example 8 for a sea component, a 35 wt. % N6 resin for a core component, and the 25 wt. % polymer alloy obtained in Example 8 for a sheath component respectively, an island-core-sheath type sea-island conjugate fiber (the number of islands are 36) was spun with a ternary spinning machine to obtain an undrawn yarn. Then, the undrawn yarn was drawn by 2.0 times to produce a conjugate fiber with 7.0 dtex.

The conjugate fiber had a strength of 2.8 cN/dtex and an elongation percentage of 45%. As a result of a cross-sectional TEM observation of the obtained conjugate fiber, it turned out that a number average diameter of the N6 parts in the sheath component was 56 nm. Crimping and cutting of the fiber were performed to obtain conjugate staple fibers (G) with a cut length of 51 mm.

The conjugate staple fibers (G) were subjected to carding and lapping, and further subjected to needle punching at a punching times of 3500 needles/cm$^2$ to obtain a nonwoven fabric with a unit weight of 750 g/m$^2$ composed of the conjugate staple fibers (G).

Subsequently, in a similar manner to the case of Example 1, the nonwoven fabric was immersed into 5% sodium hydroxide solution at 95° C. for 1 hour to thereby hydrolyze and remove 99% or more of a polyester component in the nonwoven fabric, and then neutralized with acetic acid followed by being rinsed and dried.

Then, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF solution of polyester/polyether-based polyurethane so as to contain 30 wt. % in terms of solid content of polyurethan with respect to the fibers in the nonwoven fabric, and then subjected to wet coagulation to thereby obtain a nonwoven fabric composed of the N6 nanofibers.

A surface of the obtained nonwoven fabric was buffed, pressed, and then rapidly cooled down in a similar manner to the case of Example 1, to thereby obtain an abrasive cloth having a smooth surface.

The stress at 10% elongation, compressive elasticity ratio S, abrasion resistance coefficient, surface roughness, and surface hardness of the obtained abrasive cloth, and the texturing results of a hard disk are as listed in Table 9.

Example 49

A hollow annular petalous 24-division splittable conjugate fiber (single fiber fineness of 2.4 dtex, and conjugate ratio of 1:1) composed of poly-L-lactic acid used in Example 8 and the polymer alloy obtained in Example 8 was spun out from a spinneret at a spinning speed of 2900 m/minute, and collected onto a net conveyer (collection sheet) under a suctioning condition by using an ejector. During the above processing, an ejector pressure was set to 0.1 MPa. A conjugate fiber nonwoven fabric (unit weight of 300 g/m$^2$) collected on the net conveyer was temporarily set at room temperature by a calender press method.

Also, the conjugate staple fibers (C) used in Example 3 were independently subjected to carding and lapping, and further subjected to needle punching at a punching times of 300 needles/cm$^2$ to thereby obtain a nonwoven fabric with a unit weight of 250 g/m$^2$ composed of the conjugate staple fibers (C).

One sheet of the conjugate fiber nonwoven fabric and another sheet of the nonwoven fabric composed of the conjugate staple fibers (C), both obtained as above, were stacked, and then punched four times, i.e., on its front surface at 10 MPa, back surface (the surface touched a net conveyer when collecting) at 10 MPa, front surface at 20 MPa, and back surface at 20 MPa, with a water jet punch (WJP), to be thereby bonded as well as densified.

Subsequently, in a similar manner to the case of Example 1, the nonwoven fabric was immersed into 5% sodium hydroxide solution at 95° C. for 1 hour to thereby hydrolyze and remove 99% or more of a polyester component in the nonwoven fabric, and then neutralized with acetic acid followed by being rinsed and dried.

As a result of a cross-sectional TEM observation of the nonwoven fabric, it turned out that a number average diameter in the N6 parts in the sheath component was 56 nm.

Then, polyvinyl alcohol was provided to the nonwoven fabric such that a solid content of the polyvinyl alcohol was 20 wt. % with respect to the fibers in the nonwoven fabric.

Furthermore, the nonwoven fabric was impregnated in DMF solution of polyester/polyether-based polyurethane so as to contain 30 wt. % in terms of solid content of polyurethane with respect to the fibers in the nonwoven fabric, and then subjected to wet coagulation to thereby obtain a bonding type nonwoven fabric composed of the N6 nanofibers and the ultrafine N6 fibers.

A surface of the obtained nonwoven fabric was buffed, pressed, and then rapidly cooled down in a similar manner to the case of Example 1, to thereby obtain an abrasive cloth having a smooth surface.

The stress at 10% elongation, compressive elasticity ratio S, abrasion resistance coefficient, surface roughness, and surface hardness of the obtained abrasive cloth, and texturing results of a hard disk are as listed in Table 9.

INDUSTRIAL APPLICABILITY

The nanofibers of the present invention enables an unprecedentedly good-hand fabric and a high-performance abrasive cloth, which have not been able to be seen with ordinary ultrafine fibers, to be obtained.

Also, the method for producing a nanofiber structure according to the present invention is applicable to the production of any nanofiber structure comprised by conjugating the nanofibers with a support, and particularly preferable to abrasing, wiping and polishing applications using the surface smoothness, flexibility, and wiping capability of the nanofiber structure. It is also preferable to the production of filters in the range from daily life material applications to various industrial fields, and of nanofiber filters for medical use such as a blood filter. Furthermore, not only to the filter applications, it is also preferable to general fiber applications including daily life material applications such as apparel, interior, automotive interior, and cosmetic applications.

TABLE 1

| | Polymer comprising nanofiber | Form of sheet-like material | Nanofibers number average Diameter (nm) | Nanofibers number average Fineness (dtex) | Nanofibers variation Fineness ratio (%) | Nanofibers variation Range Diameter range (nm) | Nanofibers variation Range Area ratio (%) |
|---|---|---|---|---|---|---|---|
| Example 1 | N6 | Needle punched nonwoven fabric | 56 | $3 \times 10^{-5}$ | 99 | 55~84 | 71 |
| Example 2 | N6 | Needle punched nonwoven fabric | 56 | $3 \times 10^{-5}$ | 99 | 55~84 | 71 |
| Example 3 | N6 | Needle punched nonwoven fabric | 56 | $3 \times 10^{-5}$ | 99 | 55~84 | 71 |

TABLE 1-continued

| | | | | | | | |
|---|---|---|---|---|---|---|---|
| Example 4 | N6 | Wet paper making | 56 | $3 \times 10^{-5}$ | 99 | 55~84 | 71 |
| Example 5 | N6 | Wet paper making | 56 | $3 \times 10^{-5}$ | 99 | 55~84 | 71 |
| Example 6 | N6 | Wet paper making | 56 | $3 \times 10^{-5}$ | 99 | 55~84 | 71 |
| Example 7 | N6 | Wet paper making | 56 | $3 \times 10^{-5}$ | 99 | 55~84 | 71 |
| Example 8 | N6 | Needle punched nonwoven fabric | 56 | $3 \times 10^{-5}$ | 99 | 55~84 | 71 |
| Example 9 | N6 | Needle punched nonwoven fabric | 84 | $6 \times 10^{-5}$ | 78 | 75~104 | 64 |
| Example 10 | N6 | Woven fabric | 84 | $6 \times 10^{-5}$ | 78 | 75~104 | 64 |
| Example 11 | N6 | Woven fabric | 84 | $6 \times 10^{-5}$ | 78 | 75~104 | 64 |
| Example 12 | PBT | Needle punched nonwoven fabric | 50 | $3 \times 10^{-5}$ | 98 | 45~74 | 70 |

| | Sheet-like material | | | | | Texturing characteristics Texturing of hard disk | |
|---|---|---|---|---|---|---|---|
| | Stress at 10% elongation (N/cm width) | Compressive elasticity ratio S | Abrasion resistance coefficient (mg) | Surface roughness (μm) | Surface hardness (A) | Substrate surface roughness (nm) | Counts of scratches (counts/10 substrates) |
| Example 1 | 12 | 3.0 | 30 | 20 | 38 | 0.24 | 96 |
| Example 2 | 16 | 2.4 | 29 | 32 | 46 | 0.23 | 90 |
| Example 3 | 14 | 2.8 | 27 | 18 | 44 | 0.25 | 150 |
| Example 4 | 100 | — | — | 49 | — | 0.30 | 160 |
| Example 5 | 100 | — | — | 55 | — | 0.29 | 150 |
| Example 6 | 100 | — | — | 39 | — | 0.24 | 100 |
| Example 7 | 100 | — | — | 44 | — | 0.23 | 90 |
| Example 8 | 12 | 3.0 | 30 | 21 | 39 | 0.24 | 95 |
| Example 9 | 13 | 3.2 | 29 | 33 | 41 | 0.27 | 140 |
| Example 10 | 8 | — | — | — | — | 0.29 | 170 |
| Example 11 | 6 | — | — | — | — | 0.30 | 190 |
| Example 12 | 13 | 2.6 | 33 | 23 | 42 | 0.28 | 150 |

Fineness ratio: A fineness ratio of fibers each of which a single fiber fineness falls within the range of $1 \times 10^{-8}$ to $1 \times 10^{-4}$ dtex.
Range: One example of a fineness ratio of fibers each of which a diameter falls within a width of 30 nm.

TABLE 2

| | | Sheet-like material | | | | | Texturing characteristics Texturing of hard disk | |
|---|---|---|---|---|---|---|---|---|
| | Abrasive cloth with which film is bonded | Stress at 10% elongation (N/cm width) | Compressive elasticity ratio S | Abrasion resistance coefficient (mg) | Surface roughness (μm) | Surface hardness (A) | Substrate surface roughness (nm) | Counts of scratches (counts/10 substrates) |
| Example 13 | Example 1 | 70 | 3.0 | 30 | 20 | 39 | 0.23 | 90 |
| Example 14 | Example 8 | 70 | 3.0 | 30 | 21 | 40 | 0.23 | 89 |

TABLE 2-continued

| | | Sheet-like material | | | | | Texturing characteristics | |
|---|---|---|---|---|---|---|---|---|
| | | | | | | | Texturing of hard disk | |
| | Abrasive cloth with which film is bonded | Stress at 10% elongation (N/cm width) | Compressive elasticity ratio S | Abrasion resistance coefficient (mg) | Surface roughness (μm) | Surface hardness (A) | Substrate surface roughness (nm) | Counts of scratches (counts/10 substrates) |
| Example 15 | Example 9 | 70 | 3.2 | 29 | 33 | 42 | 0.25 | 120 |
| Example 16 | Example 10 | 70 | — | — | — | — | 0.28 | 140 |
| Example 17 | Example 11 | 70 | — | — | — | — | 0.29 | 185 |
| Example 18 | Example 12 | 70 | 2.6 | 33 | 23 | 43 | 0.26 | 140 |

TABLE 3

| | | Sheet-like material | | | | | Texturing characteristics | |
|---|---|---|---|---|---|---|---|---|
| | | | | | | | Texturing of hard disk | |
| | Polymer alloy fibers to be used | Stress at 10% elongation (N/cm width) | Compressive elasticity ratio S | Abrasion resistance coefficient (mg) | Surface roughness (μm) | Surface hardness (A) | Substrate surface roughness (nm) | Counts of scratches (counts/10 substrates) |
| Example 19 | Example 1 | 14 | 3.0 | 31 | 22 | 36 | 0.26 | 100 |
| Example 20 | Example 8 | 14 | 3.0 | 31 | 23 | 37 | 0.26 | 98 |
| Example 21 | Example 9 | 15 | 3.2 | 30 | 35 | 39 | 0.29 | 145 |
| Example 22 | Example 10 | 10 | — | — | — | — | 0.30 | 174 |
| Example 23 | Example 11 | 8 | — | — | — | — | 0.30 | 195 |

TABLE 4

| | | Sheet-like material | | | | | Texturing characteristics | |
|---|---|---|---|---|---|---|---|---|
| | | | | | | | Texturing of hard disk | |
| | Abrasive cloth to be used | Stress at 10% elongation (N/cm width) | Compressive elasticity ratio S | Abrasion resistance coefficient (mg) | Surface roughness (μm) | Surface hardness (A) | Substrate surface roughness (nm) | Counts of scratches (counts/10 substrates) |
| Example 24 | Example 13 | 70 | 3.0 | 30 | 20 | 39 | 0.22 | 80 |
| Example 25 | Example 14 | 70 | 3.0 | 30 | 21 | 40 | 0.21 | 84 |
| Example 26 | Example 15 | 70 | 3.2 | 29 | 33 | 42 | 0.23 | 100 |
| Example 27 | Example 16 | 70 | — | — | — | — | 0.24 | 105 |

TABLE 5

| | | | Nanofibers | | Nanofibers variation | | |
|---|---|---|---|---|---|---|---|
| | | | | | | Range | |
| | Polymer comprising nanofiber | Form of sheet-like material | number average Diameter (nm) | number average Fineness (dtex) | Fineness ratio (%) | Diameter range (nm) | Area ratio (%) |
| Comparative Example 1 | N6 | Needle punched nonwoven fabric | 334 | $1 \times 10^{-3}$ | 0 | 395~424 | 10 |

TABLE 5-continued

| | | | | | | | |
|---|---|---|---|---|---|---|---|
| Comparative Example 2 | N6 | Needle punched nonwoven fabric | 56 | $3 \times 10^{-5}$ | 99 | 55~84 | 71 |

| | Sheet-like material | | | | | Texturing characteristics Texturing of hard disk | |
|---|---|---|---|---|---|---|---|
| | Stress at 10% elongation (N/cm width) | Compressive elasticity ratio S | Abrasion resistance coefficient (mg) | Surface roughness (μm) | Surface hardness (A) | Substrate surface roughness (nm) | Counts of scratches (counts/10 substrates) |
| Comparative Example 1 | 5 | — | — | — | — | 0.25 | 96 |
| Comparative Example 2 | 2 | 3.5 | 67 | 62 | 21 | — | — |

Fineness ratio: A fineness ratio of fibers each of which a single fiber fineness falls within the range of $1 \times 10^{-8}$ to $1 \times 10^{-4}$ dtex.
Range: One example of a fineness ratio of fibers each of which a diameter falls within a width of 30 nm.

TABLE 6

| | Polymer comprising nanofiber | Form of sheet-like material | Nanofibers number average Diameter (nm) | Nanofibers number average Fineness (dtex) | Nanofibers variation Fineness ratio (%) | Nanofibers variation Range Diameter range (nm) | Nanofibers variation Range Area ratio (%) |
|---|---|---|---|---|---|---|---|
| Example 28 | N6 | Needle punched nonwoven fabric (sprayed) | 56 | $3 \times 10^{-5}$ | 99 | 55~84 | 71 |

| | Sheet-like material | | | | | Texturing characteristics Texturing of hard disk | |
|---|---|---|---|---|---|---|---|
| | Stress at 10% elongation (N/cm width) | Compressive elasticity ratio S | Abrasion resistance coefficient (mg) | Surface roughness (μm) | Surface hardness (A) | Substrate surface roughness (nm) | Counts of scratches (counts/10 substrates) |
| Example 28 | 13 | 2.7 | 30 | 18 | 36 | 0.24 | 92 |

Fineness ratio: A fineness ratio of fibers each of which a single fibers fineness falls within the range of $1 \times 10^{-8}$ to $1 \times 10^{-4}$ dtex.
Range: One example of a fineness ratio of fibers each of which a diameter falls within a width of 30 nm.

TABLE 7

| | Dispersant in nanofiber dispersion liquid | Nanofibers Polymer | Nanofibers Number average diameter | Nanofibers Fiber ratio of thick fibers | Dispersant content (wt. %) |
|---|---|---|---|---|---|
| Reference Example 1 | SHALLOL AN-103P | N6 | 60 nm | 0%: diameters of fibers more than 100 nm | 0.1 |

TABLE 7-continued

| | Dispersant in nanofiber dispersion liquid | Nanofibers | | | |
|---|---|---|---|---|---|
| | | Polymer | Number average diameter | Fiber ratio of thick fibers | Dispersant content (wt. %) |
| Reference Example 2 | SHALLOL AN-103P | N6 | 120 nm | 0%: diameters of fibers more than 500 nm<br>1%: diameters of fibers more than 200 nm | 0.1 |
| Reference Example 3 | NOIGEN EA-87 | PBT | 85 nm | 0%: diameters of fibers more than 200 nm<br>1%: diameters of fibers more than 100 nm | 0.1 |
| Reference Example 4 | NOIGEN EA-87 | PTT | 95 nm | 0%: diameters of fibers more than 200 nm<br>3%: diameters of fibers more than 100 nm | 0.1 |
| Reference Example 5 | NOIGEN EA-87 | PP | 240 nm | 0%: diameters of fibers more than 500 nm | 0.1 |
| Reference Example 6 | NOIGEN EA-87 | PET | 600 nm | — | 0.1 |
| Reference Example 7 | NOIGEN EA-87 | PP | 2 μm | — | 0.1 |
| Reference Example 8 | None | N6 | 60 nm | 0%: diameters of fibers more than 100 nm | 0.1 |
| Reference Example 9 | NOIGEN EA-87 | PPS | 60 nm | 0%: diameters of fibers more than 100 nm | 0.1 |
| Reference Example 10 | SHALLOL AN-103P | N6 | 60 nm | 0%: diameters of fibers more than 100 nm | 0.1 |
| Reference Example 11 | SHALLOL AN-103P | N6 | 60 nm | 0%: diameters of fibers more than 100 nm | 0.1 |

TABLE 8

| | Nanofiber dispersion liquid | Dispersant in nanofiber dispersion liquid | Nanofibers | | | | | |
|---|---|---|---|---|---|---|---|---|
| | | | Polymer | Number average diameter | Fiber ratio of thick fibers | Dispersant content (wt. %) | Porous support | Nanofiber attaching method |
| Example 29 | Reference Example 1 | SHALLOL AN-103P | N6 | 60 nm | 0%: diameters of fibers more than 100 nm | 0.01 | PET ultrafine fiber nonwoven fabric | Spray of nanofiber dispersion liquid |
| Example 30 | Reference Example 2 | SHALLOL AN-103P | N6 | 120 nm | 0%: diameters of fibers more than 500 nm<br>1%: diameters of fibers more than 200 nm | 0.01 | PET ultrafine fiber nonwoven fabric | Spray of nanofiber dispersion liquid |
| Example 31 | Reference Example 3 | NOIGEN EA-87 | PBT | 85 nm | 0%: diameters of fibers more than 200 nm<br>1%: diameters of fibers more than 100 nm | 0.01 | PET ultrafine fiber nonwoven fabric | Spray of nanofiber dispersion liquid |

TABLE 8-continued

| | Nanofiber dispersion liquid | Dispersant in nanofiber dispersion liquid | Nanofibers | | | | | |
|---|---|---|---|---|---|---|---|---|
| | | | Polymer | Number average diameter | Fiber ratio of thick fibers | Dispersant content (wt. %) | Porous support | Nanofiber attaching method |
| Example 32 | Reference Example 4 | NOIGEN EA-87 | PTT | 95 nm | 0%: diameters of fibers more than 200 nm 3%: diameters of fibers more than 100 nm | 0.01 | PET ultrafine fiber nonwoven fabric | Spray of nanofiber dispersion liquid |
| Example 33 | Reference Example 5 | NOIGEN EA-87 | PP | 240 nm | 0%: diameters of fibers more than 500 nm | 0.01 | PET ultrafine fiber nonwoven fabric | Spraying of nanofiber dispersion liquid |
| Comparative Example 3 | Reference Example 6 | NOIGEN EA-87 | PET | 600 nm | — | 0.01 | PET ultrafine fiber nonwoven fabric | Spraying of nanofiber dispersion liquid |
| Comparative Example 4 | Reference Example 7 | NOIGEN EA-87 | PP | 2 μm | — | 0.01 | PET ultrafine fiber nonwoven fabric | Spraying of nanofiber dispersion liquid |
| Example 34 | Reference Example 1 | SHALLOL AN-103P | N6 | 60 nm | 0%: diameters of fibers more than 100 nm | 0.001 | PET ultrafine fiber nonwoven fabric | Soaking in nanofiber dispersion liquid |
| Example 35 | Reference Example 1 | SHALLOL AN-103P | N6 | 60 nm | 0%: diameters of fibers more than 100 nm | 0.1 | PET ultrafine fiber nonwoven fabric | Coating of nanofiber dispersion liquid |
| Example 36 | Reference Example 1 | SHALLOL AN-103P | N6 | 60 nm | 0%: diameters of fibers more than 100 nm | 0.0025 | PP nonwoven fabric | Papermaking from nanofiber dispersion liquid |
| Example 37 | Reference Example 1 | SHALLOL AN-103P | N6 | 60 nm | 0%: diameters of fibers more than 100 nm | 0.01 | PET woven fabric | Spraying of nanofiber dispersion liquid |
| Example 38 | Reference Example 1 | SHALLOL AN-103P | N6 | 60 nm | 0%: diameters of fibers more than 100 nm | 0.01 | PET woven fabric | Spraying of nanofiber dispersion liquid |
| Example 39 | Reference Example 1 | SHALLOL AN-103P | N6 | 60 nm | 0%: diameters of fibers more than 100 nm | 0.01 | Paper | Spraying of nanofiber dispersion liquid |
| Example 40 | Reference Example 1 | SHALLOL AN-103P | N6 | 60 nm | 0%: diameters of fibers more than 100 nm | 0.01 | Foam | Spraying of nanofiber dispersion liquid |
| Example 41 | Reference Example 1 | SHALLOL AN-103P | N6 | 60 nm | 0%: diameters of fibers more than 100 nm | 0.01 | PET film | Spraying of nanofiber dispersion liquid |
| Example 42 | Reference Example 1 | SHALLOL AN-103P | N6 | 60 nm | 0%: diameters of fibers more than 100 nm | 0.01 | Stainless steel wire mesh | Dropping (coating) of nanofiber dispersion liquid |

TABLE 8-continued

| | Nanofiber dispersion liquid | Dispersant in nanofiber dispersion liquid | Nanofibers: Polymer | Number average diameter | Fiber ratio of thick fibers | Dispersant content (wt. %) | Porous support | Nanofiber attaching method |
|---|---|---|---|---|---|---|---|---|
| Example 43 | Reference Example 8 | None | N6 | 60 nm | 0%: diameters of fibers more than 100 nm | 0.01 | Stainless steel wire mesh | Dropping (coating) of nanofiber dispersion liquid |
| Example 44 | Reference Example 9 | NOIGEN EA-87 | PPS | 60 nm | 0%: diameters of fibers more than 100 nm | 0.01 | PET ultrafine fiber nonwoven fabric | Spraying of nanofiber dispersion liquid |
| Example 45 | Reference Example 10 | SHALLOL AN-103P | N6 | 60 nm | 0%: diameters of fibers more than 100 nm | 0.01 | PET ultrafine fiber nonwoven fabric | Spraying of nanofiber dispersion liquid |
| Example 46 | Reference Example 11 | SHALLOL AN-103P | N6 | 60 nm | 0%: diameters of fibers more than 100 nm | 0.01 | PET ultrafine fiber nonwoven fabric | Spraying of nanofiber dispersion liquid |

TABLE 9

| | Polymer comprising nanofiber | Form of sheet-like material | Nanofibers number average: Diameter (nm) | Nanofibers number average: Fineness (dtex) | Nanofibers variation: Fineness ratio (%) | Nanofibers variation: Range: Diameter range (nm) | Nanofibers variation: Range: Area ratio (%) |
|---|---|---|---|---|---|---|---|
| Example 47 | N6 | Needle punched nonwoven fabric | 56 | $3 \times 10^{-5}$ | 99 | 55~84 | 71 |
| Example 48 | N6 | Needle punched nonwoven fabric | 56 | $3 \times 10^{-5}$ | 99 | 55~84 | 71 |
| Example 49 | N6 | Needle punched nonwoven fabric | 56 | $3 \times 10^{-5}$ | 99 | 55~84 | 71 |

| | Sheet-like material: Stress at 10% elongation (N/cm width) | Sheet-like material: Compressive elasticity ratio S | Sheet-like material: Abrasion resistance coefficient (mg) | Sheet-like material: Surface roughness (μm) | Sheet-like material: Surface hardness (A) | Texturing characteristics Texturing of hard disk: Substrate surface roughness (nm) | Texturing characteristics Texturing of hard disk: Counts of scratches (counts/10 substrates) |
|---|---|---|---|---|---|---|---|
| Example 47 | 15 | 2.6 | 30 | 19 | 40 | 0.22 | 88 |
| Example 48 | 10 | 2.7 | 28 | 18 | 34 | 0.21 | 85 |
| Example 49 | 14 | 2.5 | 29 | 21 | 42 | 0.23 | 91 |

Fineness ratio: A fineness ratio of fibers each of which a single fiber fineness falls within the range of $1 \times 10^{-8}$ to $1 \times 10^{-4}$ dtex.
Range: One example of a fineness ratio of fibers each of which a diameter falls within a width of 30 nm.

What is claimed is:

1. An abrasive cloth comprising a sheet material comprising polyurethane and having nanofibers of various finenesses made by a melt spinning method of a thermoplastic polymer at least in a surface of the abrasive cloth, the nanofibers of said surface of the abrasive cloth being formed of a napped surface of said nanofibers, the nanofibers having a number average single fiber fineness of all nanofibers in the abrasive cloth of $0.8\times10^{-5}$ to $2\times10^{-4}$ dtex and the sum of fineness ratios of single fiber finenesses in the range of $0.8\times10^{-5}$ to $2\times10^{-4}$ dtex of 75% or more, wherein stress at 10% elongation in a longitudinal direction is in the range of 10 to 200 N/cm width, wherein 70% or more of the nanofibers in a single fiber fineness ratio falls within a width of 30 nm in a single fiber diameter difference, and wherein a content of polyurethane is in the range of 20 to 60 wt. % of a fiber weight in the sheet material, and wherein the sheet material is impregnated with polyurethane.

2. The abrasive cloth according to claim 1, wherein the sheet material is made of a nonwoven fabric.

3. The abrasive cloth according to claim 1, wherein the sheet-like material is made of a woven fabric.

4. The abrasive cloth according to claim 1, wherein the sheet-like material is made of a knitted fabric.

5. The abrasive cloth according to claim 1, wherein a ratio S between a value of compressive elasticity of the sheet material under a load of 0.1 kg/cm$^2$ and that under a load of 0.5 kg/cm$^2$ is 4.0 or less.

6. The abrasive cloth according to claim 1, wherein an abrasion resistance coefficient of the sheet material is 50 mg or less.

7. The abrasive cloth according to claim 1, wherein a surface roughness value of the sheet material is 100 μm or less.

8. The abrasive cloth according to claim 1, wherein a surface hardness value of the sheet material is 20 or more.

9. The abrasive cloth according to claim 1, wherein the sheet material is formed in such a way that nanofibers are laminated on a support.

10. The abrasive cloth according to claim 9, wherein a thickness of the nanofiber laminated layer is 70% or less of a thickness of the whole abrasive cloth.

11. The abrasive cloth according to claim 1, wherein the sheet material has a space inside thereof, and the space is impregnated with a polymeric elastomer.

12. The abrasive cloth according to claim 11, wherein the polymeric elastomer is polyurethane.

13. The abrasive cloth according to claim 11, wherein a content of the polymeric elastomer is in the range of 20 to 60 wt. % of a fiber weight of the sheet material.

14. An abrasive cloth comprising a sheet material comprising polyurethane and having nanofibers of various finenesses made by a melt spinning method of a thermoplastic polymer at least in a surface of the abrasive cloth, the nanofibers of said surface of the abrasive cloth being formed of a napped surface of said nanofibers, the nanofibers having a number average single fiber fineness of all nanofibers in the abrasive cloth of $0.8\times10^{-5}$ to $2\times10^{-4}$ dtex and the sum of fineness ratios of single fiber finenesses in the range of $0.8\times10^{-5}$ to $2\times10^{-4}$ dtex of 75% or more, wherein stress at 10% elongation in a longitudinal direction is in the range of 10 to 200 N/cm width, wherein a ratio S between a value of compressive elasticity of the sheet material under a load of 0.1 kg/cm$^2$ and that under a load of 0.5 kg/cm$^2$ is 4.0 or less, and wherein a content of polyurethane is in the range of 20 to 60 wt. % of a fiber weight in the sheet material, and wherein the sheet material is impregnated with polyurethane.

* * * * *